US008939842B2

(12) United States Patent
Ehrmann

(10) Patent No.: US 8,939,842 B2
(45) **Date of Patent: *Jan. 27, 2015**

(54) METHOD AND SYSTEM FOR OPERATING A SELF-PROPELLED VEHICLE ACCORDING TO SCENE IMAGES

(75) Inventor: Eric Ehrmann, Beit Shemesh (IL)

(73) Assignee: Meimadtek Ltd., Beit Shemesh (IL)

( * ) Notice: Subject to any disclaimer, the term of this patent is extended or adjusted under 35 U.S.C. 154(b) by 831 days.

This patent is subject to a terminal disclaimer.

(21) Appl. No.: 12/687,126

(22) Filed: Jan. 13, 2010

(65) Prior Publication Data

US 2011/0003640 A9 Jan. 6, 2011

Related U.S. Application Data

(60) Provisional application No. 61/204,915, filed on Jan. 13, 2009, provisional application No. 61/241,914, filed on Sep. 13, 2009.

(51) Int. Cl.

| | |
|---|---|
| ***A63F 9/24*** | (2006.01) |
| ***A63F 13/00*** | (2014.01) |
| ***A63H 30/04*** | (2006.01) |
| ***A63F 7/06*** | (2006.01) |

(52) U.S. Cl.

CPC ..... *A63H 30/04* (2013.01); *A63F 7/0664* (2013.01); *A63F 2009/2419* (2013.01); *A63F 2009/2435* (2013.01); *A63F 2300/1093* (2013.01)

USPC ..... 463/62; 463/58; 701/28; 701/523; 348/118; 348/119

(58) Field of Classification Search

CPC ..... G06K 9/00791

USPC ..... 701/28, 523; 348/118, 119

See application file for complete search history.

(56) References Cited

U.S. PATENT DOCUMENTS

| | | | | |
|---|---|---|---|---|
| 4,753,569 | A | 6/1988 | Pryor | |
| 5,471,312 | A | 11/1995 | Watanabe et al. | |
| 5,723,855 | A * | 3/1998 | Oh et al. | 250/206.1 |

(Continued)

FOREIGN PATENT DOCUMENTS

| | | |
|---|---|---|
| EP | 0367526 | 5/1990 |
| EP | 1437636 | 7/2004 |

(Continued)

OTHER PUBLICATIONS

PCT Search report of PCT/US2010/020952 mailed Jan. 18, 2011.

(Continued)

*Primary Examiner* — Steven J Hylinski

(74) *Attorney, Agent, or Firm* — Marc Van Dyke; 4th Dimension IP

(57) ABSTRACT

The present disclosure relates to a robotic system including one or more self-propelled motorized vehicles 120 (SPMV) whose motion is controlled in accordance with electronic image data acquired by one or more observing camera(s) 110 configured to image a scene including the SPMV 120. In some embodiments, the SPMV includes one or more on-board lights 124, and the SPMV is operated according to analyzing images acquired by the observing camera before and after an illumination transition of one or more of the point-lights. Some embodiments relate techniques to computer gaming and/or to stereoscopic image processing techniques.

10 Claims, 55 Drawing Sheets

(56) References Cited

U.S. PATENT DOCUMENTS

| | | | |
|---|---|---|---|
| 6,109,186 | A | 8/2000 | Smith et al. |
| 6,304,050 | B1 | 10/2001 | Skaar et al. |
| 6,380,844 | B2 | 4/2002 | Pelekis |
| 6,780,077 | B2 | 8/2004 | Baumgartner et al. |
| 7,402,106 | B2 | 7/2008 | Weisel, Jr. et al. |
| 2002/0102910 | A1 | 8/2002 | Donahue et al. |
| 2003/0232649 | A1 | 12/2003 | Gizis et al. |
| 2005/0254709 | A1 | 11/2005 | Geshwind et al. |
| 2006/0111014 | A1 | 5/2006 | Hayashi |
| 2007/0097832 | A1 | 5/2007 | Koivisto et al. |
| 2007/0243914 | A1 | 10/2007 | Yan et al. |
| 2007/0293124 | A1 | 12/2007 | Smith et al. |
| 2008/0018595 | A1 | 1/2008 | Hildreth et al. |
| 2008/0252248 | A1 | 10/2008 | Lundberg et al. |
| 2009/0081923 | A1 | 3/2009 | Dooley et al. |

FOREIGN PATENT DOCUMENTS

| | | |
|---|---|---|
| EP | 1607194 | 12/2005 |
| KR | 20030042432 | 5/2003 |
| KR | 20090000013 | 1/2009 |

OTHER PUBLICATIONS

PCT Search opinion of PCT/US2010/020952 mailed Jan. 18, 2011.

PCT Preliminary patentability opinion of PCT/US2010/020952 mailed Mar. 13, 2012.

"Camera Calibration using Mobile Robot in Intelligent Space" by Takeshi Sasaki and Hideki Hashimoto, SICE-ICASE International Joint Conference 2006 Oct. 18-21, 2006 in Bexco, Busan, Korea.

"Automated Calibration of a Camera Sensor Network" by Ioannis Rekleitis and Gregory Dudek, 2005 IEEE/RSJ International Conference on Intelligent Robots and Systems Published in 2005.

"Distributed Smart Camera Calibration using Blinking LED" by Michael Koch et al. Published in ACIVS '08 Proceedings of the 10th International Conference on Advanced Concepts for Intelligent Vision Systems pp. 242-253 (Springer-Verlag Berlin). Published in 2008.

USPTO office action for U.S. Appl. No. 13/157,414—office action was mailed on Mar. 14, 2013.

* cited by examiner

G.E. and others

G.E. and others

G.E. and others

G.E. and others

G.E.

G.E.

User Direct Control of User SPMV

G.E.

Computer Direct Control of Computer SPMV According to Output of Electronic Game Strategy Engine G.E. and others G.E. and others Use Case 3:
Mechanical motion/
Displacement in
$\Phi$-space of the SPMV G.E. and others G.E. and others G.E. and others G.E. and others

Method Effected by Element 952

G.E. and others

G.E. and others

Method Effected by Element 952

Optionally: Update the game application that the car Has not yet reached its position

METHOD AND SYSTEM FOR OPERATING A SELF-PROPELLED VEHICLE ACCORDING TO SCENE IMAGES

CROSS-REFERENCE TO RELATED APPLICATIONS

This patent application claims the benefit of U.S. Provisional Patent Application No. 61/204,915, filed Jan. 13, 2009 and the benefit of U.S. Provisional Patent Application No. 61/241,914, filed Sep. 13, 2009.

FIELD OF THE INVENTION

The present invention relates to robotics and/or computer vision, and in some embodiments, to gaming.

BACKGROUND AND RELATED ART

The following patent documents and non-patent publications describe potentially relevant background art, and are each incorporated herein by reference in their entirety: U.S. Pat. No. 5,471,312, U.S. Pat. No. 4,753,569, US 20070243914, US 20070293124, US 20020102910, U.S. Pat. No. 6,109,186, U.S. Pat. No. 6,380,844, U.S. Pat. No. 6,780,077, US 20090081923, US 20060111014, U.S. Pat. No. 7,402,106, US 20070097832. US 20030232649, "Camera Calibration using Mobile Robot in Intelligent Space" by Takeshi Sasaki' and Hideki Hashimoto, "Automated Calibration of a Camera Sensor Network" by Ioannis Rekleitis and Gregory Dudek, "Distributed Smart Camera Calibration using Blinking LED" by Michael Koch et al.

No admission has been made that any of the aforementioned documents is a prior art document.

SUMMARY OF EMBODIMENTS

It is now disclosed for the first time a gaming system for providing a gaming service to a user, the gaming system comprising: a. electronic control circuitry; b. a user-directly-controlled self-propelled motorized vehicle (SPMV) operative to move responsively to wirelessly-received user-generated direct commands provided by mechanical motion and/or brainwaves of the user; c. an array of one or more cameras configured to generate an electronic image a scene including the user-directly-controlled SPMV; and d. a computer-directly-controlled SPMV operative to move responsively to computer-generated direct commands that generated by the electronic control circuitry in accordance with: i) one or more game objectives; and ii) a position or orientation, within the electronic image of the scene, of the user-directly-controlled SPMV.

In some embodiments, the electronic control circuitry generates commands to control translational or rotational movement of computer-directly-controlled SPMV in accordance with at least one of: i) a distance between computer-directly-controlled SPMV and/or user-directly-controlled SPMV and a foreign object as determined in accordance with a Euclidian scene reconstruction of the electronic scene image; ii) historical and/or present and/or predicted future contents of a Euclidian world description data structure as determined in accordance with a Euclidian scene reconstruction of the electronic scene image; iii) historical and/or present and/or predicted contents of a game world description data structure.

In some embodiments, the electronic control circuitry includes game strategy circuitry for enforcing one or more of the one or more of the game objectives.

In some embodiments, the electronic control circuitry is operative to: i) detect the user-generated direct commands according to mechanical motion of a user control device or according to a detected gesture of the or a portion thereof; ii) wirelessly transmit the detected commands to the user-directly-controlled SPMV.

In some embodiments, the user control device is selected from the group consisting of a joystick, a mouse, a keyboard, and an accelerometer.

In some embodiments, the electronic control circuitry is operative generate the computer-generated direct commands for controlling the computer-directly-controlled SPMV in accordance with game rules of and/or strategy directives for a game selected from the group consisting of: a) a shooting game; b) a ball game; and c) a hand-to-hand combat game.

In some embodiments, the control electronic circuitry is operative to generate the computer-generated direct commands in accordance with a measured Euclidian distance within the electronic image of the scene between the user-directly-controlled SPMV and foreign object in the scene.

In some embodiments, at least one gaming objective is selected from the group consisting of: a) an objective to score or a goal with a ball or puck; b) an objective to block a goal from being scored with a ball or puck; c) an objective to score or prevent a touchdown or field goal; d) an objective to score a hit against combat game vehicle with a projectile or abeam of light; e) an objective to reduce a probability of a hit being scored against a combat game vehicle with a projectile or a beam of light; and f) an objective to move or grab a game prop with computer SPMV is the game prop is grabbed by user SPMV.

It is now disclosed for the first time a method of operating a self-propelled motorized vehicle (SPMV) including one or more electronically controlled onboard light(s) that effect illumination transition(s) that modifies brightness and/or color of one or more of the onboard lights, the SPMV located within a scene observed by an observing electronic camera, the method comprising: a) obtaining first and second electronic images acquired by the camera, the first image being a pre-transition electronic image $IMP_{PRE}$ describing the before the illumination transition and the second electronic image being a post-transition electronic image $IMG_{POST}$ describing the SPMV after the illumination transition; and b) comparing the first and second electronic images to determine for each onboard light of one or more of the onboard lights, a respective pixel location within the first and/or second electronic image; c) determining, from the pixel location(s) and camera calibration data for the camera, a respective Euclidian location for each onboard light of the one or more onboard lights; and d) in accordance with the determined Euclidian location(s) of the on-board light(s) electronically controlling rotational and/or translational movement of the SPMV or a portion thereof.

It is now disclosed for the first time a method of controlling a self-propelled motorized vehicle (SPMV) including one or more onboard lights operative to effect an illumination transition that modifies brightness and/or color of one or more of the onboard lights, the method comprising: a) obtaining a time series of images of a scene including the SPMV; b) determining a Euclidian location of the SPMV according to the illumination transition as described by the image time series; and c) controlling rotational and/or translational movement of the SPMV or a portion thereof according to the determined Euclidian location.

It is now disclosed for the first time a method of operating a self-propelled motorized vehicle (SPMV) in accordance with camera calibration data of an electronic camera, the camera calibration data relating pixel-image locations to real-world locations, the SPMV including one or more onboard lights the method comprising: a) electronically controlling the onboard light(s) of the SPMV to induce an illumination transition that modifies brightness and/or color of one or more of the onboard lights; b) comparing first and second electronic images acquired by the camera, the image being a pre-transition electronic image $IMG_{PRE}$ describing the SPMV before the illumination transition and the second electronic image being a post-transition electronic image $IMG_{POST}$ describing the SPMV after the illumination transition; and c) in accordance with results of the comparing, electronically controlling rotational and/or translational movement of the SPMV or a portion thereof.

In some embodiments, the Euclidian location of the SPMV is determined primarily by analyzing one or more image(s) of the image time series. In some embodiments, the controlling of the rotational and/or translational movement of the SPMV is carried out according to the combination of: i) the Euclidian location of the onboard light(s); and ii) other information derivable from one or more electronic images acquired by the camera.

In some embodiments, the other information describes one or more foreign objects in the scene.

In some embodiments, the foreign object information is selected from the group consisting of color information for the foreign object, surface texture information for the foreign object, and motion information describing translational or rotational motion of the foreign object.

In some embodiments, the controlling of the rotational and/or translational movement of the SPMV is carried out according to the combination of:

i) the Euclidian location of the onboard light(s); and ii) information that is a Euclidian description of a real or virtual boundary in the scene.

In some embodiments, the controlling of the rotational and/or translational movement of the SPMV is carried out according to the combination of: i) the Euclidian location of the onboard light(s); and ii) a stereoscopic description of the scene obtained by analyzing images from multiple observing cameras that view the scene.

It is now disclosed for the first time a system comprising: a) a self-propelled motorized vehicle (SPMV) including one or more onboard lights operative to effect an illumination transition that modifies brightness and/or color of one or more of the onboard lights b) an observing camera operative to acquire a time series of images of a scene including the SPMV; and c) electronic circuitry operative to: i) determine a real-world location of the SPMV according to the illumination transition as described by the image time series and according to camera calibration data for the observing camera that relates pixel-image locations to real-world locations; and ii) control rotational and/or translational movement of the SPMV or a portion thereof according to the determined real-world location of the SPMV.

It is now disclosed for the first time a system comprising: a) a self-propelled motorized vehicle (SPMV) including one or more onboard lights operative to effect an illumination transition that modifies brightness and/or color of one or more of the onboard lights b) an observing camera operative to acquire a time series of images of a scene including the SPMV; and c) control circuitry operative to control rotational and/or translational movement of the SPMV or a portion thereof according to a Euclidian location of the SPMV as determined by an illumination transition as described by the image time series.

In some embodiments, the Euclidian location of the SPMV is determined primarily by analyzing one or more image(s) of the image time series.

In some embodiments, the controlling of the rotational and/or translational movement of the SPMV is carried out according to the combination of: i) the Euclidian location of the onboard light(s); and ii) other information derivable from one or more electronic images acquired by the camera.

In some embodiments, the other information describes one or more foreign objects in the scene.

In some embodiments, the foreign object information is selected from the group consisting of color information for the foreign object, surface texture information for the foreign object, and motion information describing translational or rotational motion of the foreign object.

In some embodiments, the controlling of the rotational and/or translational movement of the SPMV is carried out according to the combination of: i) the Euclidian location of the onboard light(s); and ii) information that is a Euclidian description of a real or virtual boundary in the scene.

In some embodiments, the controlling of the rotational and/or translational movement of the SPMV is carried out according to the combination of: i) the Euclidian location of the onboard light(s); and ii) a stereoscopic description of the scene obtained by analyzing images from multiple observing cameras that view the scene.

It is now disclosed for the first time a method of controlling a self-propelled motorized vehicle (SPMV) including one or more onboard lights operative to sequentially effect a plurality of illumination transitions, each transition modifying brightness and/or color of one or more of the onboard lights, the method comprising: a) obtaining a time series of images of a scene including the SPMV, each image being generated by an observing camera observing the scene; b) computing, according to a first illumination transition set of one or more illumination transitions as described by the image time series, calibration data including at least one of: i) camera calibration data including extrinsic camera calibration data for the observing camera, the camera calibration data relating pixel-image locations to Euclidian locations; ii) SPMV motor calibration data relating SPMV motor energy inputs to Euclidian displacements describing movement of the SPMV or a portion thereof; iii) servo motor calibration data for a servo on which the observing camera is mounted, the servo calibration data relating servo motor energy inputs to perceived Euclidian displacements of the SPMV as perceived by the servo-moved camera moved the servo; c) determining, according to: i) a second illumination transition set of one or more illumination transitions as described by the image time series; and ii) camera and/or SPMV motor and/or servo motor calibration data, a Euclidian location of the SPMV; and d) controlling rotational and/or translational movement of the SPMV or a portion thereof according to the determined Euclidian location.

In some embodiments, the Euclidian location determining is carried out primarily according to images of the image time series.

In some embodiments, i) the calibration data is computed primarily according to analysis of the time series of images; and ii) the analysis includes analyzing illumination transitions of one or more of the onboard lights.

In some embodiments, i) the obtaining of the images of the image time series used for the calibration data computing includes: A) acquiring a calibration set of calibration images that all describe the SPMV in a fixed location in (R, Φ) space which describes relative translational and configurational displacement between camera and SPMV, all images of the calibration set of calibration images being identical except for illumination-transition-associated deviations; and B) effecting image comparison between images of the calibration set of calibration images to compute pixel locations of one or more of the lights at locations associated with image transitions of the calibration set and where images of the calibration set image deviate from each other; and ii) the calibration data is determined in accordance with results of the image subtractions.

In some embodiments, steps (i)(A) and (i)(B) are carried out a plurality of times, each time for a different respective fixed location in (R,Φ) space.

In some embodiments, the first and second illumination transition sets are disjoint sets.

In some embodiments, the first and second illumination transition sets are non-disjoint sets.

In some embodiments, the determining of the calibration data including the extrinsic calibration data is an ab initio determining for the extrinsic calibration data.

In some embodiments, the controlling is carried out according to a combination of the determine Euclidian location and other scene information present in image(s) of the time series besides information describing the onboard lighting.

It is now disclosed for the first time a method of providing access for a client device or client application to a self-propelled motorized vehicle (SPMV) that is located in a field of view of an observing camera the method comprising: a) sending one or more commands to the SPMV or to a servo on which the camera is mounted to induce translational or rotational movement of the SPMV or a portion thereof relative to the observing camera b) obtaining a time series of images of a scene including the SPMV, each image being generated by the observing camera and associated with a different location in appearance space (R, Φ, I) for the SPMV that is provided according to the commands of step (a); c) computing, according to differences in the appearance of the SPMV in at least some of the images of the time series, calibration data including at least one of: i) camera calibration data including extrinsic camera calibration data for the observing camera, the camera calibration data relating pixel-image locations to Euclidian locations; ii) SPMV motor calibration data relating SPMV motor energy inputs to Euclidian displacements describing movement of the SPMV or a portion thereof; iii) servo motor calibration data for a servo on which the observing camera is mounted, the servo calibration data relating servo motor energy inputs to perceived Euclidian displacements of the SPMV as perceived by the servo-moved camera moved the servo; d) receiving from the client device or the client application a Euclidian command(s) for the SPMV; e) translating the Euclidian movement command(s) to one or more motor command(s) according to the calibration data; f) sending the motor commands of step (e) to the SPMV; g) performing a Euclidian scene reconstruction of one or more images of the time series according to the calibration data; and h) providing a description of the Euclidian scene reconstruction to the client device or client application. It is now disclosed for the first time a method of providing access for a client device or client application to a self-propelled motorized vehicle (SPMV) including one or more onboard lights operative to sequentially effect a plurality of illumination transitions, each transition modifying brightness and/or color of one or more of the onboard lights, the method comprising: a) obtaining a time series of images of a scene including the SPMV, each image being generated by an observing camera observing the scene; b) computing, according to a illumination transition set of one or more illumination transitions as described by the image time series, calibration data including at least one of: i) camera calibration data including extrinsic camera calibration data for the observing camera, the camera calibration data relating pixel-image locations to Euclidian locations; ii) SPMV motor calibration data relating SPMV motor energy inputs to Euclidian displacements describing movement of the SPMV or a portion thereof; iii) servo motor calibration data for a servo on which the observing camera is mounted, the servo calibration data relating servo motor energy inputs to perceived Euclidian displacements of the SPMV as perceived by the servo-moved camera moved the servo; c) receiving from the client device or the client application a Euclidian command(s) for the SPMV; d) translating the Euclidian movement command(s) to one or more motor command(s) according to the calibration data; e) sending the motor commands of step (d) to the SPMV; f) performing a Euclidian scene reconstruction of one or more images of the time series according to the calibration data; and g) providing a description of the Euclidian scene reconstruction to the client device or client application.

It is now disclosed for the first time a method of providing a gaming service to a user, the gaming system comprising: a. operating a user-directly-controlled self-propelled motorized vehicle (SPMV) to move responsively to wirelessly-received user-generated direct commands provided by mechanical motion and/or brainwaves of the user; b. obtaining a time series of images of a scene including the user-directly-controlled SPMV; and c. providing commands to a computer-generated direct commands in accordance with: i) one or more game objectives; and ii) a position and/orientation, within the electronic image(s) of the scene, of the user-directly-controlled SPMV 120U.

It is now disclosed for the first time a method of computing post-rotation extrinsic camera calibration of a camera that is subjected to a mechanical rotation such that before the motion the camera's field of view is $FOV_{PRE}$ and the camera's extrinsic calibration data is defined by $CALIB_{PRE}$ and after the motion the camera's field of $FOV_{POST}$, the method comprising: a) before the camera mechanical rotation, operating the camera to acquire a pre-rotation image $IMG_{PRE}$ associated with $FOV_{PRE}$; b) after the camera mechanical rotation, operating the camera to acquire a post-rotation image $IMG_{POST}$ associated with $FOV_{PRE}$ which has an overlap of between 10% and 70% (for example, between 20% and 40% overlap) with $FOV_{PRE}$; c) if one of the pre-rotation image $IMG_{PRE}$ and the post-rotation image $IMG_{POST}$ is designated as a first image and the other of the pre-rotation image $IMG_{PRE}$ and the post-rotation image $IMG_{POST}$ is designated as the second image, for each candidate rotation angle of a plurality of candidate rotation angles: i) respectively applying a virtual-camera-rotation transformation function to virtually rotate the first image, thereby obtaining a respective angular-transformed image; ii) respectively measuring a pixel-match function describing the pixel matchings between at least portion of the respective angular-transformed image and least a portion of the other of the second image; d) according to the measured pixel matching functions, selecting a matching candidate rotation angle describing an estimated value of the mechanical rotation value of the mechanical rotation to which the camera is subjected; and e) computing the post-rotation camera external calibration data for the camera according to: i) the preferred candidate rotation angle; and ii) $CALEB_{PRE}$ which defines the camera's extrinsic calibration data before the rotation.

In some embodiments, i) the camera is mounted on a servo assembly and which subjects the camera to the mechanical rotation according to a delivered power parameter describing delivered power which is delivered to one or more motors of the servo assembly; ii) the candidate rotation angles are selected according to a relationship between the power parameter and an estimated rotation provided by the servo assembly.

In some embodiments, the method further comprises: f) controlling translational and/or rotational motion of an SPMV in a field of view of the camera in accordance with the computed post-rotation camera external calibration data.

It is now disclosed a method of operating a self-propelled motorized vehicle (SPMV) 120 including one or more electronically controlled onboard mechanical shutters 124 that effect mechanical shutter transition(s) that modifies color appearance of a location on SPMV housing, the SPMV located within a scene observed by an observing electronic camera 110, the method comprising: a) obtaining first and second electronic images acquired by the camera, the first image being a pre-transition electronic image $IMG_{PRE}$ describing the SPMV 120 before the mechanical shutter transition and the second electronic image being a post-transition electronic image $IMG_{POST}$ describing the SPMV 120 after the mechanical shutter transition; and b) comparing the first and second electronic images to determine for each onboard mechanical shutter assembly of one or more of the onboard mechanical shutter assemblies, a respective pixel location within the first and/or second imagec) determining, from the pixel location(s) and camera calibration data for the camera, a respective Euclidian location for each onboard mechanical shutter of the one or more onboard mechanical shutter(s); and d) in accordance with the determined Euclidian location(s) of the on-board mechanical shutter(s), electronically controlling rotational and/or translational movement of the SPMV or a portion thereof.

It is now disclosed for the first time a method of controlling a self-propelled motorized vehicle (SPMV) 120 including one or more onboard mechanical shutter(s) operative to effect an mechanical shutter transition that color appearance of a location on SPMV housing, the method comprising: a) obtaining a time series of images of a scene including the SPMV 120; b) determining a Euclidian location of the SPMV according to the mechanical shutter transition as described by the image time series; and c) controlling rotational and/or translational movement of the SPMV or a portion thereof according to the determined Euclidian location.

It is now disclosed a method of operating a self-propelled motorized vehicle (SPMV) 120 in accordance with camera calibration data of an electronic camera 110, the camera calibration data relating pixel-image locations to real-world locations, the SPMV including one or more mechanical shutters, the method comprising: a) electronically controlling the onboard mechanical shutter(s) of the SPMV 120 to induce an mechanical shutter transition that modifies a color appearance of a location on SPMV housing; b) comparing first and second electronic images acquired by the camera, the image being a pre-transition electronic image $IMG_{PRE}$ describing the SPMV 120 before the mechanical shutter transition and the second electronic image being a post-transition electronic image $IMG_{POST}$ describing the SPMV 120 after the mechanical shutter transition; and c) in accordance with results of the comparing, electronically controlling rotational and/or translational movement of the SPMV or a portion thereof.

This summary section should not be construed as limiting the invention to any features described in this summary section.

DETAILED DESCRIPTION OF EMBODIMENTS

Introductory Discussion

Embodiments of the present invention relate to a system and method for operating a self-propelled motor vehicle (SPMV) according to electronic images of the SPMV acquired by an 'observer' electronic camera viewing a scene which includes the SPMV. Some embodiments of the present invention relate to the world of robotic gaming. Other embodiments relate to other applications, including but not limited to manufacturing applications, domestic applications, and agricultural applications.

Figure 1:
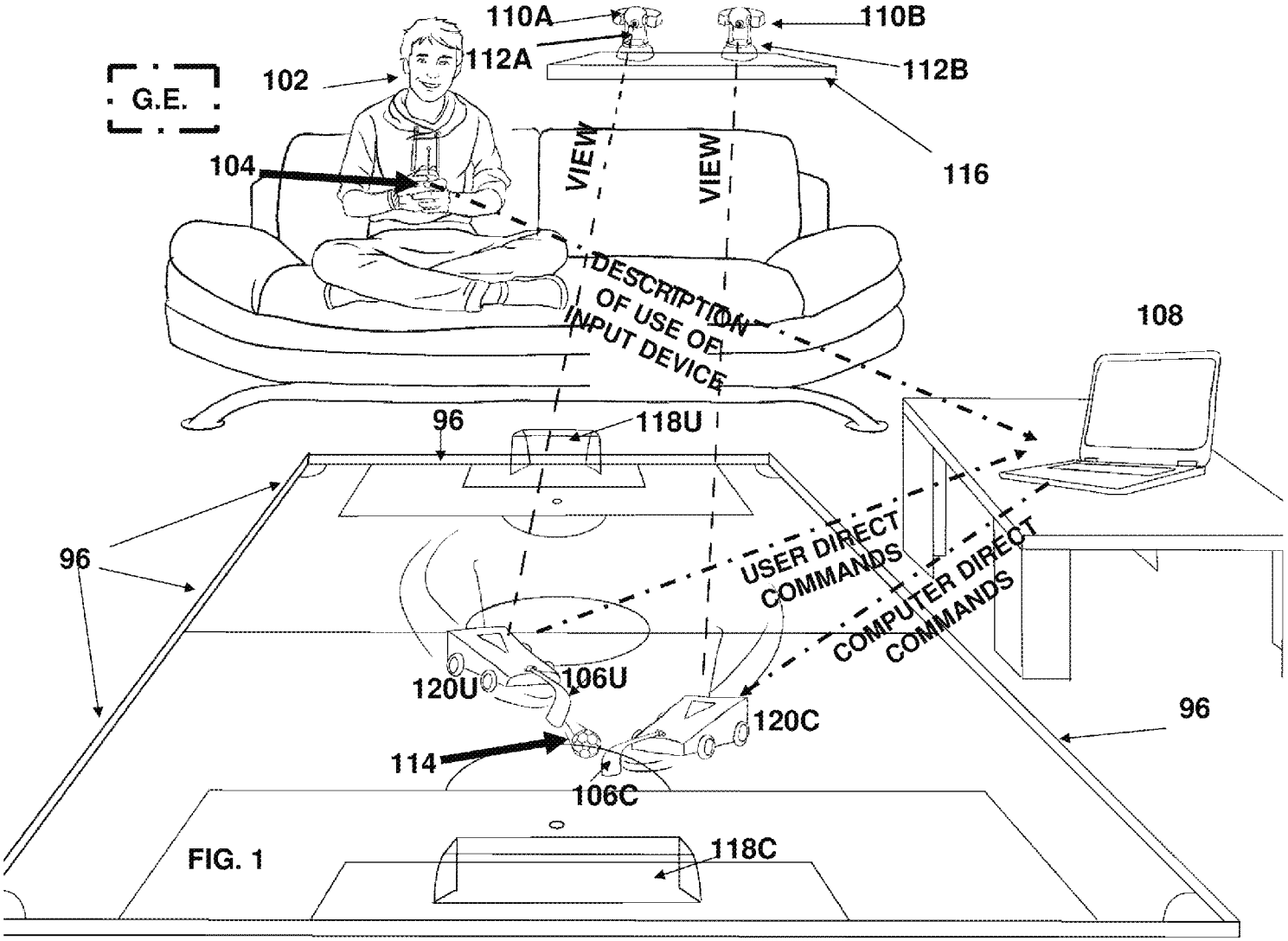
FIGS. 1, 2B illustrate a use case where a human user controls a user robot in a soccer game against a computer-controlled robot.

FIG. 1 illustrates a use case related to some gaming embodiments of the present invention. In the non-limiting example of FIG. 1, a human user 102 plays a robotic soccer game against a computer opponent—the user's robot 120U (also referred to as a user-directly-controlled SPMV or simply 'user SPMV') defends the user's soccer goal 118U while the computer's robot 120C (also referred to as a computer-directly-controlled SPMV or simply 'computer SPMV') defends the computer's soccer goal 118C. The scene is viewed by one or more electronic camera(s) 110 which repeatedly acquires electronic images of the scene including user-directly-controlled SPMV 120U and/or computer-directly-controlled SPMV 120C.

Human user 102 employs user input device/controller 104 (exemplary controllers include but are not limited to a keyboard or joystick, mobile phone) to generate direct movement commands for user SPMV 120U, and user SPMV moves (i.e. changes its location in R-space or and/or its configuration) in response to the direct movement commands generated by user input device 104.

In the example of FIG. 1, computer-directly-controlled SPMV 120C is configured to play a soccer game against user SPMV 120U in accordance with (i) contents of the electronic images of the scene acquired by electronic camera(s) 110 which describe the 'game world' and (ii) one or more game objectives for the game. For the game of soccer (referred to as "football" outside of the United States and Canada), game objectives may include attempting to cause ball 114 to cross the plane of user goal 118U and attempting to prevent ball 114 from crossing the plane of computer goal 118C.

User SPMV 120U includes an onboard wireless receiver for receiving the user-generated (i.e. generated by user input device 104 according to the user's motion or thoughts) commands while computer SPMV 120C includes an onboard wireless receiver for receiving the computer-generated commands.

In one use case, user SPMV 120U controls ball 114 (in sports lingo, SPMV 120U is 'in possession' of the ball). In this use case, SPMV 120U moves with ball 114 towards the table on which computer unit 108 is resting. In this use case, to realize one or more of the game objectives listed above, it may be advantageous for computer-directly-controlled SPMV 120C to attempt to "steal" the ball 114 from user-directly-controlled SPMV 120C. Thus, in this use case, software executing on computer unit 108 (i) analyzes images acquired by camera(s) 110 to detect the movement of user-directly-controlled SPMV 120C towards the table; and (ii) in response to this movement by SPMV 120U, in order to attempt to meet the game objective, controls SPMV 120C to move towards the table to increase the likelihood that SPMV 120C could 'steal' ball 114 from SPMV 120U.

Although not a requirement, in the non-limiting example of FIG. 1, each camera is respectively mounted on a respective mechanical servo assembly or pan-and-tilt system 112 As will be discussed below, this may be useful for extending the 'virtual' field of view of any camera 110 and/or for camera calibration.

The system illustrated in FIG. 1 may be provided using any combination of software and/or hardware. Some embodiments of FIG. 1 relate to a software translation layer having an exposed interface (see for example, FIGS. 27A-27B).

In FIG. 1, the 'game boundary' for the soccer game is indicated by number 96. In some embodiments, one input influencing how computer SPMV 120C operates is a distance between user SPMV 120U and boundary 96, or between computer SPMV 120C and boundary 96, or between the ball 'game prop' 114 and boundary 96. In the example of FIG. 1, the game boundary is a physical boundary visible to the user 102—in another example, the user may input via computer unit 108 a description of boundary 96.

A more in-depth discussion of FIG. 1 and various game embodiments is provided below.

Some embodiments of the present invention relate to a technique for operating an SPMV that includes one or more on-board lights 124 (for example, LEDs or micro-halogen lights or compact fluorescent lights or any other type of light) (see, for example, FIG. 2A) that are attached to specific locations on the housing of SPMV 120. These onboard lights 124 may be electronically controlled to effect illumination transitions of brightness or color (a simple example of which is turning on and off of the onboard lights). By comparing an electronic image acquired before an illumination transition with an electronic image acquired after the illumination transition, it is possible to acquire data (for example, data describing the Euclidian location of the SPMV) useful for operating the SPMV. Some embodiments relate to techniques of operating the SPMV having onboard lights according to this image comparison data.

Operating the SPMV includes but is not limited to translating, rotating of the SPMV 120 for any purpose including but not limited to avoiding an obstacle, moving the SPMV 120 in the context of a camera calibration routine, to attempt to fulfill one or more game objectives and for a manufacturing purpose.

In some embodiments, this technique for operating the SPMV (described in more detail below with reference to FIG. 2A and other figures) relates to robotic gaming—it is noted that onboard lights are not illustrated in FIG. 1, however they may be provided in some embodiments. In another example (see FIG. 3), a robotic vacuum-cleaner (which is also a SPMV 120) optionally including onboard lights 124 (see FIG. 3B) attached to the housing is electronically controlled in response to results of image comparison between an image acquired before the illumination transition and an image acquired after the illumination transition. This may be useful for a number of purposes,—for example, in order to avoid obstacles, to clean certain locations, etc.

In some embodiments, the system is 'self-sufficient,' (i) not requiring any special calibration object and (ii) operative with 'loosely positioned cameras' whose position may not be known a-priori (for example, placed on a substantially flat surface by a user who is not necessarily a trained technician) (iii) not requiring any additional range or position-detecting technologies such as odometers, IR range finders, ultrasound sonar etc. It is possible to both (i) electronically control SPMV 120 (for example, by wirelessly sending commands) to turn onboard lights 124 on and off or to modify color or brightness of onboard lights 124 and (ii) electronically control translation and/or rotation of SPMV or a component thereof. A series of electronic images are acquired for various 'lighting states' and various positions and/or configurations of SPMV. Calibration data for one or more camera(s) 110 may be computed from this series of electronic images.

Furthermore, some embodiments provide routines for calibrating servo assembly 112 and/or a motor of SPMV 120 in a manner that is automatic, does not require any special object, and facilitates a 'self-sufficient' system within a minimum number of required components.

In the example of FIGS. 1 and 3, a plurality of cameras 110 are employed by the system. Some embodiments of the present invention relate to apparatus and methods for approximate real-time stereoscopic scene reconstruction. In some embodiments, the real-time stereoscopic scene reconstruction may be implemented using only relatively modest computational resources.

As noted above, in some embodiment, a servo assembly 112 may be provided to expand the virtual "field of view of camera 110". Towards this end, some embodiments of the present invention relate to image processing techniques that may be employed even when relatively 'low-grade' servos without reliable and/or accurate calibration between electronic command(s) to move the servo and the actual angle that the servo mechanically rotates in response to the electronic command(s).

In the examples of FIGS. 1 and 3, the camera(s) 110 are in wireless communication with computer 108. In another implementation, camera(s) 110 are connected to computer 108 via electrical cable(s).

There is no limitation on the size or shape of SPMV 120 of any other object depicted in the figures. Thus, although the SPMV in FIGS. 1, 3A reflect certain 'length scale' (for example, appropriate for a toy radio-controlled car or a vacuum cleaner), in other embodiments, SPMV 120 may be smaller or much larger (for example, the size of a standard automobile or even larger).

Throughout the figures, figures that refer specifically to game embodiments are labeled with the label ("GE") and figures that refer to both game embodiments and other game embodiments are labeled with the label "GE and Others."

A Discussion of FIGS. 4A-D

FIG. 4A-4D are block diagrams of various systems that include one or more SMPV(s) 120 in the field of view of one or more camera(s) 110. The system may be a gaming system, a system for vacuuming a room or cleaning a room (for example, picking up items and putting them away on a shell), a system used for manufacturing (for example, including a robotic forklift), an office-environment or home-environment system (for example, including a robotic coffee dispenser), a system used for agriculture (for example, a robotic plow for plowing a field or a robotic fruit or vegetable picker) or any a system provided for any other purpose.

Figure 4A:
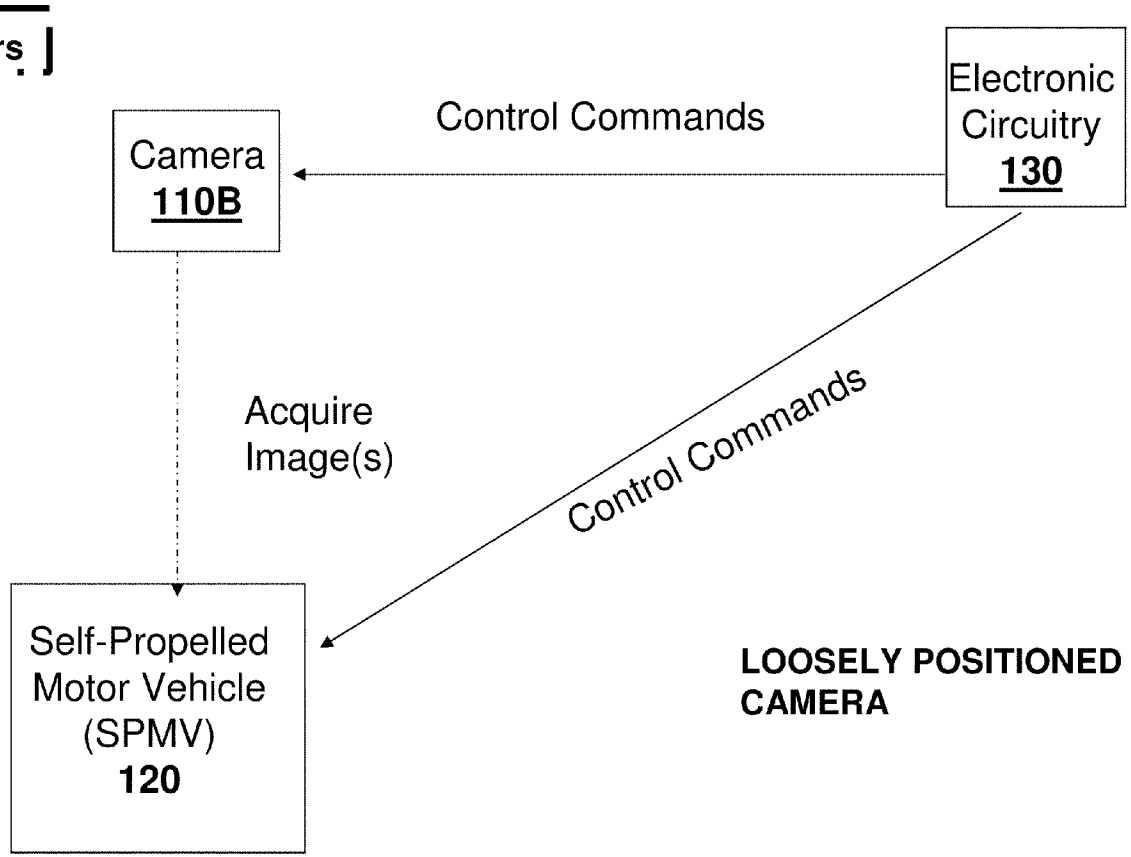
FIGS. 4A-4D are block diagrams of various systems that include one or more SMPV(s) in the field of view of one or more camera(s).
Figure 4B:
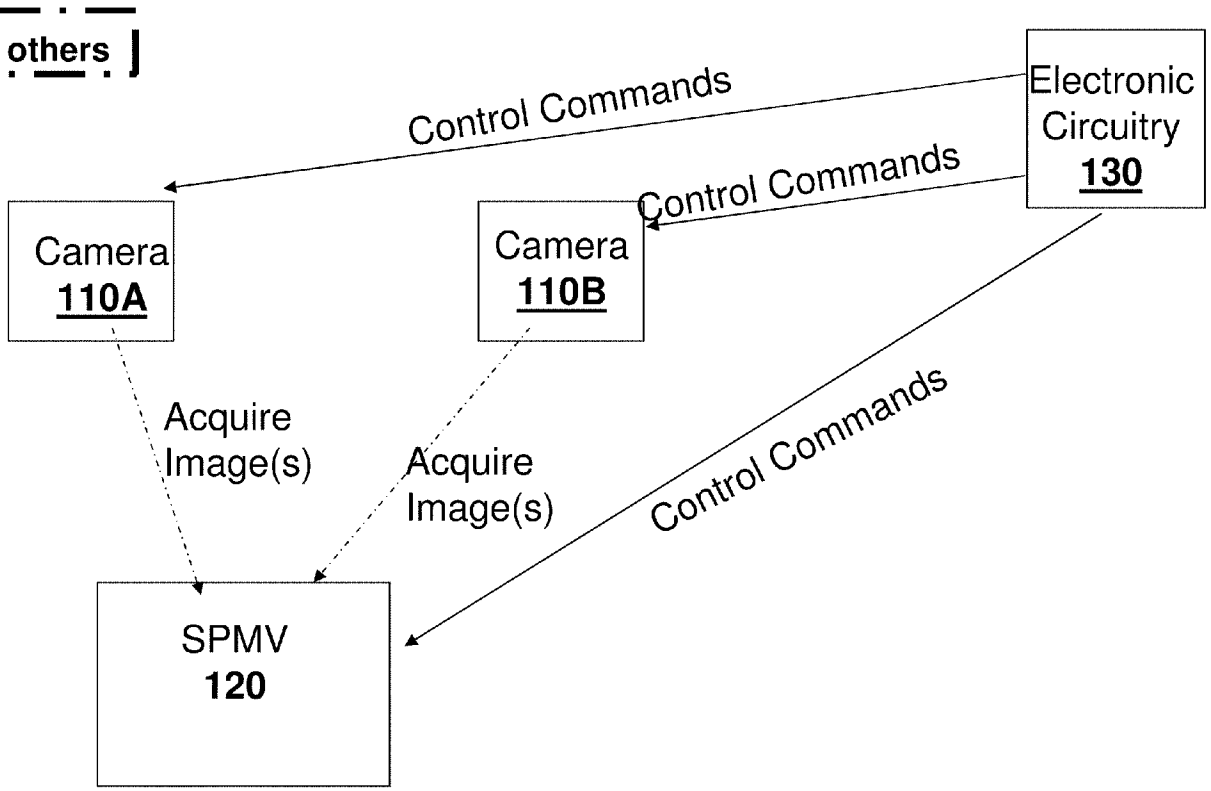
Figure 4C:
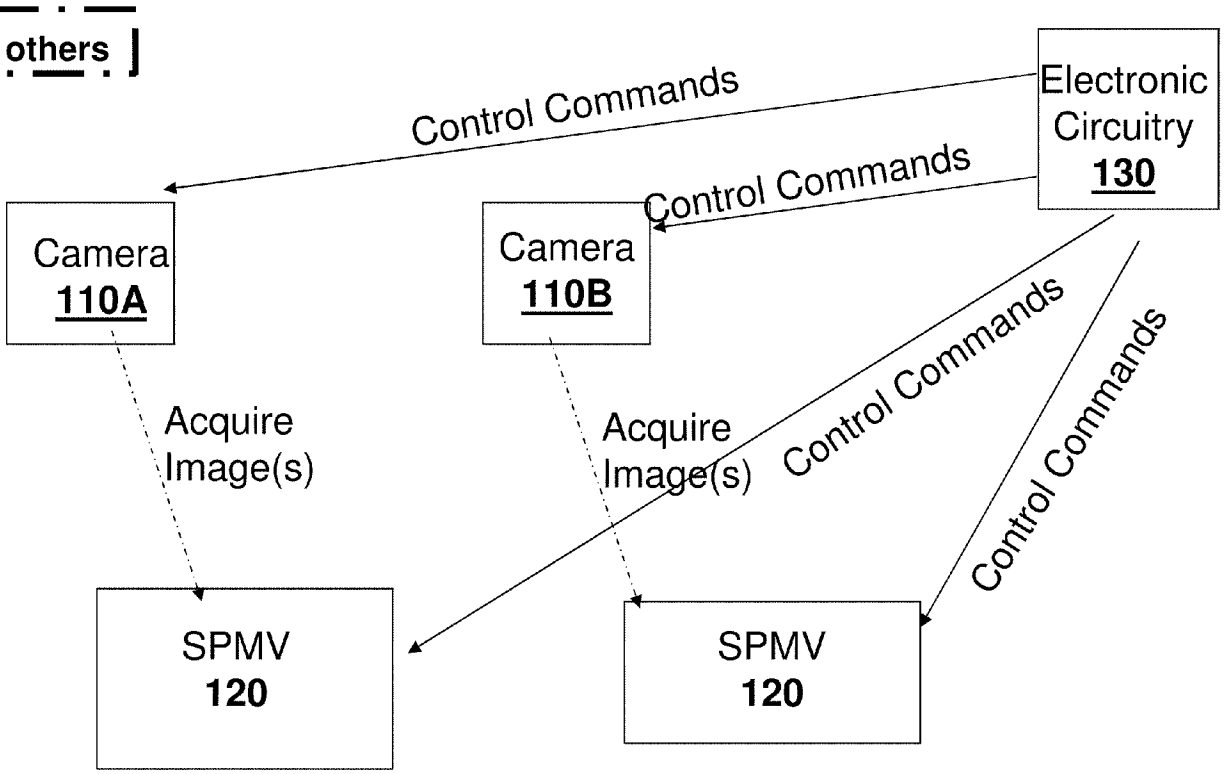
Figure 4D:
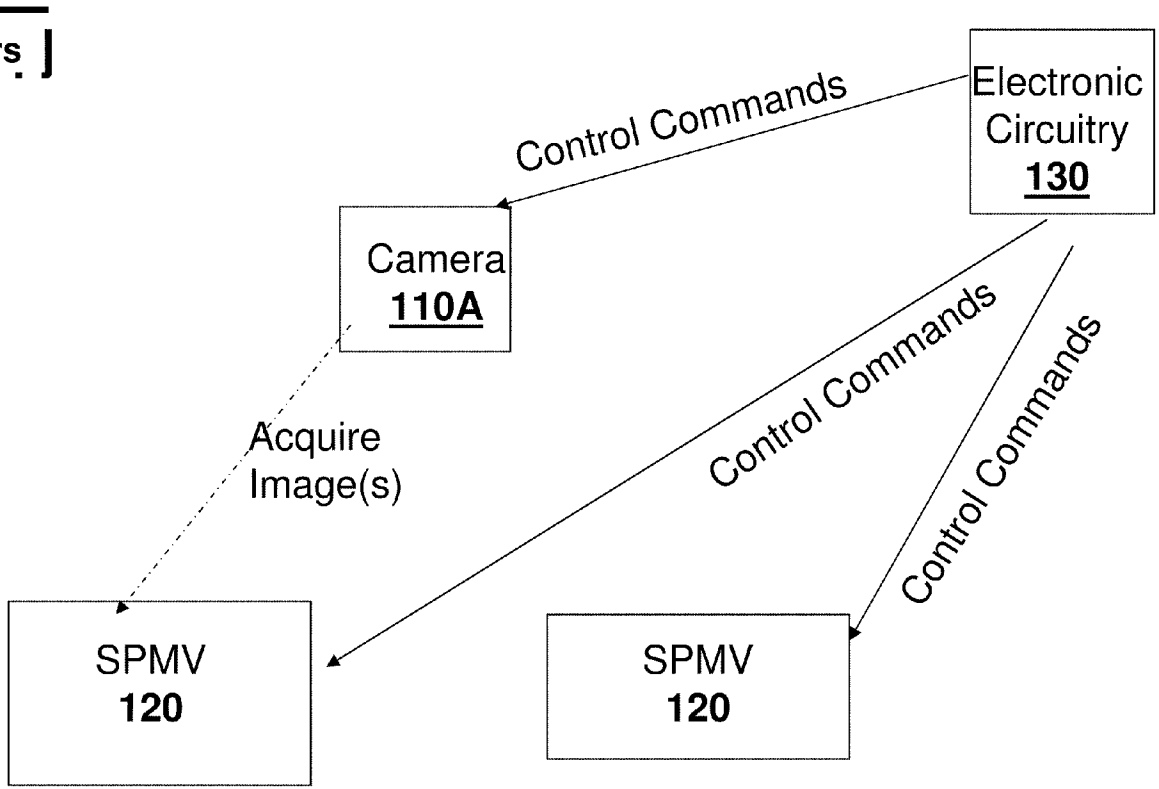

In the example of FIG. 4A, the system includes a single camera 110 and a single SPMV 120—the SPMV is located at least in part in the field of the single camera. In the example of FIG. 4B, the system includes multiple cameras 110 and a single SPMV 120—the self-propelled vehicle is located at least in part in the field of at least one of the cameras. In the example of FIG. 4B, the system includes multiple cameras 110 and a single SPMV 120—the self-propelled vehicle is located at least in part in the field of at least one of the cameras. In the example of FIG. 4C, the system includes multiple cameras 110 and multiple self-propelled vehicles 120—each self-propelled vehicle is located at least in part in the field of at least one of the cameras. In yet another example (see FIG. 4D), the system includes a single camera 110 and multiple self-propelled vehicles 120.

It is noted that the example of FIG. 1 corresponds to the use-case described in FIG. 4C; the example of FIG. 3 corresponds to the use-case of FIG. 4B. The SPMV illustrated in FIG. 2 may be used in the context of any of FIGS. 4A-4D.

The systems of FIGS. 4A-4C also include electronic circuitry 130. The term 'electronic circuitry' is intended to broadly include any combination of hardware and software. In the example of FIG. 1, computer unit 108 executing software (for example, image processing software or software for sending control commands to camera 110 and/or SPMV 120) is one example of 'electronic circuitry' according to this broader definition.

Electronic circuitry 130 may include may include any executable code module (i.e. stored on a computer-readable medium) and/or firmware and/or hardware element(s) including but not limited to field programmable logic array (FPLA) element(s), hardwired logic element(s), field programmable gate array (FPGA) element(s), and application-specific integrated circuit (ASIC) element(s). Any instruction set architecture may be used including but not limited to reduced instruction set computer (RISC) architecture and/or complex instruction set computer (CISC) architecture. Electronic circuitry 130 may be located in a single location or distributed among a plurality of locations where various circuitry elements may be in wired or wireless electronic communication with each other.

In one non-limiting use case, electronic circuitry 130 includes an executable or library running on a standard PC or laptop within a standard operating system environment such as Windows. Some of the lower level control logic of circuitry 130 may be provided as code stored on the FLASH storage of 8-bit or 32-bit microcontrollers such as Microchip's PIC18 and PIC32 series.

Locations where the electronic circuitry 130 may reside include but are not limited to the housing of any self-propelled vehicle 120, in or on the housing of any camera 110, and in another location (for example, laptop 108 of FIG. 1).

Electronic circuitry 130 may be hardwired and/or configured by computer-readable code (for example, as stored in volatile or non-memory) to effects one or more of the tasks: image processing, controlling the motion of any of the SPMVs 120, controlling one or more cameras 110, controlling a servo motor of a servo assembly 112 upon which any camera is mounted (for example, see FIG. 22A)), camera calibration, servo calibration or any other task.

Figure 5:
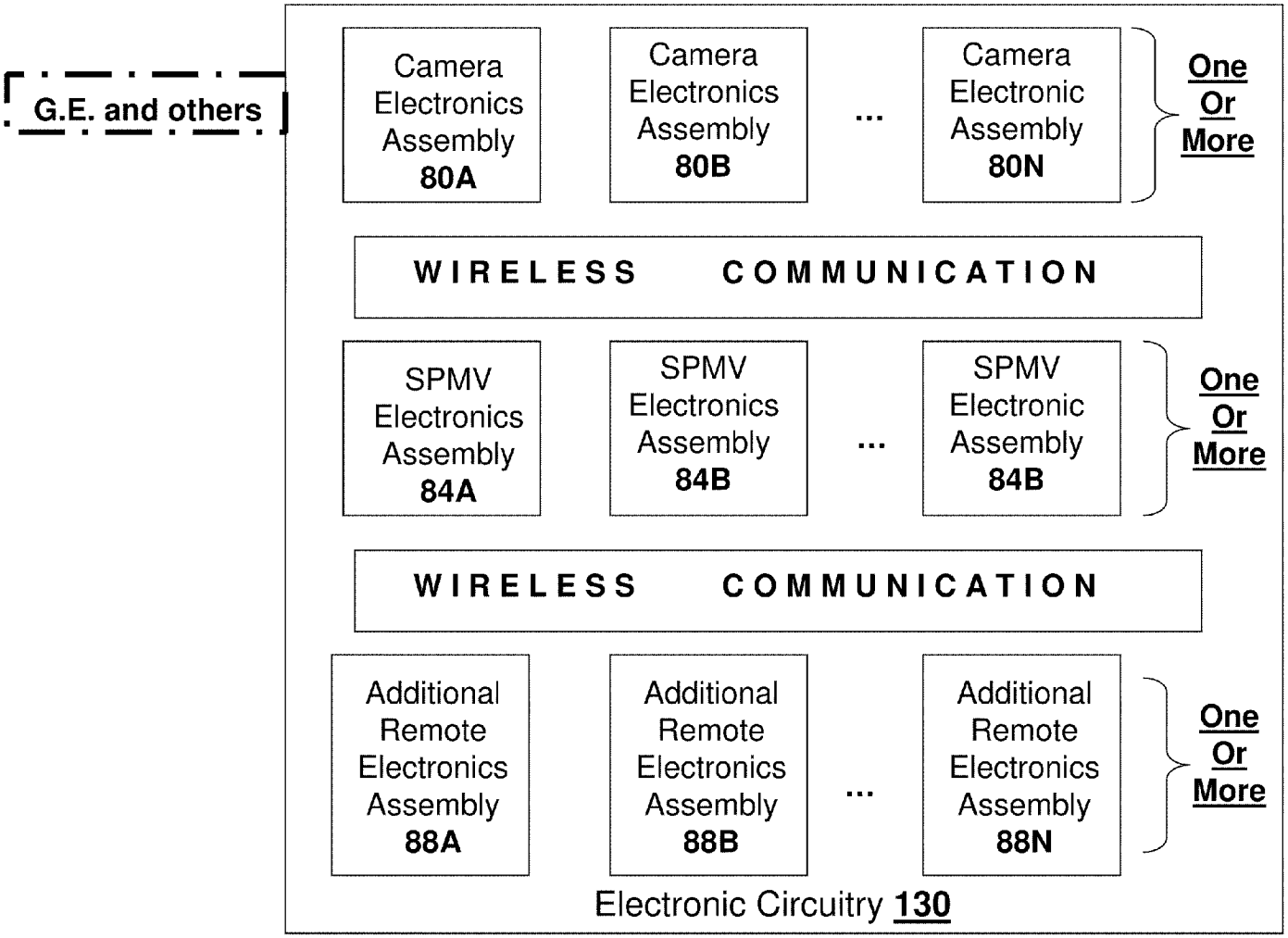
FIGS. 5, 6A-6B, 8A-8B are block diagrams of electronic circuitry.

In the example of FIG. 5, electronic circuitry includes (i) camera electronics assembly 80 which is deployed in or on the housing of camera 110; (ii) an SPMV electronic assembly 84 which resides in or on SPMV 120; and (iii) additional remote electronic assembly 88 (i.e. residing in or on housing of a mechanical element other than the camera 110 and SPMV 120).

In some embodiments, camera electronics assembly 80 may include electronic circuitry for providing functionality related to electronic image acquisition and/or data transfer and/or for any other functionality.

In some embodiments, SPMV electronics assembly 84 may include electronic circuitry for providing functionality related to moving SPMV 120 to translate or rotate SPMV or a portion thereof (for example, by operating a motor, brakes or any other mechanical element) and/or modifying a color or brightness of one or more onboard lights 124 (for example, turning the light(s) on or off) and/or data transfer and/or for any other functionality.

In some embodiments, additional electronics assembly 88 may provide any kind of functionality—in one non-limiting example; at least a portion of additional electronics assembly 88 resides in laptop computer 108. In another non-limiting example, at least a portion of additional electronics assembly 88 resides in user input device 104.

As illustrated in FIG. 5, in some embodiments, camera electronics assembly 80 and/or SPMV electronics assembly 84 and/of additional electronics assembly 88 may handle wireless communication.

A Discussion of FIG. 6

Figure 6A:
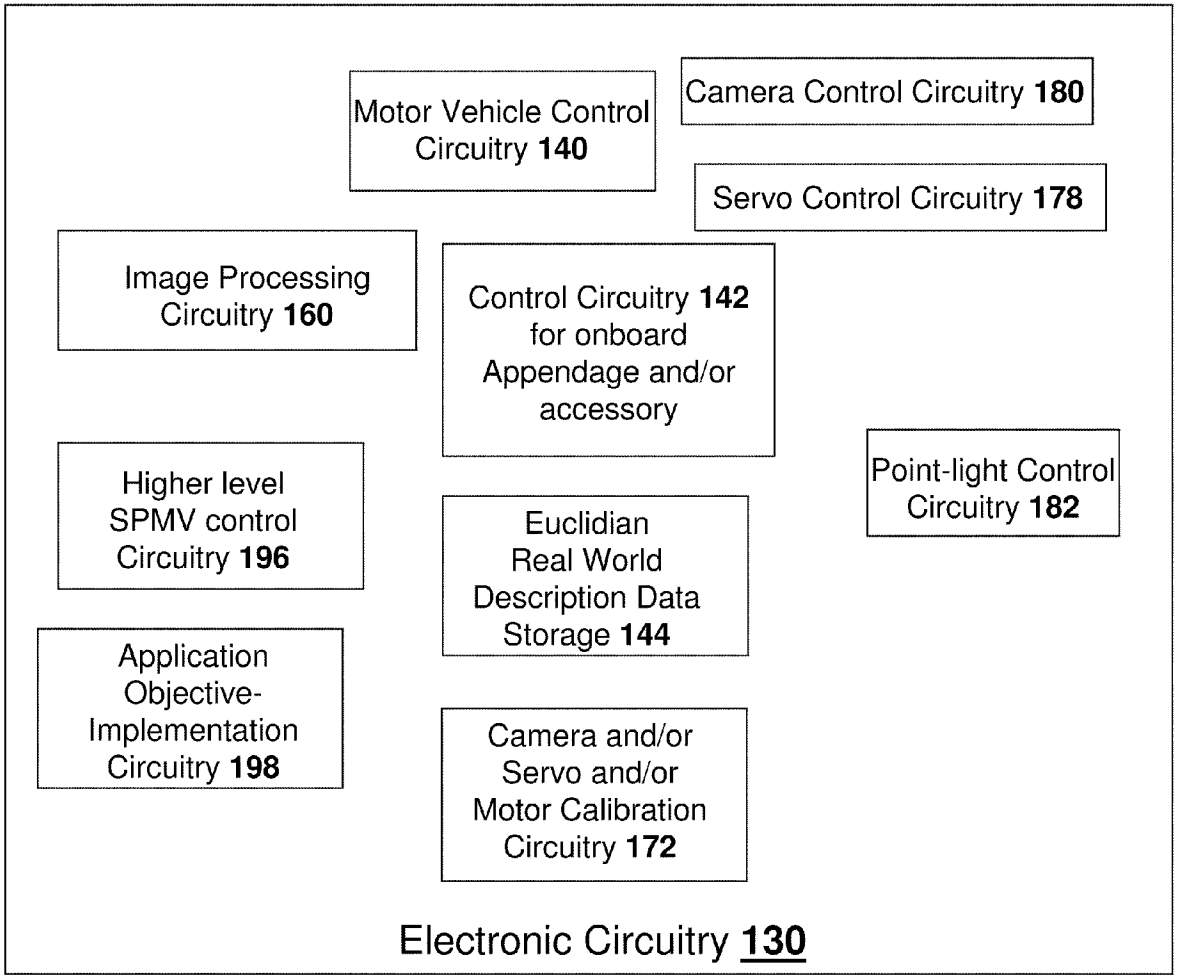
Figure 6B:
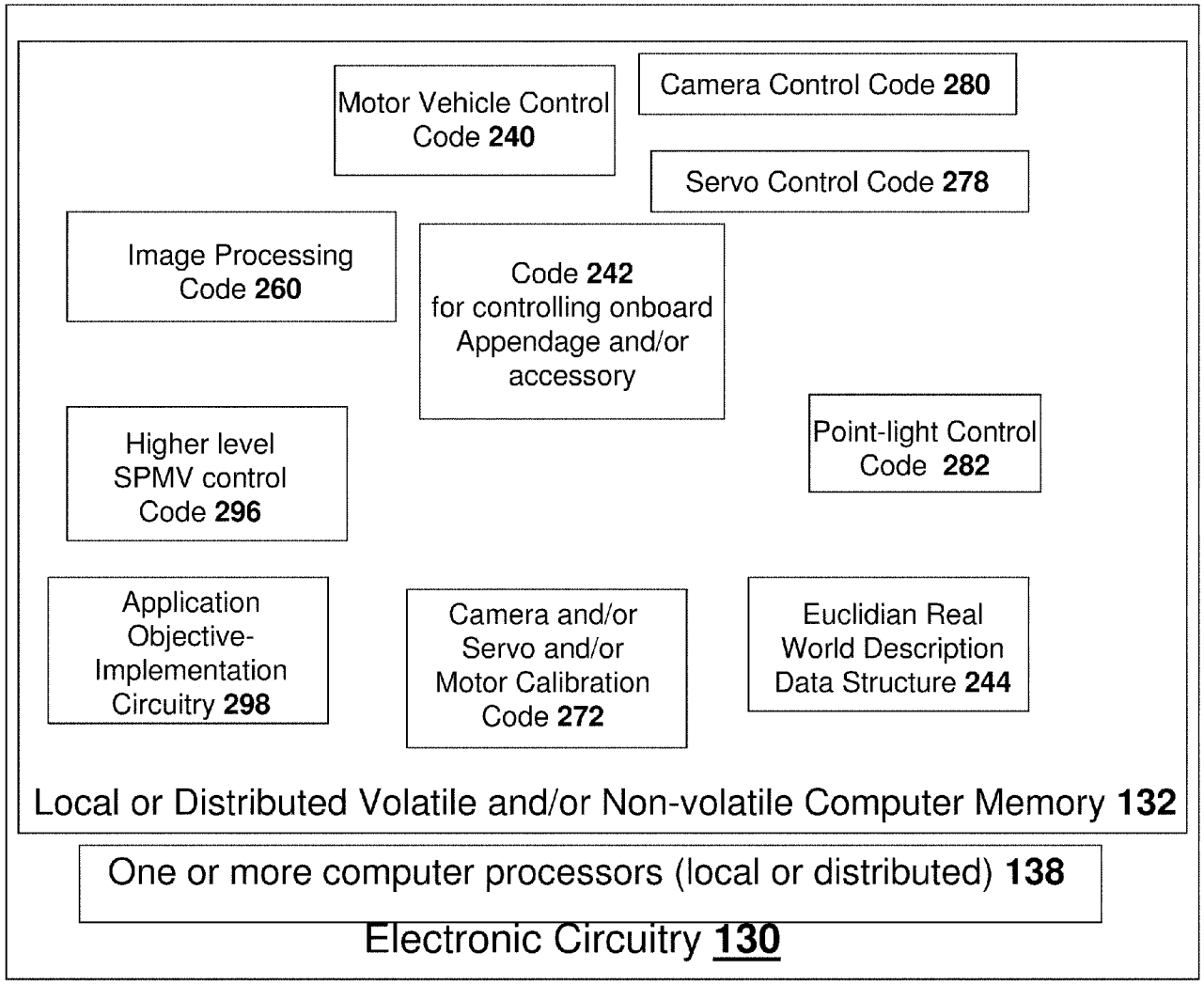

FIGS. 6A-6B are block diagrams of electronic circuitry 130 according to some embodiments. In the example of FIG. 130, electronic circuitry includes motor vehicle control 140 for controlling translational, rotational or configurational movements of any SPMV 120 (or any portion thereof), camera control 180, servo control 178, image processing circuitry 160, robotic mechanical appendage control circuitry 142, onboard light control circuitry 182, higher level SPMV control engine 196, application objective-implementation circuitry 198, Euclidian world description data structure 144 (for example, residing in volatile and/or non-volatile computer memory 132), and calibration circuitry 172 configured to calibrate camera 110 and/or servo assembly 112 and/or any onboard motor of any SPMV 120.

Any of the components illustrated in FIGS. 6A-6B (or in any other figure—for example, FIGS. 8A-8B) may reside in a single location (any location) and/or may be distributed among multiple locations. As with any of the figures, it is appreciated that not every component is required in every embodiment. Furthermore, as with any of the figures, it is appreciated that no attempt is made in FIG. 6A (or in any other figure) to show all components of electronic circuitry 130.

Camera control 180 may regulate when and/or how often images are acquired by camera(s) 110 (for example, by controlling a mechanical or electronic shutter or in any other manner), exposure time or any other parameter related to image acquisition. In one embodiment, camera control 180 does not receive and/or require and/or respond to any instructions from outside of camera electronic assembly 80 (for example, from outside of housing of camera 110). For example, camera 110 may be an ordinary video camera which takes periodically takes pictures and wirelessly transmits (or via a data cable) the contents of the pictures from camera 110 to computer unit 108 or SPMV 120 or to any other electronic device (in this example, there is only outgoing communication from camera 110 to another electronic device without any required incoming communication).

Alternatively, it is possible, in some embodiments, to send instructions to camera control 180 to acquire an electronic image—this may be carried out wirelessly or in a wired communication (for example, via a cable connecting camera 110 to computer unit 108).

For embodiments where one or more cameras 110 are mounted on a servo assembly 112, servo control 178 electrically controls the mechanical movements of servo assembly 112.

As noted throughout this disclosure, any SPMV 120 may move in accordance with contents of electronic image(s) acquired by camera(s) 110. Electronic circuitry 130 includes image processing circuitry 160 for analyzing images. In some embodiments, image processing circuitry 160 is operative to determine a location or orientation of any SPMV 120 and/or any obstacle and/or any prop (for example, a game prop) and/or any other object or visual pattern.

In some embodiments, SPMV 120 includes one or more onboard lights 124 (for example, LEDs or Incandescent, car headlights, halogen, mini-halogen, infra-red lights). This may be useful for determining how to operate any SPMV 120 and/or locating any SPMV 120 or portion thereof and/or for camera or servo or motor calibration. Thus, in some embodiments, electronic circuitry 130 includes light control circuitry 182 for electronically controlling the on-off state and/or the brightness and/or color of onboard light(s) 124. As with any illustrated component (for example, camera control 180 discussed above), in some embodiments, it is wirelessly operate to electronically control onboard light control circuitry 182 (and/or to distribute control onboard light control circuitry 182 across multiple locations in wireless communication with each other). In another embodiment, onboard light control 182 is 'autonomous' does not receive and/or require and/or respond to any instructions from outside of control circuitry of SPMV electronic assembly 84.

Image processing circuitry 160 may be configured to analyze contents of electronic image(s) acquired by camera(s) 110 and to determine the locations of one or more objects and/or to measure the distances between objects. As will be discussed below, in some embodiments, the image processing carried out by image processing circuitry 160 includes comparing images taken before and after a so-called illumination transition of one or more on-board lights mounted on any SPMV 120 and controlled by onboard light control circuitry 182. The results of the image comparison may be useful for operating any SPMV 120 (e.g. determining movement commands or any other commands—see the discussion below) and/or determining a location or orientation or configuration of any SPMV 120 or component thereof.

Higher level SPMV control circuitry 196 is operative to determine a plurality of direct commands for any SPMV 120 and/or for issue these commands according to some sort of SPMV operation 'strategy.' In one example related to FIG. 1, higher level SPMV control circuitry 196 is controlled by and/or includes and/or is included as part of a game strategy engine 170 (discussed below with reference to FIG. 8A). Thus, in one example, in response to a detection that user SPMV 120U is approaching computer goalpost 118C in 'possession' of the ball 114 (i.e. as determined by analyzing electronic image(s) acquired by camera(s) 110), higher level SPMV control circuitry 196 may issue a series of direct movement commands (including turning commands and commands to move forward or accelerate) to move computer-controlled SPMV 120C towards computer goalpost 118C to attempt to block any movement of ball 114 across the plane of computer player goalpost 118C.

In an example related to FIG. 3 and not directly related to gaming, higher level SPMV control circuitry 196 is operative to issue movement commands to the body of vacuum cleaner 120 and/or to the "vacuum cleaner appendage." According to this example, a plurality of movement commands are determined and/or issued by higher level SPMV control circuitry 196 in order to attempt to clean the maximum floor area while avoiding and/or moving around various obstacles within the room.

Thus, in some embodiments, higher level SPMV control circuitry 196 may operate according to the contents of Euclidian world description data structure 144 describing the Euclidian location(s) of one or more objects within the scene including but not limited to any SPMV 120 and/or any obstacle (for example, the table in FIG. 3 or the table or coach in FIG. 1) and/or any game prop (for example, any goalpost 118 or the ball 114 in FIG. 1) and/or any other 'prop' object (for example, a pallet to be lifted by a robotic forklift SPMV 120).

In some embodiments, SPMV 120 may include one or more onboard mechanical appendages (such as a coffee dispensing assembly or a robotic arm or robotic hand or robotic forklift) and/or any other onboard accessory (such as an onboard laser—for example, for a cutting or welding robot or for a 'laser tag' game robot). Thus, in some embodiments, electronic circuitry 130 includes appendage/onboard accessory control circuitry 142 (there is no requirement that all circuitry 142 itself be 'onboard' on the SPMV 120 though this is an option—the term 'onboard' refers to the appendage or the accessory controlled by the appendage/onboard accessory control circuitry 142).

As will be discussed below, some embodiments, it is useful to effect a calibration of camera 110 and/or servo assembly 112 and/or onboard motor (i.e. for translating, re-orientating or changing a configuration of SPMV 120 or a portion thereof) of SPMV 120. Thus, in some embodiments, electronic circuitry 130 includes circuitry for calibration of any camera 110 and/or servo assembly 112 and/or onboard motor of any SPMV 120.

Any component or combination of components of FIG. 6A (or of FIG. 8A) may be implemented in any combination of electronics and/or computer code and/or firmware.

FIG. 6B relates to some non-limiting example use cases where various components are implemented at least in part in computer code/software. Thus, in examples related to FIG. 6B, (i) motor vehicle control 140 is implemented by the combination of one or more computer processor(s) 138 (e.g. microprocessor(s)) and motor vehicle control code 240; (ii) Image Processing Circuitry 160 is implemented by the combination of one or more computer processor(s) 138 (e.g. microprocessor(s)) and Image Processing Code 260; (iii) Camera Control Circuitry 180 is implemented by the combination of one or more computer processor(s) 138 (e.g. microprocessor(s)) and Camera Control Code 280; (iv) Servo Control Circuitry 178 is implemented by the combination of one or more computer processor(s) 138 (e.g. microprocessor(s)) and Servo Control Code 278; (v) Control Circuitry 142 for onboard Appendage and/or accessory is implemented by the combination of one or more computer processor(s) 138 (e.g. microprocessor(s)) and Code 242 for controlling onboard Appendage and/or accessory; (vi) Higher level SPMV control Circuitry 196 is implemented by the combination of one or more computer processor(s) 138 (e.g. microprocessor(s)) and Higher level SPMV control Code 296; (vii) onboard light Control Circuitry 182 is implemented by the combination of one or more computer processor(s) 138 (e.g. microprocessor(s)) and onboard light Control Code 282; (viii) Camera and/or Servo and/or Motor Calibration Circuitry 172 is implemented by the combination of one or more computer processor(s) 138 (e.g. microprocessor(s)) and Camera and/or Servo and/or Motor Calibration Code 272

It is appreciated that FIG. 6B is just one particular implementation, and in other embodiments, one or more components (i.e. any number and any combination) or all components are implemented 'purely in hardware' with no need for computer-executable code.

Computer memory 132 (i.e. shown in FIGS. 6B and 8B) may include volatile memory (examples include but are not limited to random-access memory (RAM) and registers) and non-volatile memory (examples include but are not limited to read-only memory (ROM) and flash memory).

Although the memory and computer processors are shown as single elements in FIG. 6B (and in FIG. 8B), it is understood that in different embodiments, the computer processor 138 which executes a first code element (for example, image processing code 160) may be located in a different physical location from the computer processor which executes a second code element (for example, motor vehicle control code 140).

Definitions

For convenience, in the context of the description herein, various terms are presented here. To the extent that definitions are provided, explicitly or implicitly, here or elsewhere in this application, such definitions are understood to be consistent with the usage of the defined terms by those of skill in the pertinent art(s). Furthermore, such definitions are to be construed in the broadest possible sense consistent with such usage.

In a Euclidean representation of the real world, the representation accurately records the distances, angles, volumes. Parallel lines in the real world are represented as parallel lines.

In other representations, such as affine or projective, distances may be preserved but angles not. Parallel lines may not be parallel etc. They may nevertheless be able to accurately represent "closer/further than" relations between two points.

Many scene reconstruction techniques cannot create Euclidean representations. These techniques may reconstruct a scene object (e.g. house) as distorted by shears and different sizes in different directions.

For the present disclosure, when a quantity or some property is 'determined' there is no requirement this quantity or property to be determined exactly, and it may be determined, for example, only approximately.

For the present disclosure, when a quantity or some property is determined or computed or calculated 'in accordance' (or 'according to') with some sort of parameter, there is no requirement that the quantity or property be determined exclusively in accordance with the parameter—rather, it is meant that the quantity or property is determined in accordance with "at least in part.'

A Discussion of Some Gaming Embodiments with Reference to FIGS. 7-10

Figure 7:
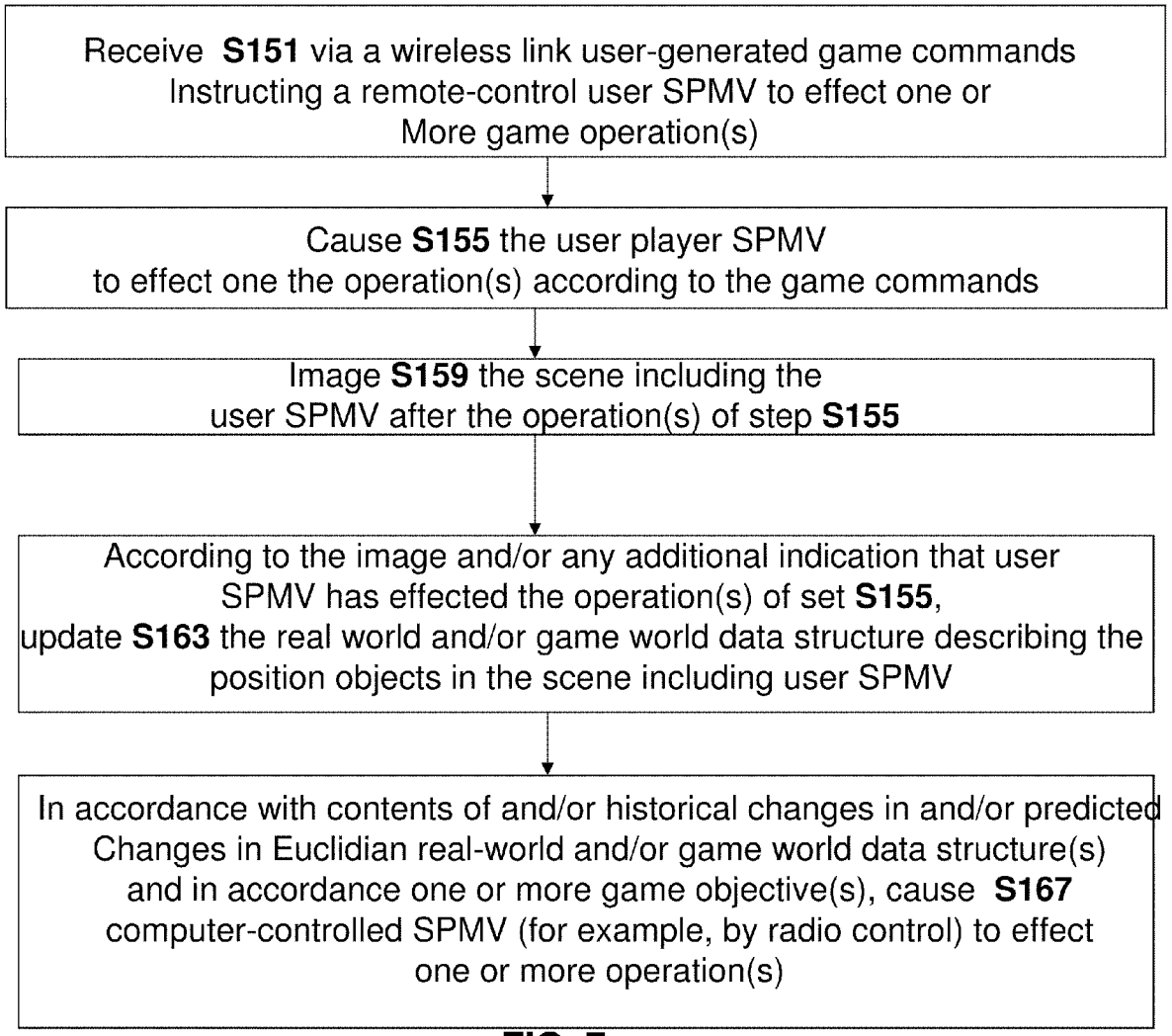
FIG. 7 is a flow chart of a routine for operating a game system.

FIG. 7 is a flow chart of a routine for operating a game system including (i) one or more user SPMV(s) 120U and one or more opponent/computer controlled SPMVs 120C; (ii) one or more observing cameras 110; (iii) a user control device 104; and (iv) electronic circuitry 130.

In step S151, the user SPMV 120A receives from user control device 104 via a wireless link (for example, a radio link or an IR link or any other wireless link) one or more direct game commands instructing the remote-control user SPMV 120A to effect one or more game operations. Game operations include but are not limited to commands to accelerate, decelerate, turn, illuminate a light mounted to the SPMV (for example, an LED or a laser light for 'firing' at an opponent such as a tank), move to a particular location, and move a robotic arm or leg. The direct game command is generated by user control device 104 in accordance with user input—for example, in response to a user pressing of a button, a user moving the user control device 104, turning a rotational object such as a knob or wheel, a user generating brainwaves, or any other user mechanical or electrical activity. In another example, user control device 104 may be operative to detect human hand gestures (or gestures of any other human body part) even when the hand is not in contact with user control device 104.

In step S155, in response to the game command(s) received in step S151, the user remote-controlled SPMV 1201 effects one or more of the operations described by the game commands—for example, by moving one or more wheels or robotic arms or legs, effecting a steering system operation, firing a projectile, or any other operation specified by the user whose activity is detected by user control device 104.

In step S159, the scene including the remote-control user SPMV 120A is imaged by camera(s) 110. By electronically analyzing the image(s), it is possible to determine the Euclidian location and/or orientation of any object within the scene, based upon camera calibration data. These objects include but are not limited to (i) user-controlled 120U and/or computer-controlled/opponent 120C SPMV and/or (ii) one or more game objects (for example, a ball) and/or (iii) one or more 'environmental' objects such as walls or other boundaries, or obstacles (for example, on the floor).

Typically, step S159 is carried out repeatedly (for example, camera 110 may be a video camera)—for example, at least several times a second. At each point in time, the physical scene may change, and some sort of 'real world data structure' maintained in accordance with Euclidian scene reconstruction operations.

In step S163, one or more data storages are updated to reflect the updated physical 'real-world' reality and/or 'game-world' reality according to the data input received via observing camera(s) 110 and according to the Euclidian scene reconstruction. In one example, one or more SPMV(s) have moved or rotated and their new positions are stored in Euclidian real world description data structure 144 (described below with reference to FIG. 6A). In another example, a ball 114 has crossed the plane of a goal 118 (this may be detected from effecting a Euclidian scene reconstruction of the scene captured by camera(s) 110) and the score (i.e. describing the 'game world' for the soccer game) may be updated. In this example, game world description data storage 146 (described below with reference to FIG. 8A) may be updated.

In step S167, computer SPMV 120C responds, in accordance with (i) one or more game objective(s); and (ii) the contents of the Euclidian-reconstructed scene which is acquired by observing camera(s) 110.

As will be discussed below, in some embodiments of the present invention, a 'game strategy engine' is provided for facilitating control of SPMV 120C.

In one example, if user SPMV 120U approaches goalpost 118C, computer SPMV 120C may respond by approaching the goalpost in order to 'block a shot.' In this example, the Euclidian scene reconstruction as indicated by contents of real world description data storage 144 may be read by the game strategy engine, which may be involved in generating a command to computer SPMV 120C to move towards the goalpost 118C.

In some embodiments, computer SPMV 120C is configured to operate according to the combination of (i) information related to locations and orientations of scene objects that is stored in Euclidian real world description data storage 144; and (ii) additional information—for example, game data beyond merely the location and/or orientation of various objects (e.g. SPMV(s) or game props or other objects) or boundaries.

Thus, in one example), the amount of time of the soccer game is recorded, and the player (i.e. either the 'computer' player or the 'user' player) with the higher 'score' wins. In this example, if the 'computer' player is 'in the lead' (i.e. had a higher score), the game strategy engine or game strategy circuitry (see element 170 of FIG. 8A) may adopt a more 'conservative' strategy when operating SPMV 120C, and place more of an emphasis on blocking goals. If the 'computer player' is losing (i.e. the user SPMV 120U has score more goals thus-far), however, SPMV 120C may place a higher emphasis on scoring goals than on blocking goals.

Information such as the score of the game, the remaining time (i.e. for timed games), the number of previous fouls per player (for a robotic basketball game) may be stored in game world description data storage 146 (see FIG. 8A), which may augment real world description data storage 144 (see FIG. 6A) that describes the Euclidian location/orientation of scene objects.

The example of FIG. 1 relates to a "computer versus human" soccer game. Various examples may relate to:

(i) shooting games—in this case, the user may employ radio controller 104 to instruct user-controlled self-controlled vehicle 120U fire a projectile or to 'fire' using a beam of light, for example, laser light. In response, opponent or computer-controlled vehicle 120C may behave according to a game objective—for example, attempting to dodge one or more projectiles, attempting to 'hide' behind some sort of obstacle to prevent a line of site between a user vehicle 120U and computer-controlled vehicle 120C, moving to a position or orientation where computer-controlled vehicle 120C can shoot user-controlled vehicle 120U, or firing a shot at user self-propelled vehicle 120U. In this case, the game events to which computer-controlled vehicle 120C may relate to a vehicle being 'hit' by a shot, a near miss, movement of a vehicle, etc. The events may be used for keeping score and/or determining the behavior of computer-controlled vehicle 120C.

(ii) hand-to-hand combat games—for example, a karate match between a computer SPMV 120C and user SPMV 120U;

(iii) maze and/or chasing games—for robotic Pacman where user SPMV 120U is the "Pacman" and one or more computer SPMVs 120C are 'monsters.';

(iv) ball games—for example, computer 120C versus user 120U robotic baseball or basketball or hockey or American football.

Figure 8A:
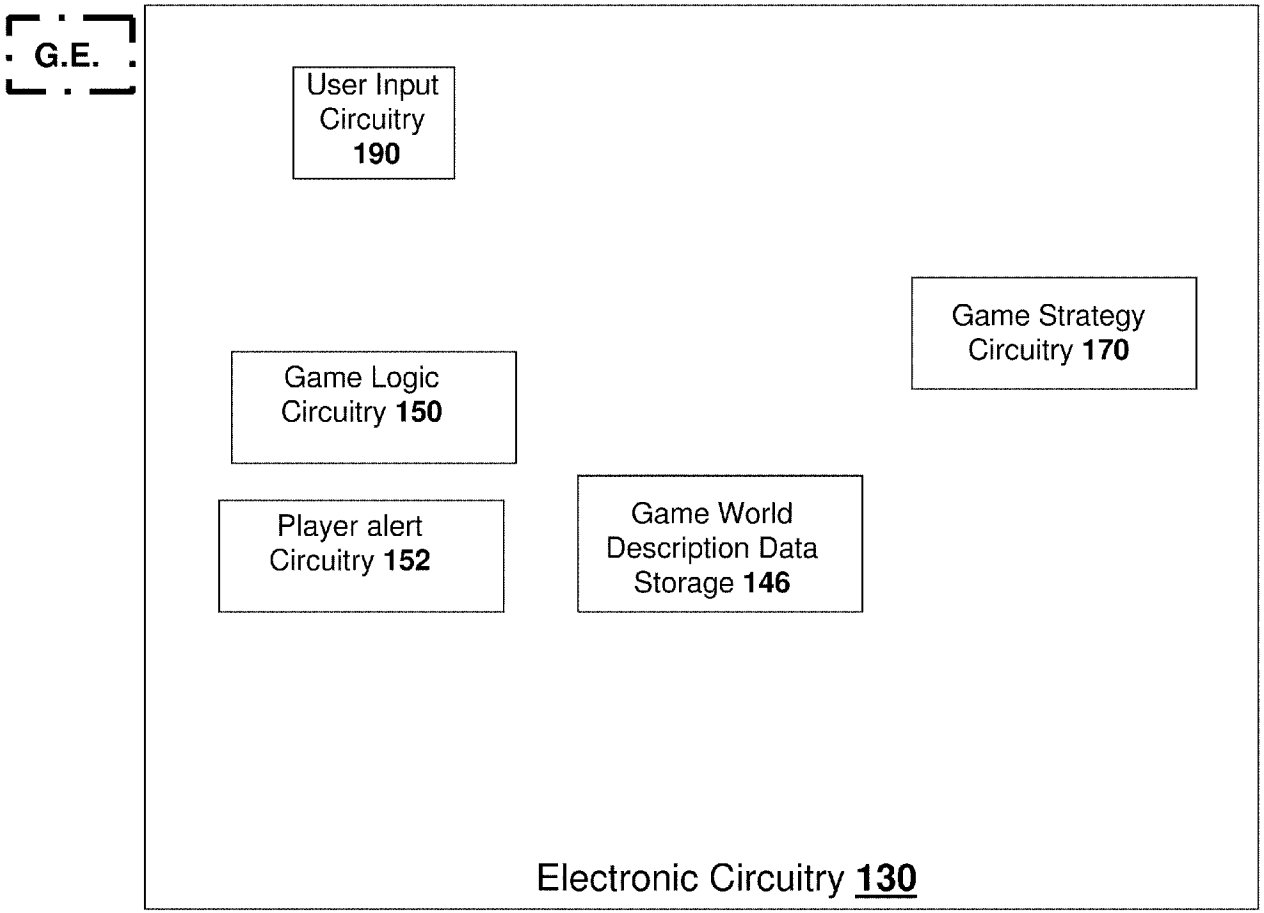
Figure 8B:
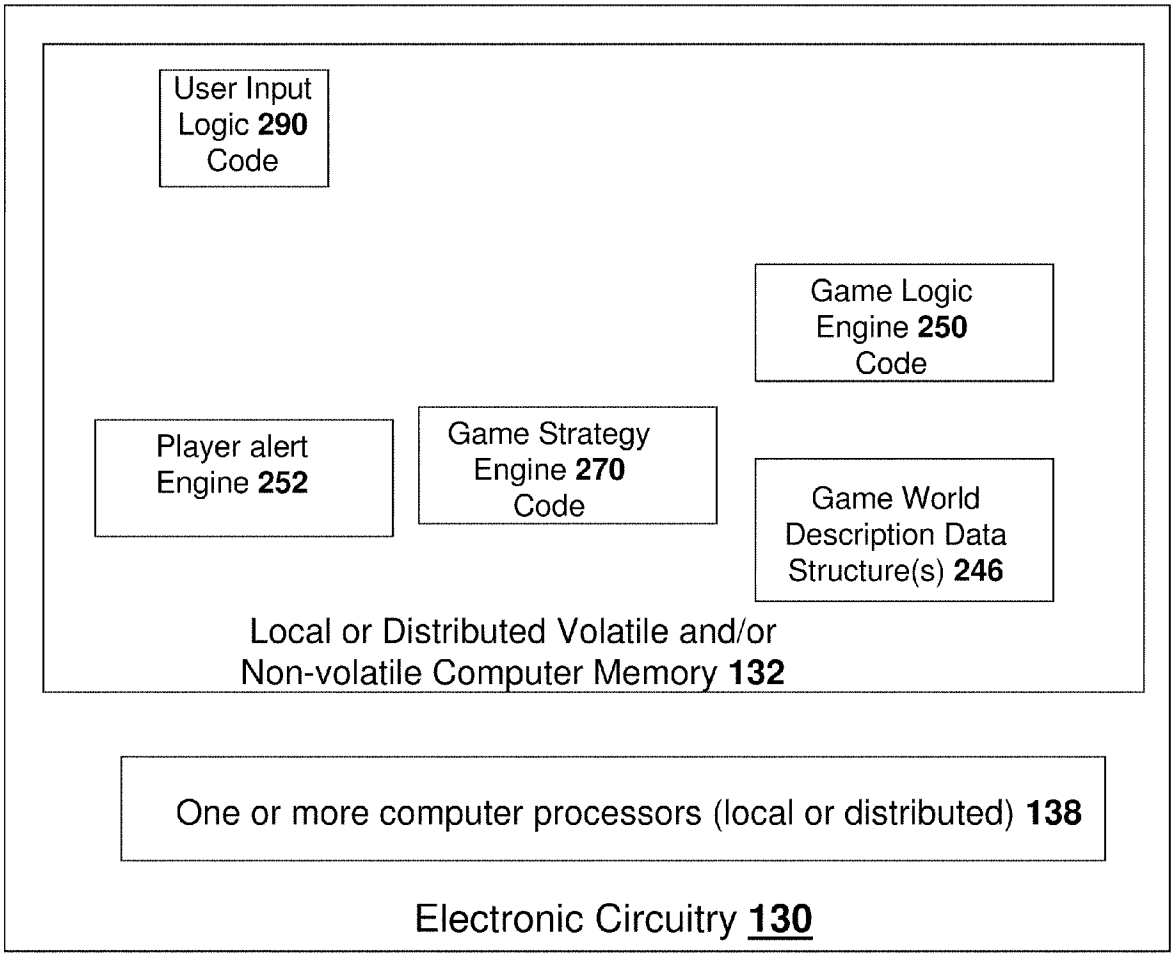

A Discussion of FIGS. 8A-8B

In some embodiments related to gaming, electronic circuitry 130 may include some or all components of FIGS. 6A and/or 6B as well as one or more additional components illustrated in FIGS. 8A and/or 8B.

Electronic circuitry 130 further may include game logic engine 150 (this is virtual world information) for enforcing game rules. Game logic engine 150 may maintain update game world description data storage 146 according to the set of game rules. One example of a game rule for robot soccer is that if the ball crosses the plane of the goal a team is awarded one point. In this case, an entry in a data structure of game world description repository 144 indicating the score of the game may be updated game logic engine 150.

One example of a game rule (i.e. that may be enforced by game logic circuitry) related to robot basketball is if a player (i.e. implemented as a SPMV 120) in possession of the ball goes out-of-bounds, then play is frozen, the clock is stopped, and the other team is to be awarded possession of the ball. In this case, an entry in a data structure describing the amount of time remaining in the game, or who is entitled to receive the ball from a robotic referee, may be updated.

In some embodiments, the game rules enforced by game logic engine 150 may relate to informing or alerting a player that a specific game event has occurred. Game logic engine 150 may determine whether or not a game event (for example, scoring a goal, hitting a tank, etc) has occurred. In one use case, a display screen and/or speaker to present information to the user may be provided (for example, as part of game controller 104), and the user may be alerted via the screen and/or speaker. In one example, a player alert engine 152 sends the information, describing the game event, to the user.

Game strategy circuitry 170 may access game world description data storage 146 and/or real world description data storage 144 when making the strategic decisions for operating computer SPMV 120C according to game objective(s) (see the discussion in the previous section).

Thus, in some embodiments, opponent or computer SPMV 120C may be configured to operate according to a game strategy for attempting to achieve one or more game objectives. In one example related to a shooting game (for example, tanks), this game strategy may include (i) moving computer SPMV 120C away from locations where user SPMV 120U can possibility fire upon opponent/computer controlled SPMV 120B; and/or (ii) re-locating or re-orienting computer SPMV 120C so that it is possible to successfully fire upon user SPMV 120U.

According to a game strategy, game strategy engine 170 may issue a set of commands for one or more computer SPMV(s) 120C. In one example related to a robotic soccer game, if game strategy engine 170 detects from the contents of game world description repository 144 that the soccer ball 114 is about to cross the plane of the "computer's" goal (as opposed to the user's/player's goal), game strategy engine 170 may respond by issuing a command to the "computer's/opponent's" goalie robot (which is a SPMV 120B) to move to attempt to intercept the soccer ball before it crosses the plane of the goal.

In one example, this command may be sent wirelessly to opponent/computer-controlled SPMV 120C via a wireless link. In one particular example related to FIG. 1, electronic circuitry of computer unit 108 may be configured by software/computer-executable code as game strategy engine 170, and the command(s) issued to computer SPMV 120C according to a game strategy and/or by game strategy engine 170 may be sent via a wireless link between computer unit 108 and computer SPMV 120C.

Any component or combination of components FIG. 8A may be implemented in any combination of electronics and computer code. FIG. 8B relates to the specific use case where various components are implemented using computer code/software. Thus, FIG. 8B includes user input logic code 290, player alert code 252, game strategy engine code 270, game logic engine code 250, and game world description data structure(s) 246 which reside in memory 132 (see the discussion above with reference to FIG. 6B)

Figure 9:
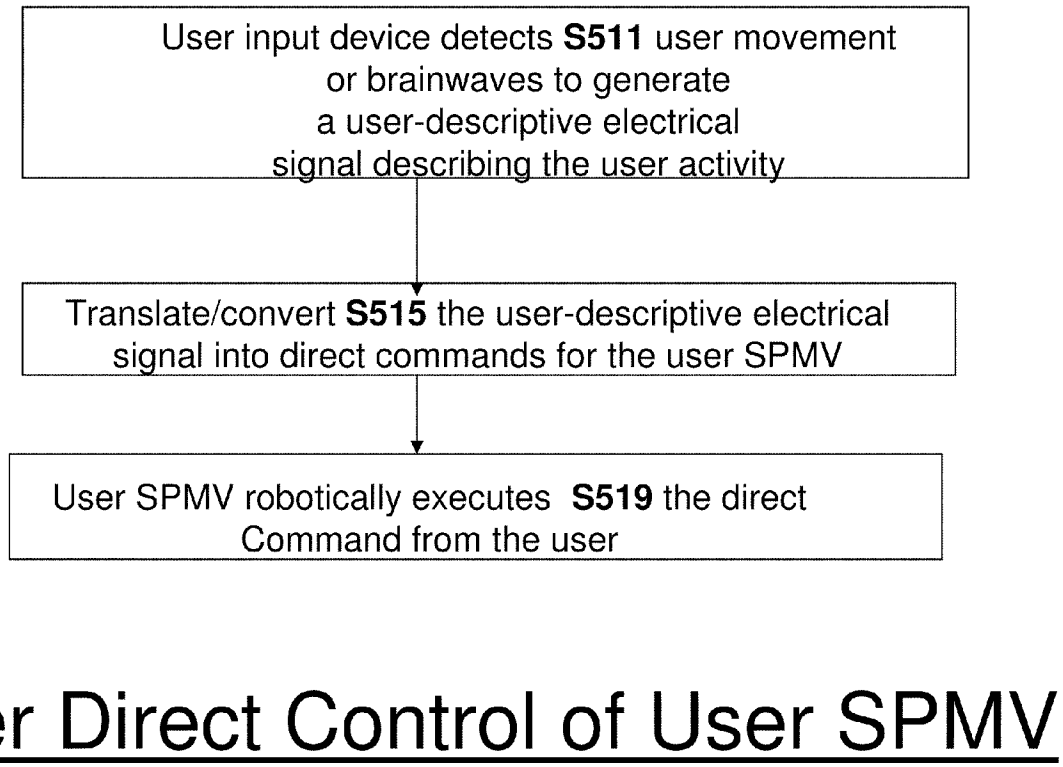
FIG. 9 is a flow chart of a routine for user direct control of user SPMV.
Figure 10:
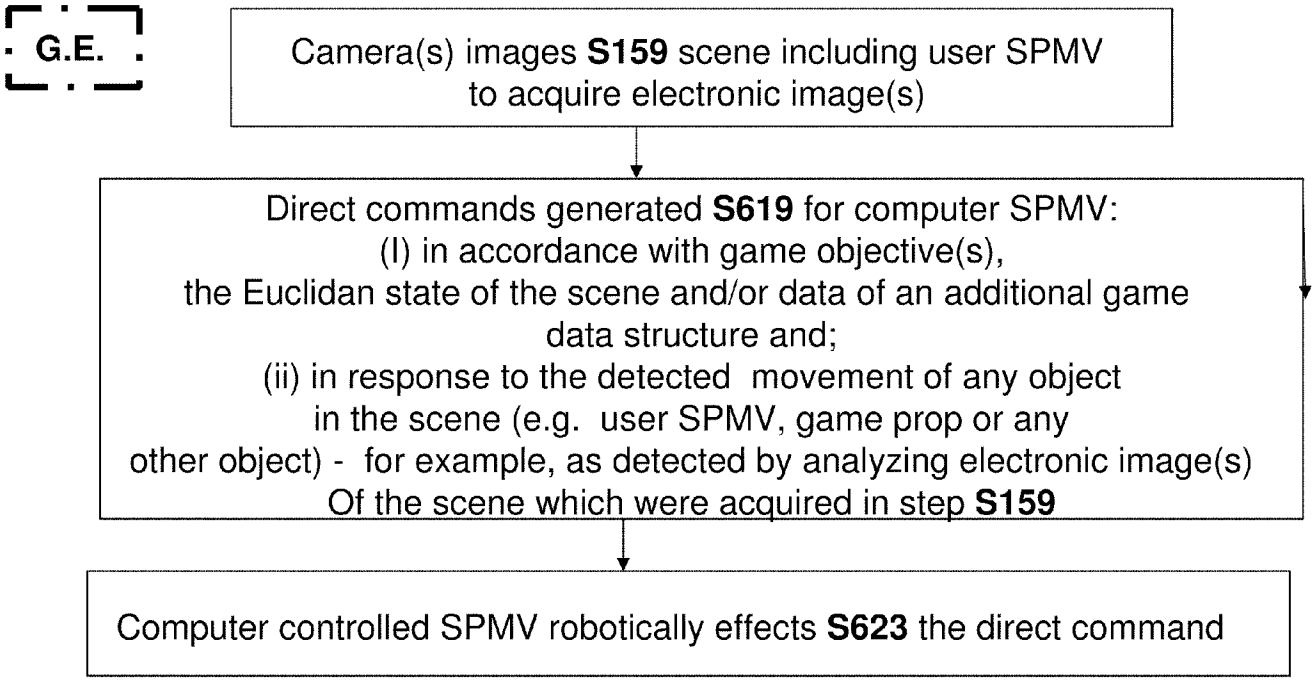
FIG. 10 is a flow chart of a routine for computer direct control of computer SPMV.

A Discussion of FIGS. 9-10

FIG. 9 is a flow chart of a routine whereby the user 102 provides direct commands to user SPMV 120U via input device 104. Direct commands include but are not limited to direct movement commands, direct commands to a robotic mechanical appendage of an SPMV and direct commands to 'fire' for shooting games. Direct movement commands include but are not limited to (i) a command to move (or turn) SPMV to the left; (ii) a command to move (or turn) SPMV to the right, (iii) a command to stop the SPMV, (iv) a command to move the SPMV forwards, (v) a command to accelerate the SPMV (i.e. press the 'gas'), (vi) a command to decelerate the SPMV (i.e. press the 'brake'), (vii) a command to reverse direction (i.e. effect a mode transition from 'forward to backwards' or from 'back, forwards); (viii) a command to jump, (ix) a command to climb up (x) a command to climb down, (xi) a command to turn wheels; (xii) a command to turn wheels to a specific position; (xiii) a command to set motor to a specific rpm; (xiv) a command to set speed of SPMV to a specific value.

Direct commands to a mechanical robotic appendage (for example, a tank turret or a robotic arm or foot) include: (i) move appendage left; (ii) move appendage right; (iii) kick (for a robotic foot); (iv) accelerate (or decelerate) movement of appendage to the left (or right); (v) grab (for a robotic hand); (vi) rotate clockwise to a specific angle; (vii) rotate anti-clockwise to a specific angle; (viii) rotate at a certain angular velocity; (vi) release (for a robotic hand).

Direct commands to 'fire' for shooting games include but are not limited to (i) a command to fire (either a project, or a 'light' such as a laser for games like laser tag); (ii) a command to accelerate (for decelerate) a rate of repetitive firing; and (iii) a command to cease firing.

In step S511 the user input device 104 detects movements or brainwaves of the user 102 (for example, touching or moving a finger across a touch-screen, pressing a mouse-button, pressing a key on a laptop keyboard, moving a mouse or the stick of a joystick user 102 hand or body movements captured by a dedicated user-input camera etc) to generate a user-descriptive electrical signal describing the user activity. This signal may be translated/converted, in step S515, into a direct command for operating (for example, for moving) user SPMV 120U.

This electronic conversion of the user-descriptive electrical signal into direct commands may be carried out, at least in part, in any location, including but not limited to electronics assembly of user input device 104, electronics assembly 88 of laptop 108 (or desktop or any other 'external' digital compute that is external to camera(s) 110, the SPMVs 120 and the user input device 104), in electronics assembly 84 of any SPMV 120, or in any location.

In some embodiments (not illustrated in FIG. 9), the user-descriptive electrical signal and/or one or direct commands for user SPMV 120U may be wirelessly transmitted—for example, directly from user input device 104 to user SPMV 120U or 'indirectly' (e.g. via laptop computer 108).

In the specific example of FIG. 1, the user-descriptive electrical signal describing the user activity is wirelessly transmitted from user input device 104 to laptop computer 108 (which acts like a central 'brain' of the user vs. computer game). The conversion or translation of the user-descriptive electrical signal into commands for user SPMV 120U is carried out within the laptop computer 108, and these direct commands are then transmitted wirelessly to user SPMV 120U.

In some embodiments, it is possible to retain (i.e. in volatile or non-volatile memory of computer unit 108) information about the direct commands that are routed from user 102 to user SPMV 120U via computer unit 108. For example, this information (i.e. describing direct command data) may be entered into to real world description Data structure 144 (see FIG. 6A and the accompanying discussion), and utilized, for example, by Game Strategy Engine 170 (see FIG. 8A and the accompanying discussion). In one example, this information may be particularly useful when user SPMV 120U leaves the field of view of one or more camera(s) 110, and it is desired to estimate the location of user SPMV 120U. In another example, this information may augment the information provided by one or more electronic images of the scene including user SPMV 120U—for example, to reduce the amount of computer resources required to assess a Euclidian location of user SPMV 120U and/or to facilitate a more accurate estimate.

In yet another example, the 'translation' of user mechanical engagements of (or brainwaves) input device 104 into commands for user SPMV 120U may be carried out within input device 104, and these commands may be wirelessly transmitted by input device 104. In yet another example, user SPMV 120U (for example, circuitry of SPMV electronics assembly 84) may (i) receive the wireless user electronic signal describing user mechanical engagement of input device 104 and (ii) electronically convert or translate this signal into commands for moving SPMV 120U.

FIG. 10 is a flow chart of a routine whereby the computer provides direct commands to the computer SPMV 120C according to electronic output of game strategy engine in order to attempt to achieve one or more game objectives for computer SPMV 120C.

In FIG. 10, one or more objects (including, for example, user SPMV 120U) may move in the 'real world.' Step S159 is as in FIG. 7.

In step S619, direct commands are generated S619 for computer SPMV (i) in accordance with game objective(s), the Euclidan state of the scene and/or data of an additional game data structure and; (ii) in response to the detected movement of any object in the scene (e.g. user SPMV, game prop such as ball 114 or any other object). In some embodiments, the movement is detected by analyzing electronic image(s) and effecting multiple Euclidian scene reconstructions (a first scene reconstruction at a first time a second reconstruction at a later time)—it is possible to detect movement or angular displacement according to the two scene reconstructions.

In step S623, the computer SPMV 120C effects the direct command (for example, to move, to fire, etc)—for example, according to the output of game strategy circuitry.

Although the user's moves may be said to have 'influence' upon motion of computer SPMV 120C (since the computer SPMV 120C may be programmed to in response to any movement of objects in the scene—thus, SPMV 120C may be able carry out 'countermeasures' in response to the actions of user SPMV 120U), it is clear that the relation between the user 102 and user SPMV 120U (which operates primarily according to direct commands provided by the user via user input device 102) is profoundly different from the relation between the user 102 and computer SPMV 120C.

A Discussion of a Technique for Operating an SPMV According to Electronic Images of the SPMV that Describe an Illumination Transition of One or More Onboard Lights Embodiments of the present invention relate to a SPMV 120 that includes a plurality of onboard lights (for example, see elements 124A-124D of FIGS. 2B, 3B, 11A) that are mounted to the housing of the SPMV 120. As will be explained in the present section, it is possible to electronically control of the onboard lights 124 to turn the light(s) on or off and/or modify their brightness and/or modify their color. Analyzing electronic images describing the 'illumination transitions' produced by turning light(s) on or off and/or modifying color and/or modifying brightness may be useful for facilitating: (i) the determining a 'real-world' or Euclidian location of the onboard lights 124 themselves within a real-world scene captured by an image of the scene acquired by the observing camera 110 where the image includes the SPMV 120 and its immediate or nearby surroundings (see FIGS. 11-12 and step S923 of FIG. 13); and/or (ii) the operating of the SPMV according to the real-world or Euclidian locations (see FIGS. 13-16B); and/or (iii) the generation of camera calibration data including extrinsic calibration data for the observing camera (see FIG. 18A and FIG. 19); and/or (iv) the generation of calibration data for a SPMV motor and/or servo motor (see FIG. 18B).

In some embodiments, the SPMV 120 may be operated primarily according to information provided in images generated by observing camera 110—for example, according to a Euclidian location of SPMV 120 (or a portion thereof). In some embodiments, this may be obviate the need for an additional location-finding system (i.e. other than a system based on images of the observing camera 120), such as an ultrasound locating system or a radar-based locating system. In some embodiments, the SPMV 120 is operated in accordance with (i) the Euclidian location of SPMV (or a portion thereof) as determined according to illumination transitions and (ii) other information available in the scene including the SPMV that is described by the image acquired by observing camera 110.

Figure 11A:
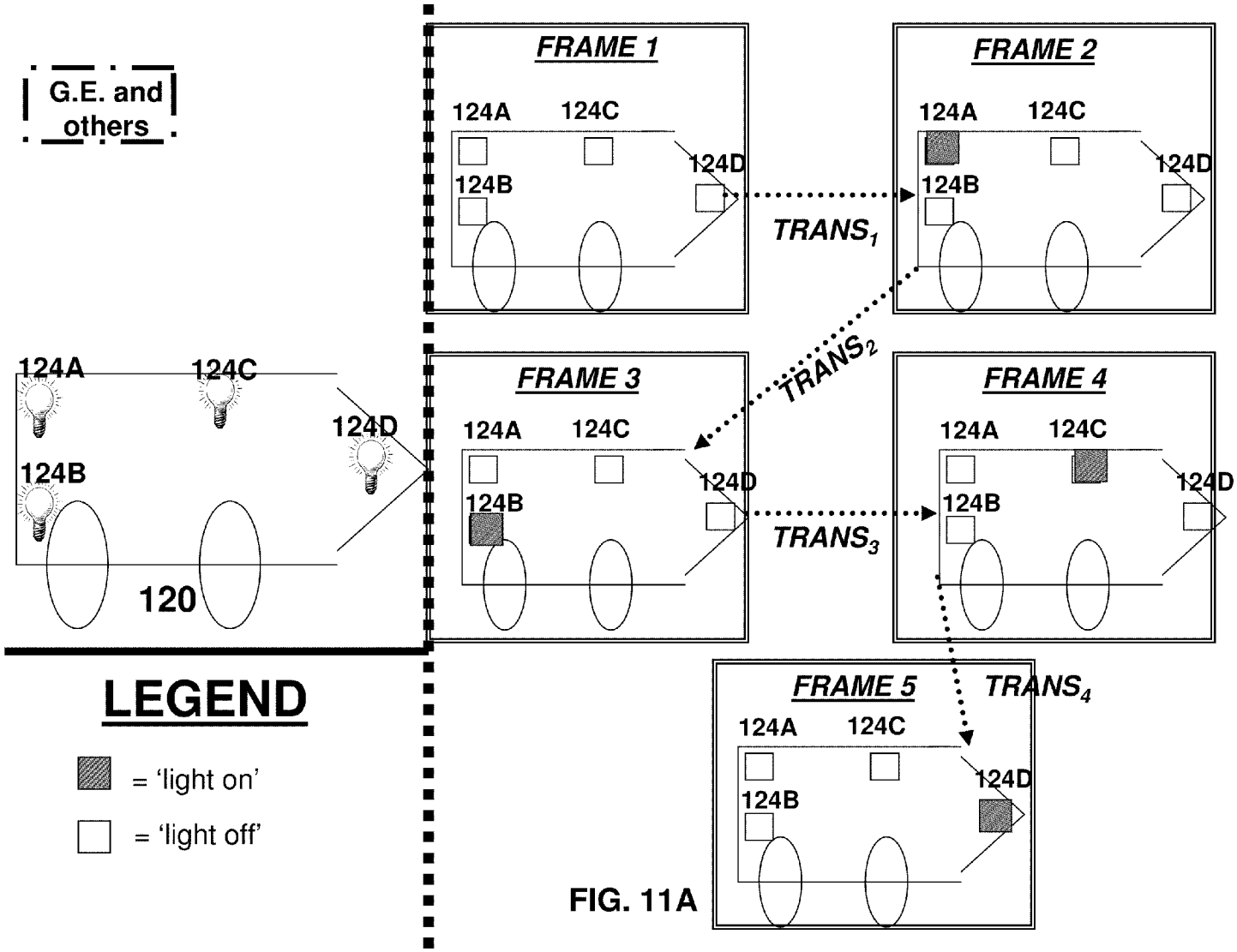
FIGS. 11A and 17 illustrate illumination transitions.
Figure 11B:
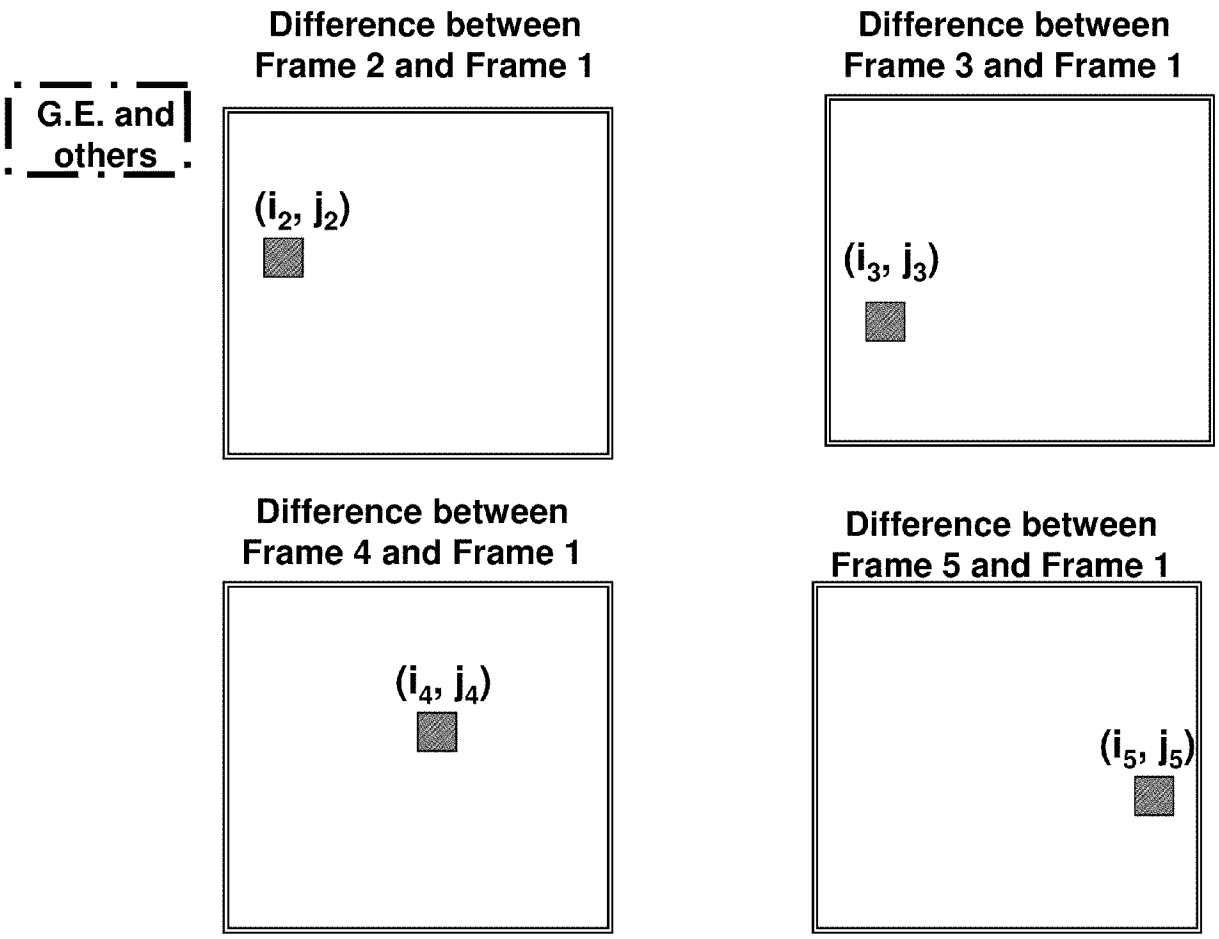
FIG. 11B illustrates pixel locations of a light.
Figure 12:
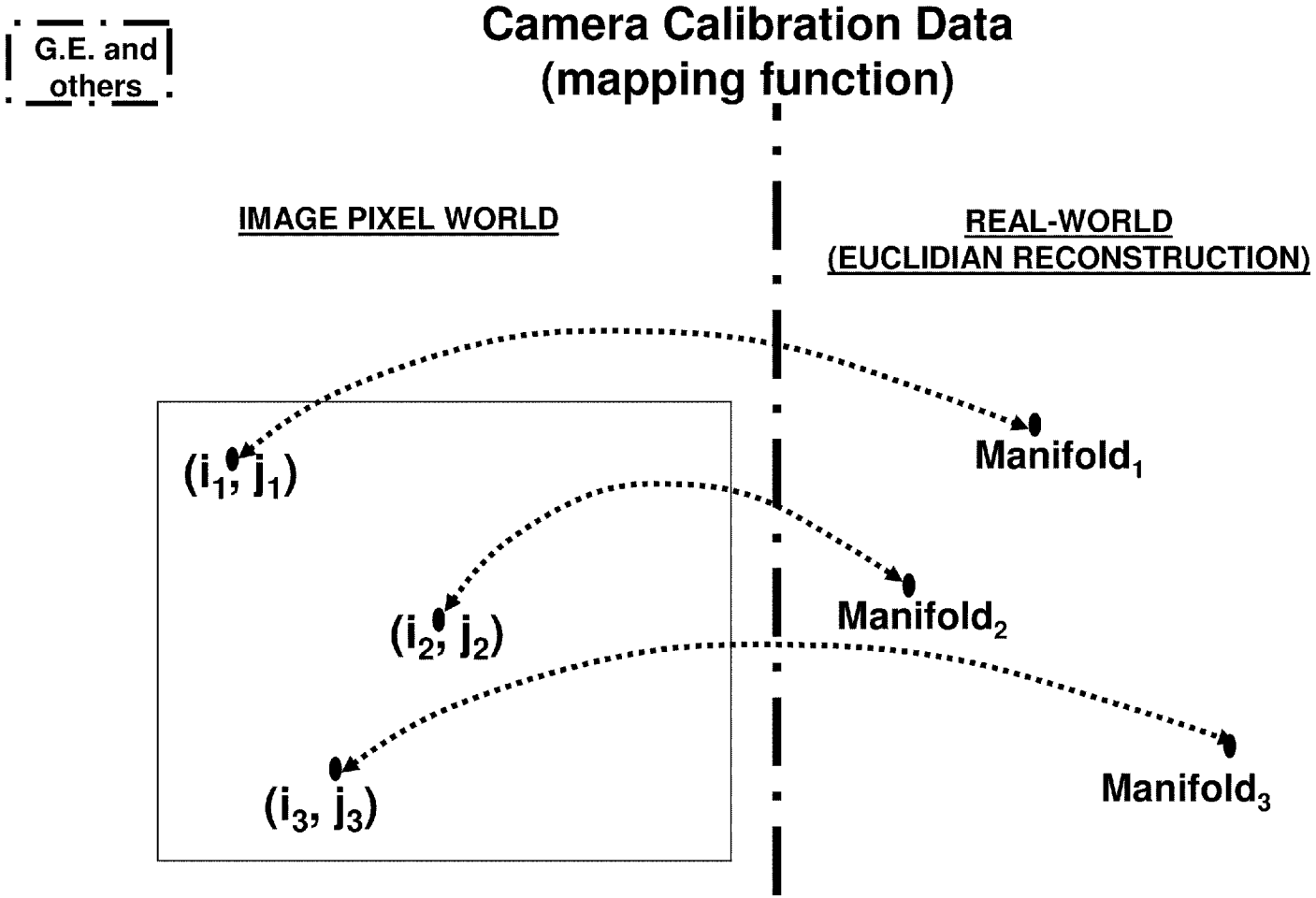
FIG. 12 illustrate camera calibration data.

Before explaining routines for utilizing illumination transitions to operate SPMV 120 (i.e. control translational or rotational movement of SPMV or of a portion thereof), several concepts are now explained: illumination transitions (see FIGS. 11A and 17), pixel locations of a light (see FIG. 11B), and extrinsic calibration data (see FIG. 12).

FIGS. 13-16B relate to the exemplary technique for controlling movement (or otherwise operating) the SPMV 120 according to information derived from imaged illumination transitions (e.g. how the illumination transitions facilitate the determination of a Euclidian location of SPMV 120 or a portion thereof).

Figure 18A:
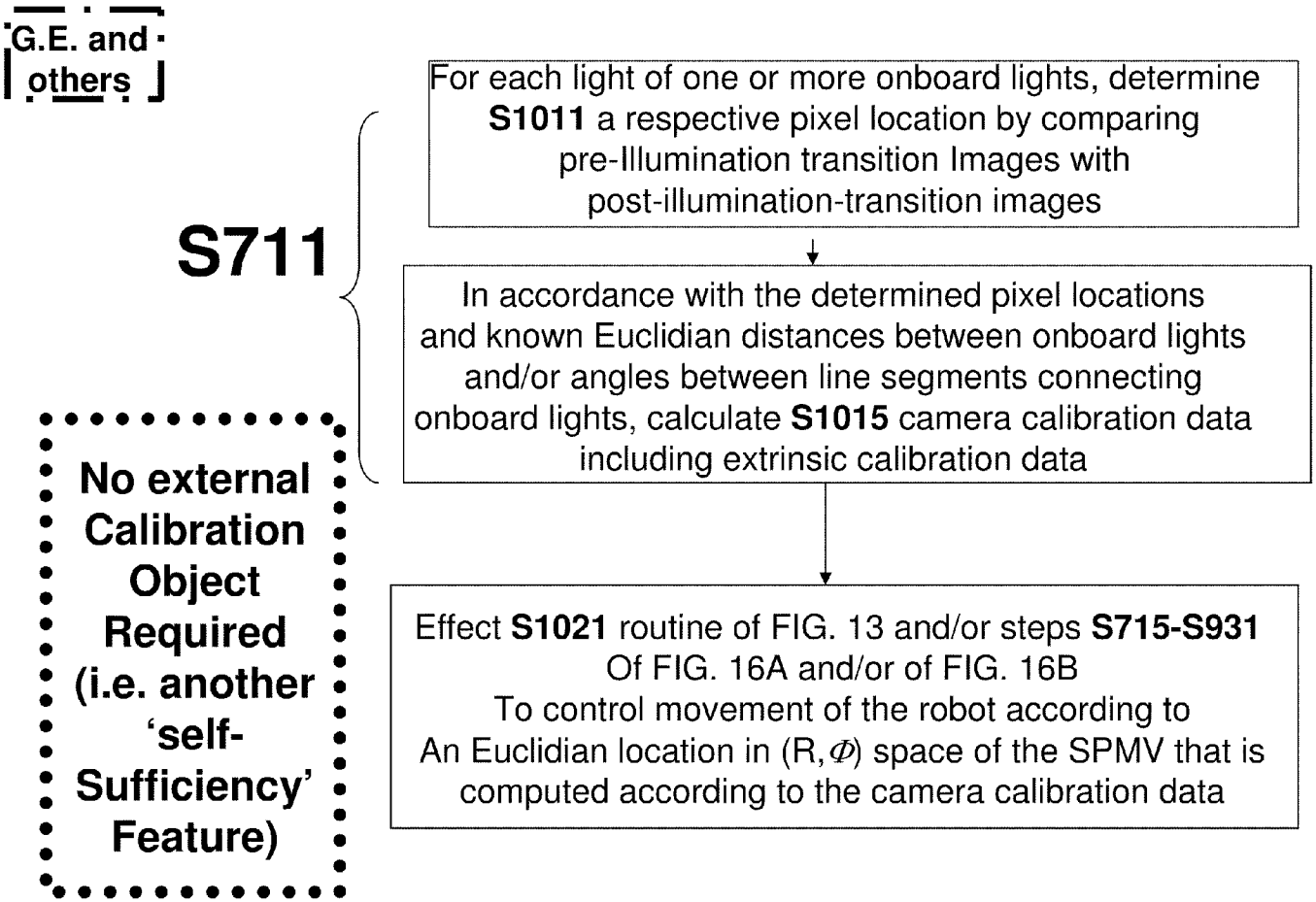
FIGS. 18A-18B, 19 are routines of operating an SPMV in a self-sufficient system.
Figure 18B:
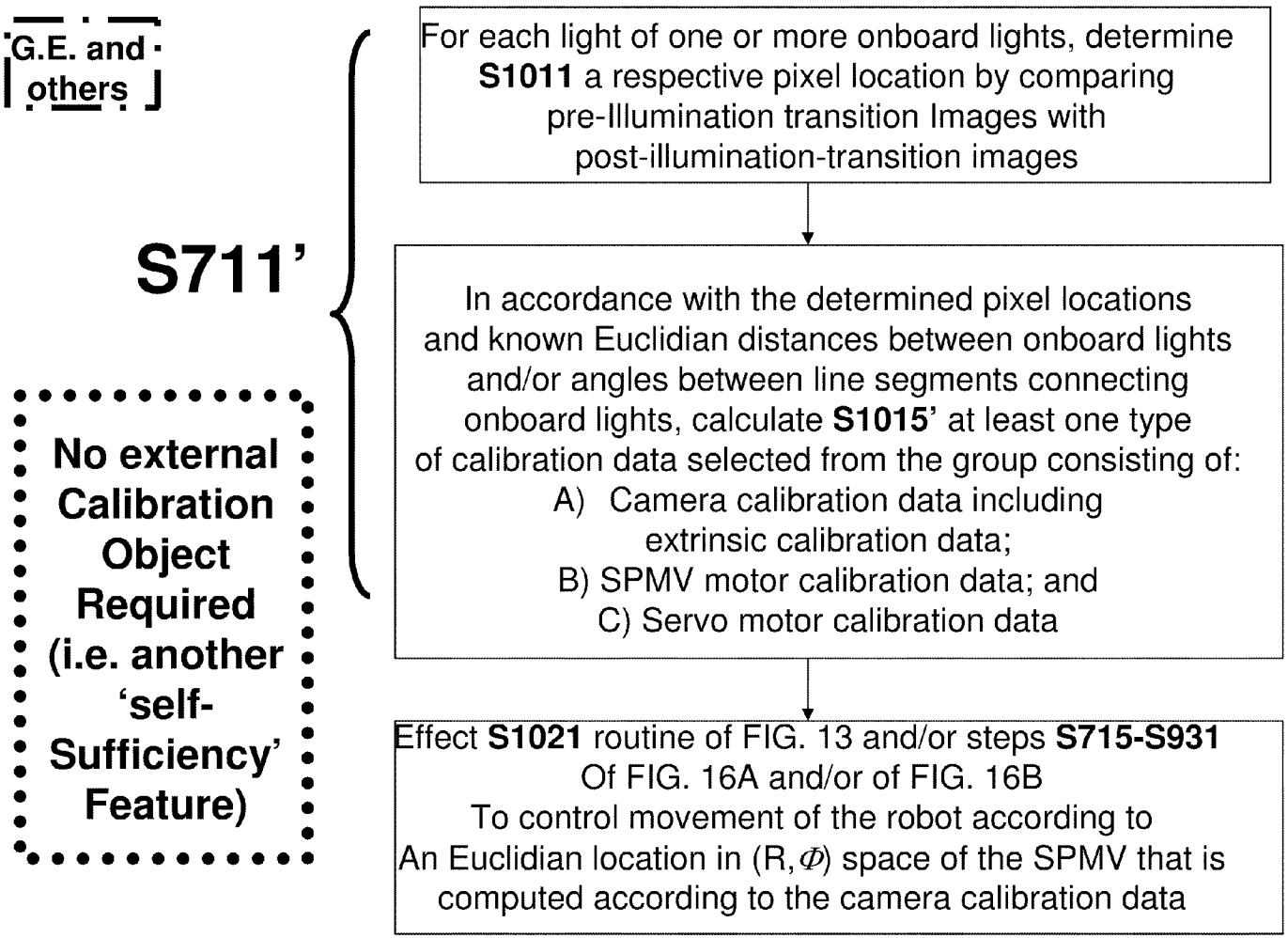
Figure 19:
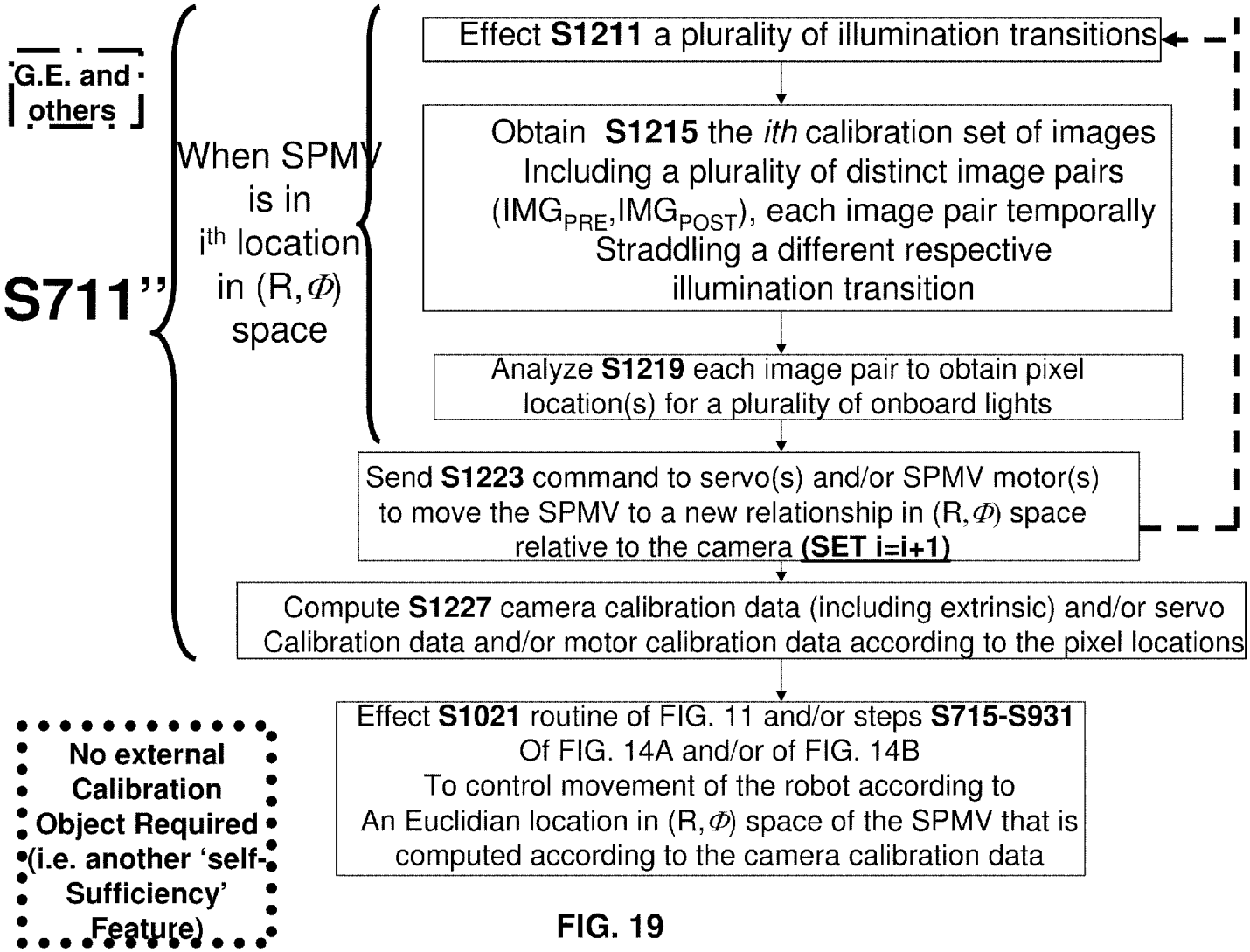

FIGS. 18A-19 (and some other figures) relate to 'self-sufficient' embodiments where it is possible to calibrate the observing camera 110 and/or onboard motor of the SPMV 120 and/or a motor of a servo assembly 112 using the same SPMV 120 which is to be later controlled according one or more mapping functions (i.e. associated with camera and/or servo motor and/or SPMV motor calibration) created by the calibration process.

This 'self-sufficient' approach obviates the need for a special calibration object (i.e. or the need to effect any calibration procedure that requires a relatively 'high' degree of technical competence by user 102) and allows for the distribution of relatively simple systems that employ a minimal number of components.

Thus, in some embodiments (for example, see FIGS. 18A-19), information describing illumination transitions is employed to compute calibration data for an observing camera 110 (see FIGS. 12 and 18A) and/or for one or more onboard motors powering SPMV 120 (see FIGS. 24A and 23) and/or for a motor of a servo (see FIGS. 24B and 22B) on which a camera is mounted (i.e. for embodiments where the servo is part of the system—there is absolutely no requirement to employ any servo, however servo(s) are useful for some embodiments).

A Discussion of Illumination Transitions

Before describing the technique for controlling movement of robotic SPMVs 120 according to 'illumination transitions' of one or more onboard lights 124 mounted onto an SPMV 120, it is useful to discuss the concept of illumination transitions. This concept will first be explained relative to a simple non-limiting example illustrated in FIGS. 11A-11B.

In FIG. 11A, in FRAME 1 (at time $t_1$), no lights are illuminated; in FRAME 2 (at time $t_2$), only light 124A is illuminated; in FRAME 3 (at time $t_3$), only light 124B is illuminated; in FRAME 4 (at time $t_4$), only light 124C is illuminated; in FRAME 5 (at time $t_5$), only light 124D is illuminated.

By turning on the light 124A, SPMV 120 is said to undergo an illumination transition $TRANS_1$ between the time of FRAME 1 and the time of FRAME 2 (and illumination transition $TRANS_1$ relates only to a single light 124A); by simultaneously turning off light 124A and turning on light 124B, SPMV 120 is said to undergo an illumination transition $TRANS_2$ between the time of FRAME 2 and the time of FRAME 3 (and illumination transition $TRANS_2$ relates to lights 124A and 124B); by simultaneously turning off light 124B and turning on light 124C, SPMV 120 is said to undergo an illumination transition $TRANS_3$ between the time of FRAME 3 and the time of FRAME 4 (and illumination transition $TRANS_3$ relates to lights 124B and 124C); by simultaneously turning off light 124C and turning on light 124D, SPMV 120 is said to undergo an illumination transition $TRANS_4$ between the time of FRAME 4 and the time of FRAME 5 (and illumination transition $TRANS_4$ relates to lights 124C and 124D).

In the simplified example of FIG. 11A, illumination transitions related only to various embodiments, illumination transitions may relate to modifying light brightness and/or light color. It is appreciated that turning the light on or turning the light off (as illustrated in FIG. 11A) is a particular case of the more general concept of "modifying light brightness."

A Discussion of Pixel Locations

By effecting a subtraction between frames, it is possible to determine a pixel location of one or more onboard lights 124.

In the example of FIG. 11A, the images of all frames are substantially identical with the exception of the pixels at the onboard light(s)—this is because the location and orientation or the SPMV 120 relative to observing camera 110 is identical in all frames, and the only deviation between the images relates to different 'illumination configurations' of the onboard lights 124.

The "difference images" are illustrated in FIG. 11B—these images are obtained by subtracting one frame from another frame, for example on a 'pixel-by-pixel' basis (e.g. it is possible to subtract the intensity of each pixel in a first frame/image from the intensity of the corresponding pixel in a second frame/image). As is illustrated in FIG. 11B, it is possible to determine the pixel location of an individual onboard light by comparing pairs of images. It is noted that image subtraction is only one example of an image comparison.

In the event that the images of any image pair whose constitutive images are compared substantially identical images (i.e. identical in all aspects except for appearance deviations associated with a illumination transition(s)), it may be useful to subtract images when comparing a pair of images ($IMG_{PRE}$, $IMG_{POST}$), where $IMG_{PRE}$ describes the appearance of the SPMV including the onboard lights 124 before a given illumination transition, and $IMG_{POST}$ describes the appearance of the SPMV including the onboard lights 124 after a given illumination transition—for the example of $TRANS_1$, it is possible to write that FRAME 1 is a $IMG_{PRE}$ and FRAME 2 is a $IMG_{POST}$.

The deviation between frames (illustrated in FIG. 11B) that are caused by illumination transition (i.e. the change of light brightness and/or color for one or more onboard light(s)) may appears as an entire single pixel or a 'cloud' comprising more than one pixel and/or with all pixels in the cloud have the same deviation value or a range of values.

For the present disclosure, a "pixel location" refers to either (i) a single pixel; (ii) a portion of a single pixel; and (iii) a centroid of a group of more than one pixel (for example, weighted by brightness or darkness or color). The "pixel location" refers to a position in the image space and not to a position in world space.

In some embodiments, it may be preferred that the length and width of the cloud of pixels are on the same order of magnitude.

As noted above, the "image comparison" routine employed in FIG. 11B was a simple image subtraction. Nevertheless, it is noted that image subtraction (used to generate FIG. 11B) is not the only possible type of image comparison that may be used. In embodiments where $IMP_{PRE}$ and $IMG_{POST}$ deviate due to relative translational or rotational motion of the camera and/or SPMV 120 (or a portion thereof), it may be useful, when effecting the image comparison, to first employ motion detection techniques to transform one of $IMG_{PRE}$ and $IMG_{POST}$ into 'transformed image' which is substantially identical to the other of $IMG_{PRE}$ and $IMG_{POST}$. In one use case, the SPMV 120 is in translational and/or rotational motion during the illumination transition and thus has a different location in (R,Φ) space in $IMG_{PRE}$ and $IMG_{POST}$.

Motion detection or motion estimation techniques are well-known in the art and are used extensively in, for example, video compression.

It is possible to subtract this transformed image (i.e. transformed to reverse a change in location/orientation between camera 110 and SPMV 120—for example, due to mechanical motion of camera 110 or SPMV 120) from one of $IMG_{PRE}$ and $IMG_{POST}$ in order to obtain a pixel location of one or more onboard lights.

Camera Calibration Data

FIG. 12 shows a map between individual pixels and manifolds within the real world (for example, lines). This mapping is defined by the camera calibration data including extrinsic calibration data.

As will be discussed below with reference to FIGS. 13-16, it is possible to use this camera calibration data (for example, in step S923 of FIG. 13 or FIG. 16A) in order to (i) determine a real-world Euclidian location of one or more onboard lights 124; (ii) regulate movement of the SPMV 120 in accordance with the determined real-world location.

In some embodiments, because the mapping between "points in pixel space" on the left hand side of FIG. 12 an multi-point manifold on the right hand side of FIG. 12, it may be useful to employ other information when determining which point in Euclidian space matches a particular pixel. In one non-limiting example, information relating to an known or estimated height of an onboard light 124 above the floor.

The skilled artisan is referred to the section "Details of a Specific Exemplary Embodiment" below for additional details about how non-limiting examples for computing the real-world Euclidian location from a pixel location.

A Discussion of an Exemplary Routine for Operating an SPMV

Figure 13:
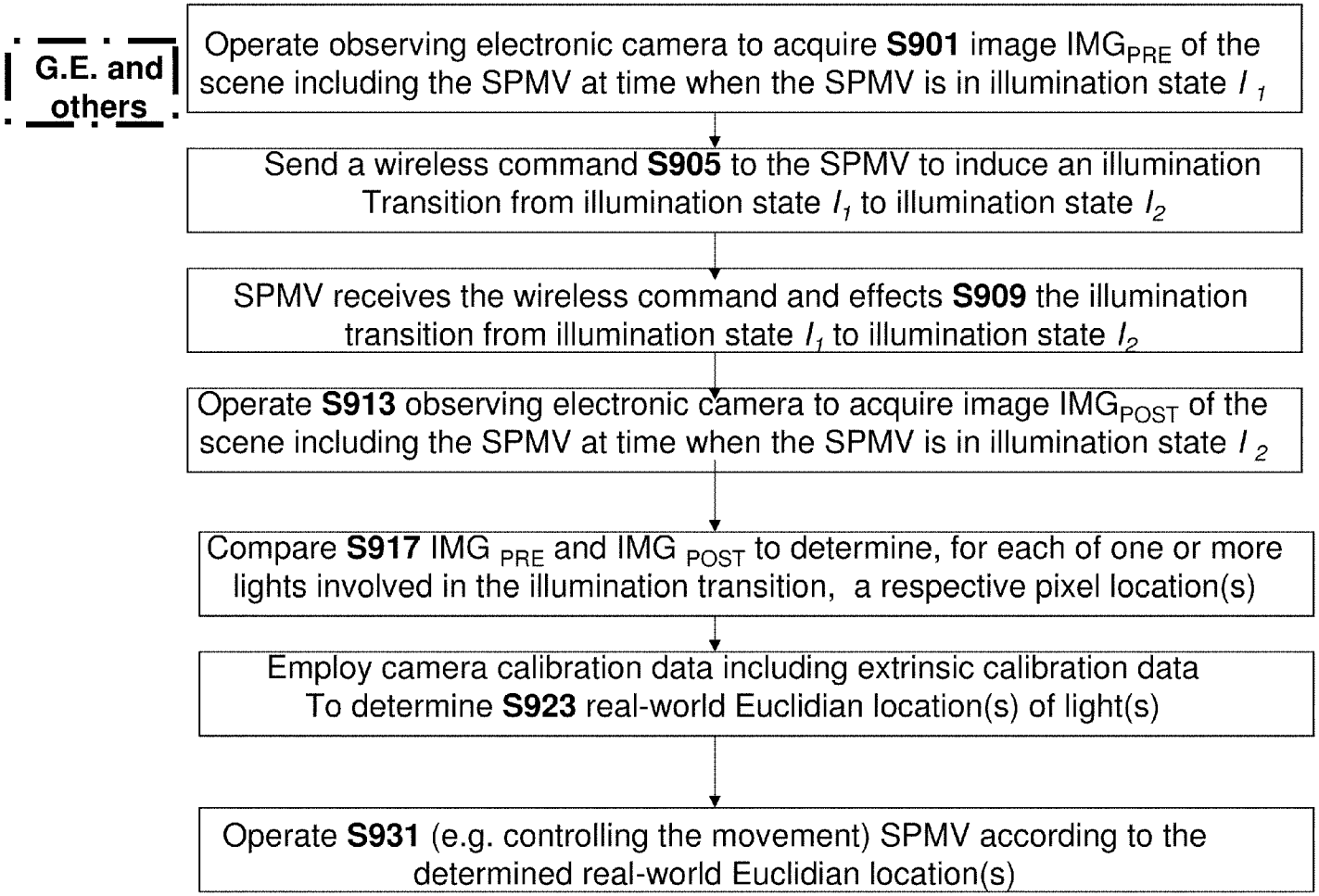
FIGS. 13, 16A-16B are flow charts for routines of operating an SPMV according to illumination transitions.

FIG. 13 is a flow chart of a routine for operating (e.g. controlling movement) of an SPMV 120 according to a Euclidian location detected from a respective pixel location of each onboard light 124 of one or more onboard lights. FIG. 13 is discussed also with reference to FIGS. 14-15.

In FIGS. 14A-14E it is assumed that $t_2$ occurs at a time later than $t_1$, $t_3$ occurs at a time later than $t_2$, and $t_4$ occurs at a time later than $t_3$.

Figure 14A:
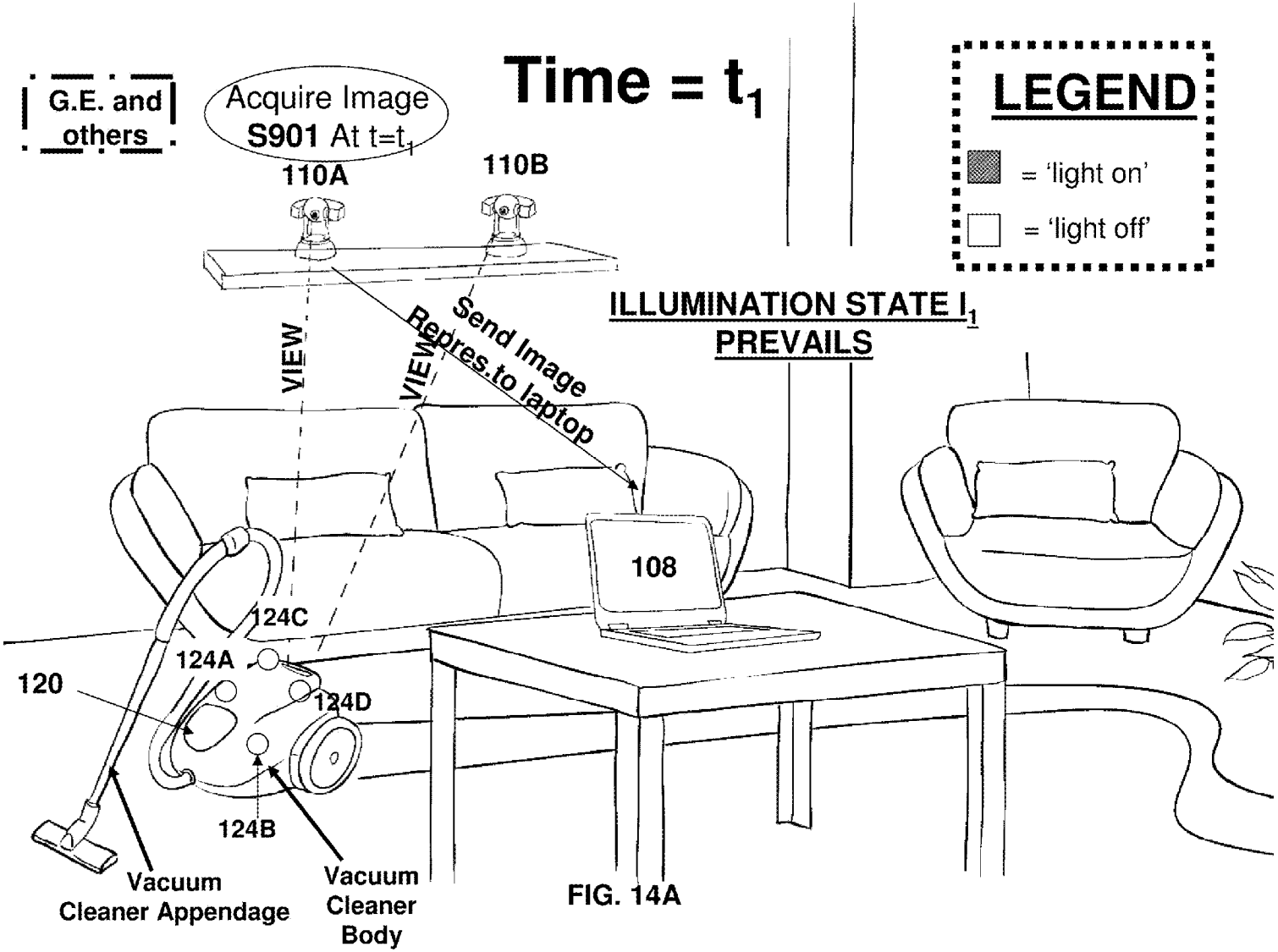
FIGS. 14A-14E illustrate a use case of FIG. 13.

In step S901 of FIG. 13 (and as illustrated in FIG. 14A), the observing electronic camera is operated to acquire an image at a time $t_1$. In the example of FIG. 14A, this describes the vacuum cleaner SPMV 120 when no onboard lights are illuminated. This image will be referred to as $IMG_{PRE}$.

Figure 14B:
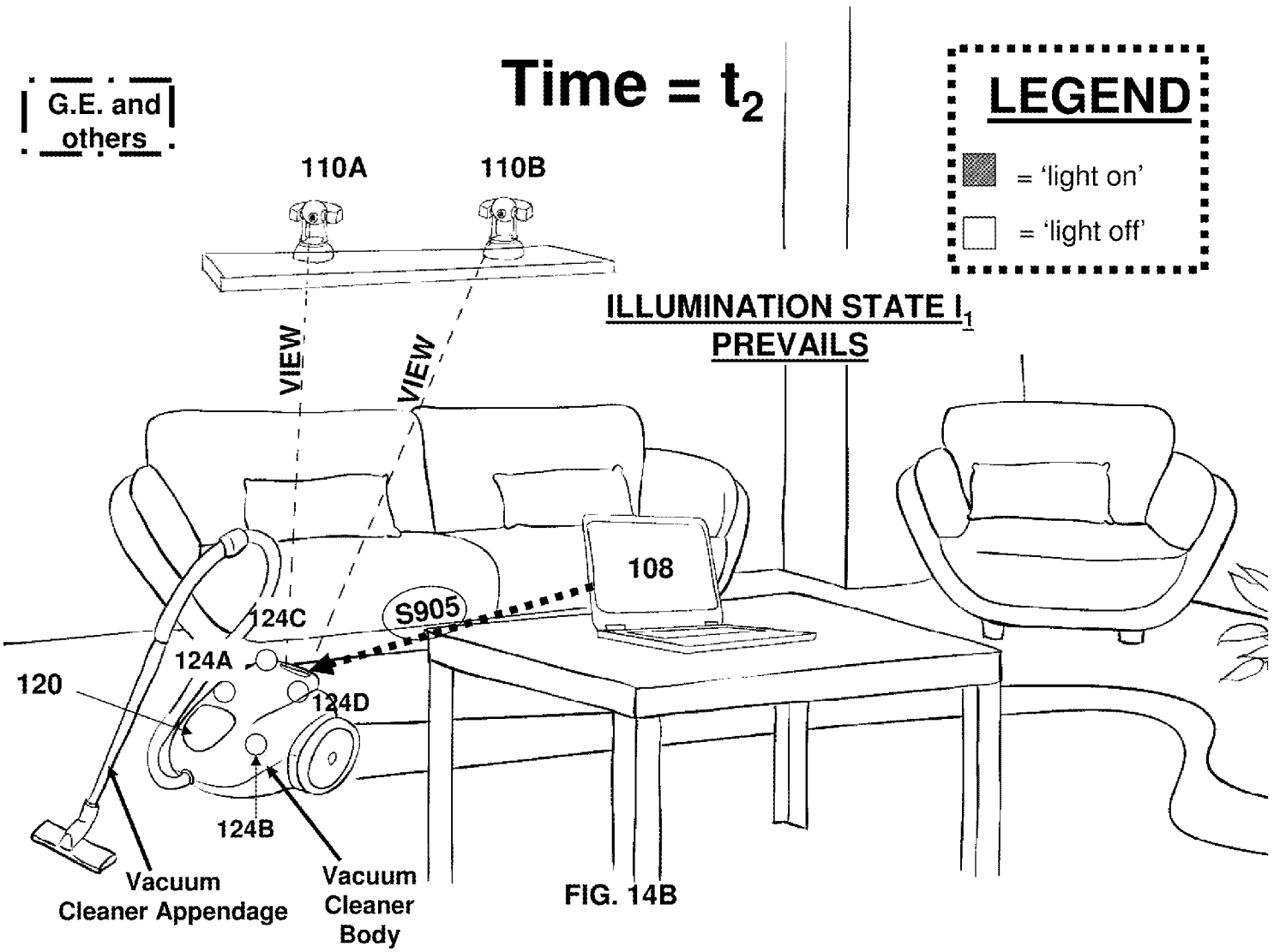

In step S905 of FIG. 13 (and at time $t_2$—see FIG. 14B), a wireless command is sent from computer unit 108 to SPMV 5905 instructing the SPMV 5905 to undergo an illumination transition. In the example of FIG. 14B, this command is a command to 'turn on light 124C.'

In step S909 of FIG. 13 (and at time $t_3$—see FIG. 14C), the onboard electronic circuitry (e.g. of SPMV electronic assembly 84—see FIG. 5) receives this command (for example, using an onboard wireless receiver) and executes this command to turn on light 124C. Thus, the time of the 'illumination transition' is $t_3$.

Figure 14C:
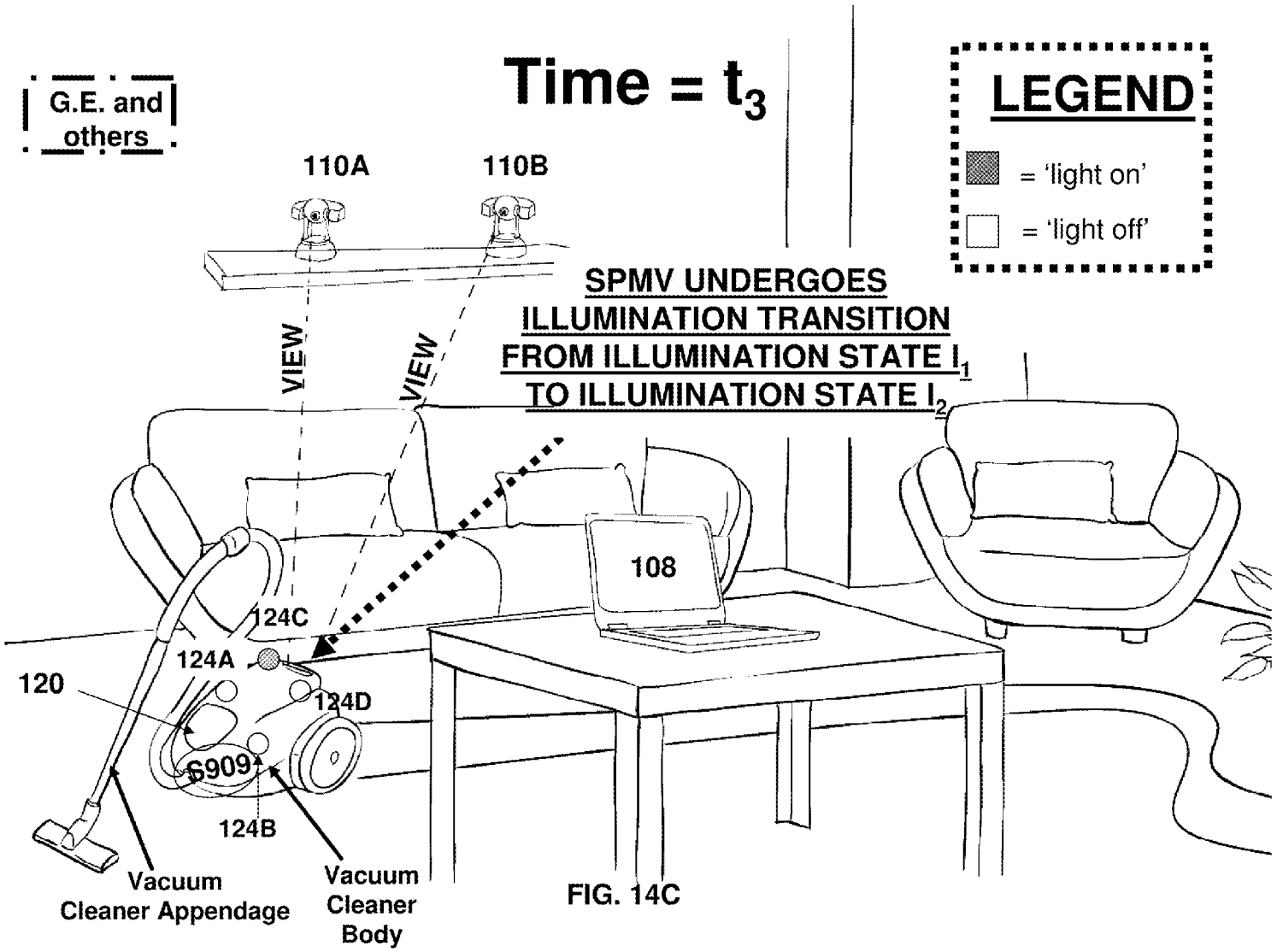
Figure 14D:
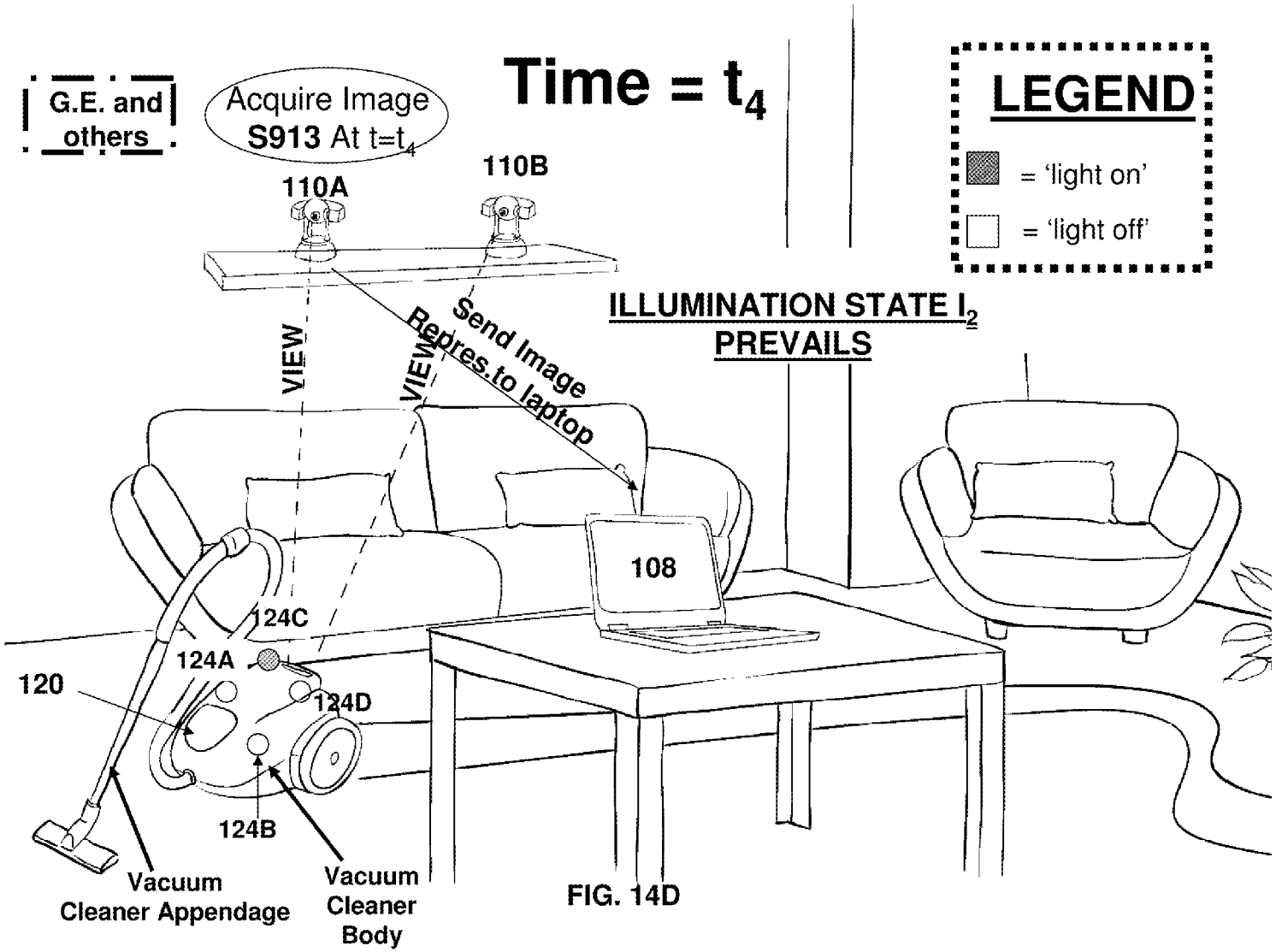
Figure 14E:
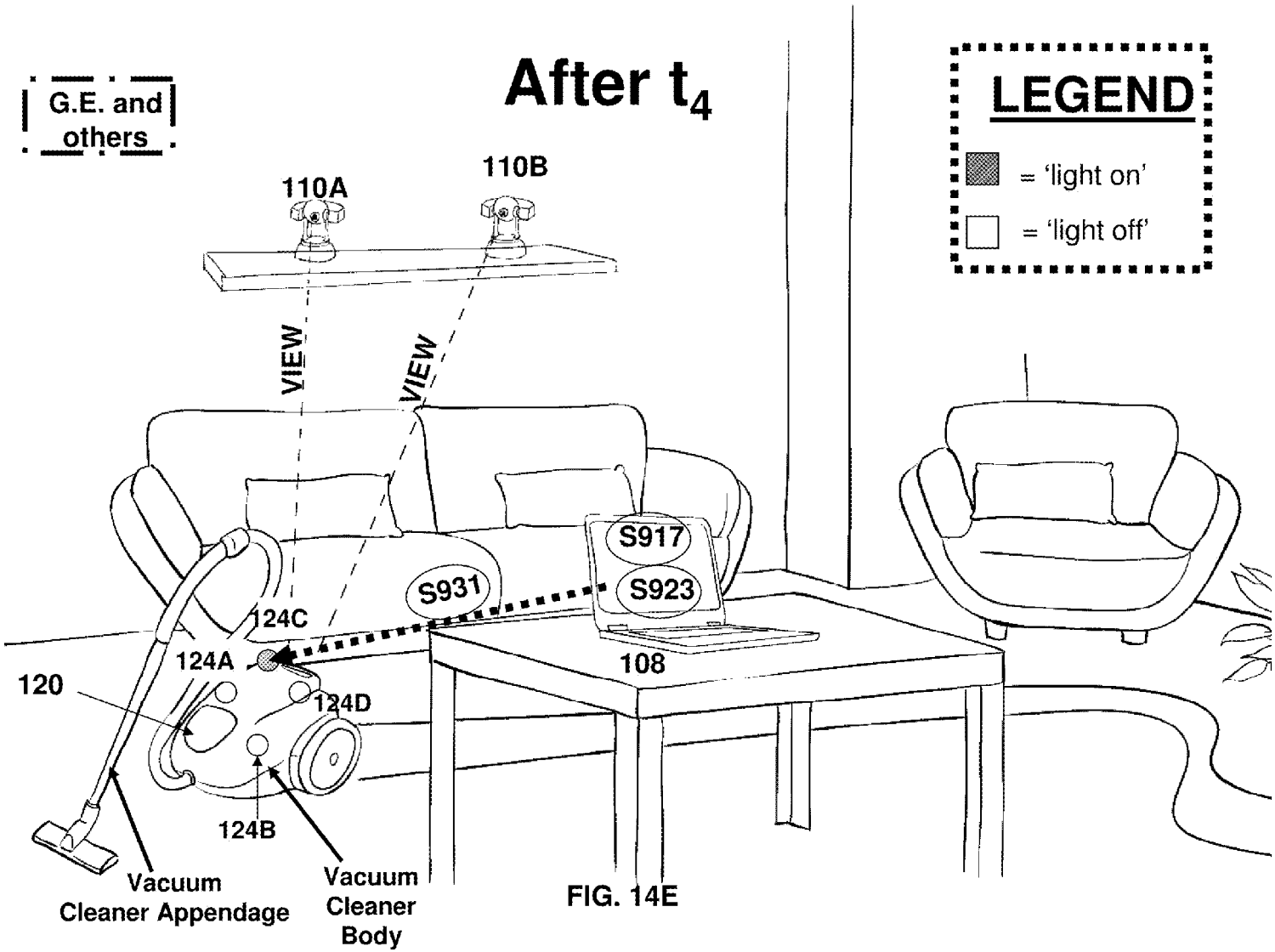

In step S913 of FIG. 13, the observing electronic camera acquires and at time $t_3$—see FIG. 14C) an additional image—this image will be referred to as $IMG_{POST}$.

The image of step S901 is acquired at time $t_1$, and describes the appearance of SPMV before the illumination transition which occurs at time $t_3$—therefore, the image of step S901 is referred to as $IMG_{PRE}$. Before the illumination transition which occurs at time $t_3$ in step S909 illustrated in FIG. 14C, illumination state $I_1$ (in illumination state $I_1$, no onboard lights are illuminated) prevails—it is this illumination state which is described in $IMG_{PRE}$.

The image of step S913 is acquired at time $t_4$, and describes the appearance of SPMV after the illumination transition which occurs at time $t_3$—therefore, the image of step S913 is referred to as $IMG_{POST}$. After the illumination transition which occurs at time $t_3$ in step S909 illustrated in FIG. 14C, illumination state $I_2$ (in illumination state $I_2$, only light 124C is illuminated) prevails—it is this illumination state which is described in $IMG_{POST}$.

In one example, $IMG_{PRE}$ and $IMG_{POST}$ are substantially identical except for features related to the illumination transition (i.e. $IMG_{PRE}$ describes illumination state $I_t$ and $IMG_{POST}$ describes illumination state $I_2$).

In step S917 of FIG. 13, $IMG_{PRE}$ and $IMG_{POST}$ are compared to determine a respective pixel location of each onboard light 124 of one or more lights. In one example, the comparison may include an image subtraction.—see, for example, the discussion above with reference to FIG. 11B. In the example of FIG. 14, step S917 is carried out in computer unit 108—for example, by software executing on computer unit 108.

In step S923 of FIG. 13, a real-world Euclidian location is determined for each onboard light 124 involved in the illumination transition of step S909—in the example of FIG. 14, only a single light (i.e. 124C) is involved in the illumination transition. However, embodiments of the present invention relate to 'multi-light' illumination transitions when a plurality of onboard lights 124 are involved in an illumination transition (see the discussion below with respect to FIG. 17). In the example of FIG. 14, step S923 is carried out in computer unit 108—for example, by software executing on computer unit 108.

In step S931 of FIG. 13, movement of the SPMV is controlled according to the determined real-world locations. In the example of FIG. 14, controlling the robot includes generating and wirelessly transmitting a command to SPMV 120—for example, a command to accelerate or decelerate or SPMV 124, or a command to move SPMV 120 to a particular Euclidiantly-defined real-world location, or to a command to move SPMV 120 to a particular Euclidiantly-defined real-world orientation, or to move at a particular Euclidiantly-defined real-world speed, or to rotate at a particular Euclidiantly-defined real-world rotation rate.

An Additional Discussion Describing Some Exemplary Implementations of Step S931

In one use-case related to step S931 (this relates to 'example 1' of FIG. 15), the distance between the SPMV 120 and an obstacle (for example, a table or sofa in FIG. 1 or any other possible obstacle) may be determined according to the Euclidian location of the onboard light mounted on the SPMV 120 (which may indicate the location and/or orientation of SPMV 120). According to this use case, in response to the distance (or a change in distance) between the car and the obstacle (and thus in response to determined in step S923 of the Euclidian) location, it is possible to control movement of SPMV 120—for example, to (i) steer the SPMV 120 to the left or right, (ii) to reverse distance of the SPMV 120 or to (iii) decelerate or stop SPMV 120 in order to miss the obstacle.

In another use-case related to step S931 and FIG. 1 (this relates to 'example 1' of FIG. 15), the distance between computer robot 120C and an object other than an obstacle (for example, a game prop such as ball 114) may be determined according to the Euclidian location of the any combination of onboard light(s) 124 (as determined in step S923). In this use case, if the computer SPMV 120C gets within a certain distance of ball 114, robotic arm 106C may move in response. Thus, it is possible to operate a mechanical robotic appendage according to distance between SPMV 120C and a foreign object.

Another use case (this relates to 'example 1', of FIG. 15) relates to a robotic "butler" or "servant" SPMV 120 serves a drink to a person. In this example, the robotic butler SPMV 120 whose base is currently stationary may rotate its mechanical arm as the robotic butler SPMV 120 serves the drink. In this use case, a dog suddenly moves close to the 'rotating butler.' Continued rotation would cause a collision between the robotic arm holding the drink and the dog. Thus, in this use case, the information from the Euclidian location of the onboard light(s) 124 derived in step S923 may provides an indication of the orientation of the robotic arm of the robotic butler SPMV 120, and hence may provide an indication of the rotational distance (or rotational displacement—for example, in degrees or gradients) between the robotic arm and the foreign object (for example, an obstacle such as a dog). In step S931, the robotic arm would be operated accordingly.

Another use case (this relates to 'example 1' of FIG. 15) relates to a robotic forklift approaching its load. The distance between the tongs of the forklift and the load may be determined according to the Euclidian location of the light(s) of step S923. In this example, upward motion of the tongs is contingent upon the forklift being "close enough" to the load to lift the load. The distance between the tongs of SPMV 120 and the load may be determined according to the Euclidian location of one or more lights as determined according to earlier steps preceding step S931. Thus, in this example, the operation of the forklift may be said to be carried out according to the Euclidian location of one or more lights as determined according to earlier steps preceding step S931.

Another use case relates to motion control. In this example, an SPMV 120 is attempting to move from a first location (for example, computer goalpost 118C of FIG. 1) to a second location (for example, user goalpost 118U of FIG. 1). In this example, use of inexpensive and unreliable mechanical components (e.g. onboard SPMV motor(s), wheels of SPMV 129) within SPMV 120 may cause SPMV 120 to cause SPMV to move slightly to the left or slightly to the right instead of straight ahead. In this example, in step S771, the 'pattern' of motion to the left or right is detected, and in step S775, in response to this pattern is corrected—for example, by steering SPMV 120 in the direction opposite of its 'biased' direction (i.e. if SPMV 120 moves forward and slightly to the left, corrective action of step S775 may cause SPMV 120 to move forward and slightly to the right to compensate).

Figure 15:
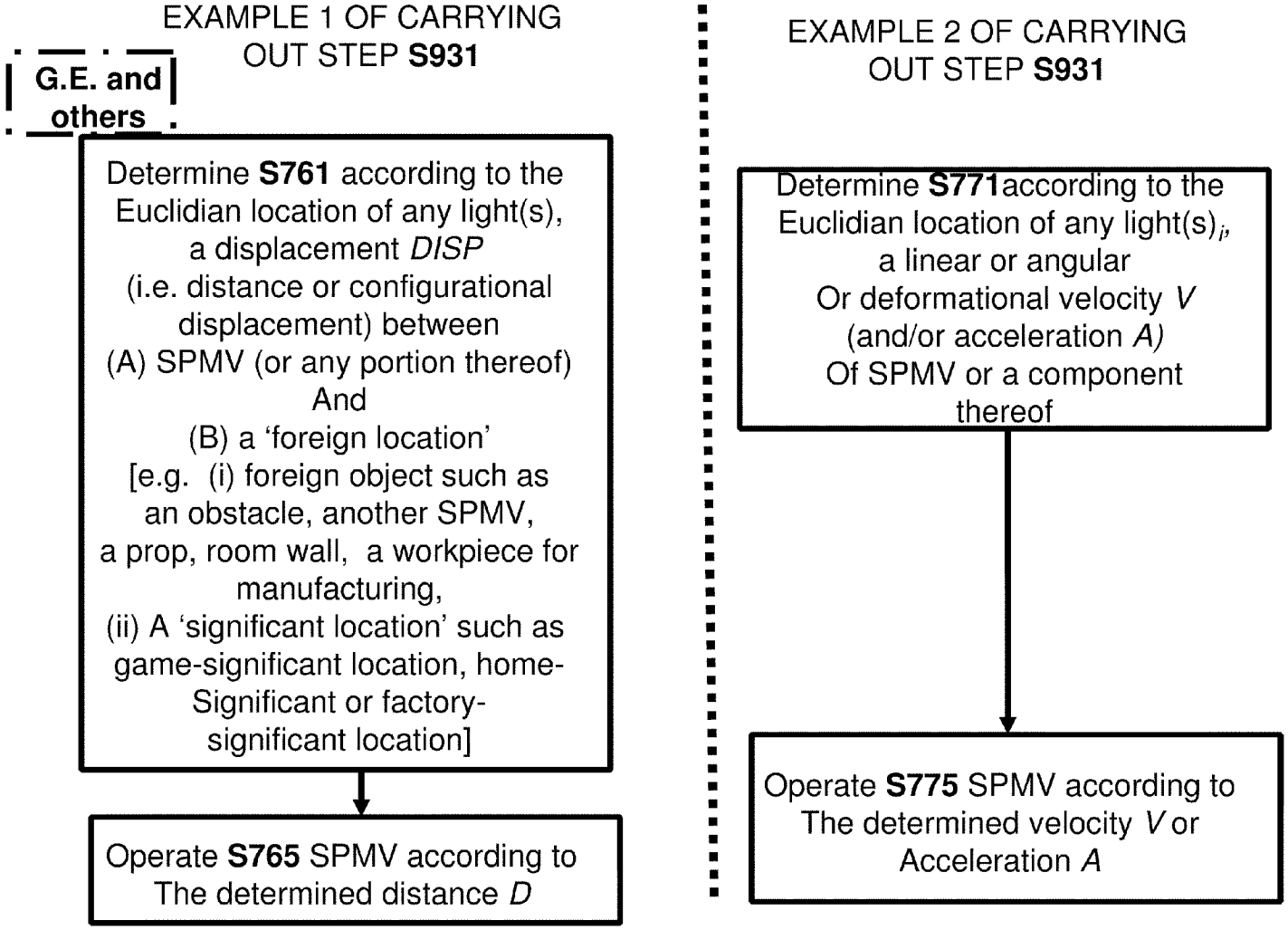
FIG. 15 is a flow chart of a routine for carrying out step S931.

FIG. 15 indicates examples of step S931 in accordance with some embodiments. The left side of FIG. 15 describes a first example and the right hand side of FIG. 15 describes a second example. According to the first example, in step S761 a displacement or distance (either translational or rotational or configurational distance) between SPMV 120 (or a portion thereof) and a foreign location is determined according to the Euclidian location of any light(s) that was determined in step S912. In step S765, the SPMV 120 is operated according to the determined distance or displacement (i.e. either translational rotational or configurational) determined in step S761.

According to the second example (see the right hand side of FIG. 15), in step S771, according to the Euclidian location of any light(s) (i.e. as determined in step S923 of FIG. 13), a time derivative of displacement (e.g. linear or angular velocity or acceleration) may be determined (see the above discussion of the SPMV which veers to the left or right).

In some of the above examples, the 'operating' of step S931 included sending a wireless command to SPMV 120. However, this is not a limitation. In yet other embodiments, the command may be sent via a data cable. In yet other embodiments, one or more of steps S905 and/or S931 are carried out within SPMV electronic assembly 84, and the command may be generated within SPMV 120.

An Additional Discussion of Step S931

As is evident from the examples discussed above, in some embodiments, in step S931 the SPMV 120 may be operated (e.g. to control rotational or translational movement of SPMV of a portion thereof) according to a Euclidian relationship (for example, a distanced between, an angle between, a rate of change of distance or angle, etc) between (i) SPMV 120 (or a location on SPMV 120); and (ii) a 'foreign object' other than SPMV 120 (for example, another SPMV or a prop or any other object) and/or a Euclidian location or locations (for example, a boundary such as the 'out-of-bounds' boundary 96 in the soccer game depicted in FIG. 1).

Thus, some embodiments relate to utilizing the combination of (i) the Euclidian location of one or more lights that undergo an illumination transition as described in a plurality of images of the scene including the SPMV 120 having onboard lights 124; and (ii) other information describing other objects in the scene as recorded in the electronic image(s) acquired by observing camera 110.

Examples of the 'other information' includes but is not limited to location or orientation information for the other object, shape information describing the foreign object or boundary, height information describing the foreign object or boundary, color or surface texture information for the foreign object, and motion information describing translational or rotational motion of the foreign object.

In some non-limiting embodiments, in order to detect the location or any other aspect of the 'foreign object' within the scene image including SPMV 120 acquired by the observing camera(s), one or more the following techniques may be employed (i.e. either any single technique or any combination or multiple techniques):

A) information from a plurality of cameras 110 viewing the same scene (for example, cameras 110A and 110B of FIG. 1 of 3) from different perspectives—this image may include 3D or 'stereoscopic' data derivable from the plurality of images where each image is acquired by a different respective camera. In some embodiments, it may be assumed that all objects in the scene are placed on 'the floor,' and when the 'height' as detected by the plurality of camera(s) 110. Thus, in some embodiments, step S931 is carried out in accordance with the both (i) the real-world Euclidian location determined from analyzing illumination transition in the images of the scene including the SPMV 120; and (ii) stereoscopic and/or 3D image information derived from multiple images of the scene.

B) in some embodiments, it may be difficult to detect where a given foreign object is (e.g. because it is a 'difficult' image processing problem). Nevertheless, if the foreign object (e.g. ball 114 in FIG. 1) moves, then it may be possible to effect some sort of motion-detection routine in order to detect the location of the foreign object. Thus, in some embodiments, step S931 is carried out in accordance with the both (i) the real-world Euclidian location determined from analyzing illumination transition in the images of the scene including the SPMV 120; and (ii) results of motion detection of a foreign object.

C) manual input for the user—in some embodiments, the user may manually provide information describing the real-world location of various foreign object (i.e. obstacles) in the scene—for example, describing the real-world size of the foreign objects and/or the real-world distance between the foreign objects and/or a pre-determined real-world trajectory in which any foreign object will translate or rotate. Thus, in some embodiments, step S931 is also carried out in accordance with this information.

In a non-limiting example, a software application executing on a computer 108 may provide a user interface for receiving this manual input. This user interface may include a visual description of the scene either as (i) the image taken by the camera unmodified (ii) a combination of images stitched together as is known in the art (iii) a 3D graphic representation of the room as calculated from the stereoscopic or other calculation. The user may then be prompted to draw on the screen locations or lines or interest or may be prompted to respond to a question regarding a highlighted area.

A Discussion of Techniques for Controlling Camera 110 and Onboard Lighting 124

In steps S901 and S913, images are acquired by observing camera(s) 110. In some embodiments, an explicit command may be sent from computer unit 108 to camera 110 for the purpose of acquiring the image at the appropriate time. After the command of step S901 is sent computer unit 108 to camera 110 to acquire $IMG_{PRE}$, a different command is sent from computer unit 108 in step S905 to induce the illumination transition. After time is allowed for the illumination transition to be carried out at SPMV 120 (or alternatively, after an acknowledgment of the illumination transition is received back), in step S913 it is possible to send an additional command to camera 110 (for example, in response to an acknowledgement of the illumination transition wirelessly received by computer unit 108 from SPMV 120—thus the image acquisition of step S913 may be in response to the illumination transition).

Thus, the 'command scheme' implementation for instruction the camera discussed with reference to FIG. 13 is just one way of obtaining a time series of images of the scene including SPMV. In the example of FIG. 13, the time series includes $IMG_{PRE}$ acquired according to the command of step S905 and $IMG_{POST}$ acquired according to commands of step S905 and S913, It is noted, however, that there is no requirement that commands be provided to camera 110 and/or onboard lighting 124.

In one non-limiting use case, camera 110 may be a video camera and each image may be associated with a time stamp. In this use case, computer unit 108 (or any other electronic circuitry or logic managing the process of FIG. 13 or 16A or 16B) may obtain each video frame with some sort of time stamp. If computer unit 108 (or any other electronic circuitry or logic managing the process of FIG. 13 or 16A or 16B) is 'aware' of the time of the illumination transition, it may be possible to select from the video frames images for $IMG_{PRE}$ and $IMG_{POST}$. This may require correlating the image acquisition times for camera(s) 110 with an illumination transition time of onboard lighting 124.

In some embodiments, the illumination transition time may be determined according to the time a command is sent to SPMV (for example, see step S905 of FIG. 13). Then, the selecting of $IMG_{PRE}$ and $IMG_{POST}$ may be carried out so that the image acquisition time by camera 110 of $IMG_{PRE}$ precedes the image acquisition time by camera 110 of $IMG_{POST}$.

Alternatively, there is no requirement to send a wired, or wireless command to induce the illumination transition. In some embodiments, onboard lights 124 may be 'internally configured' (for example, SPMV electronics assembly 84 may be internally configured without requiring any external input from outside of SPMV 120) to automatically undergo one or more illumination transitions—for example, at predetermined times (e.g. according to some periodic blinking pattern other with some other pre-determined temporal scheme).

In one example when it is 'known' or 'predicted' that an image transition will occur at a particular time $t_{given}$, then it is possible to acquire in $IMG_{PRE}$ and/or $IMG_{POST}$ 'response' to this information about the timing of the illumination transition at $t_{given}$. In another example, camera(s) 110 may be configured to repeatedly acquire images of the scene (for example, in 'video camera mode') and images may be designated as $IMG_{PRE}$ and/or $IMG_{POST}$ according to time stamps of the image and information about the illumination transition at $t_{given}$.

Figure 16A:
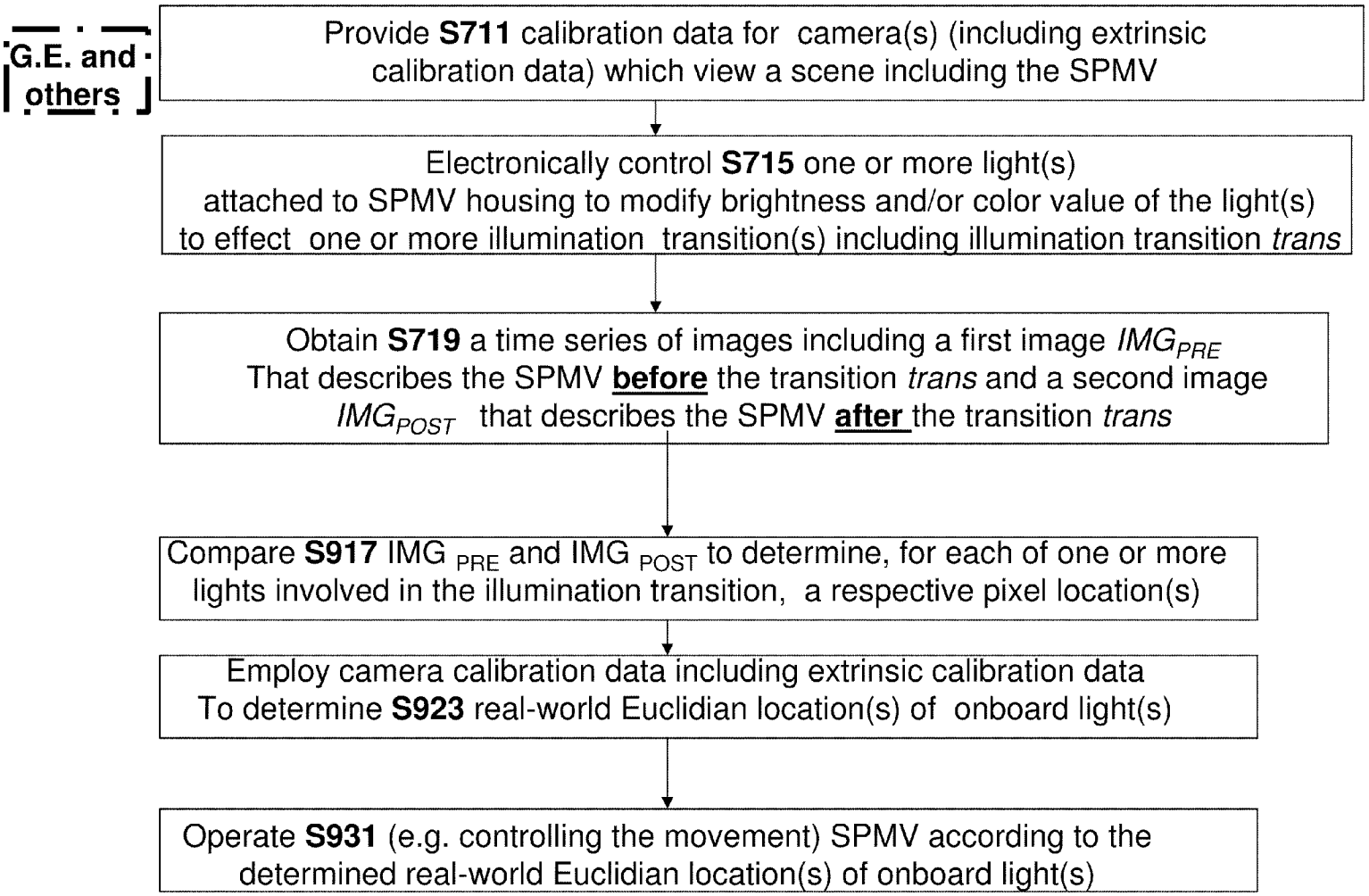
Figure 16B:
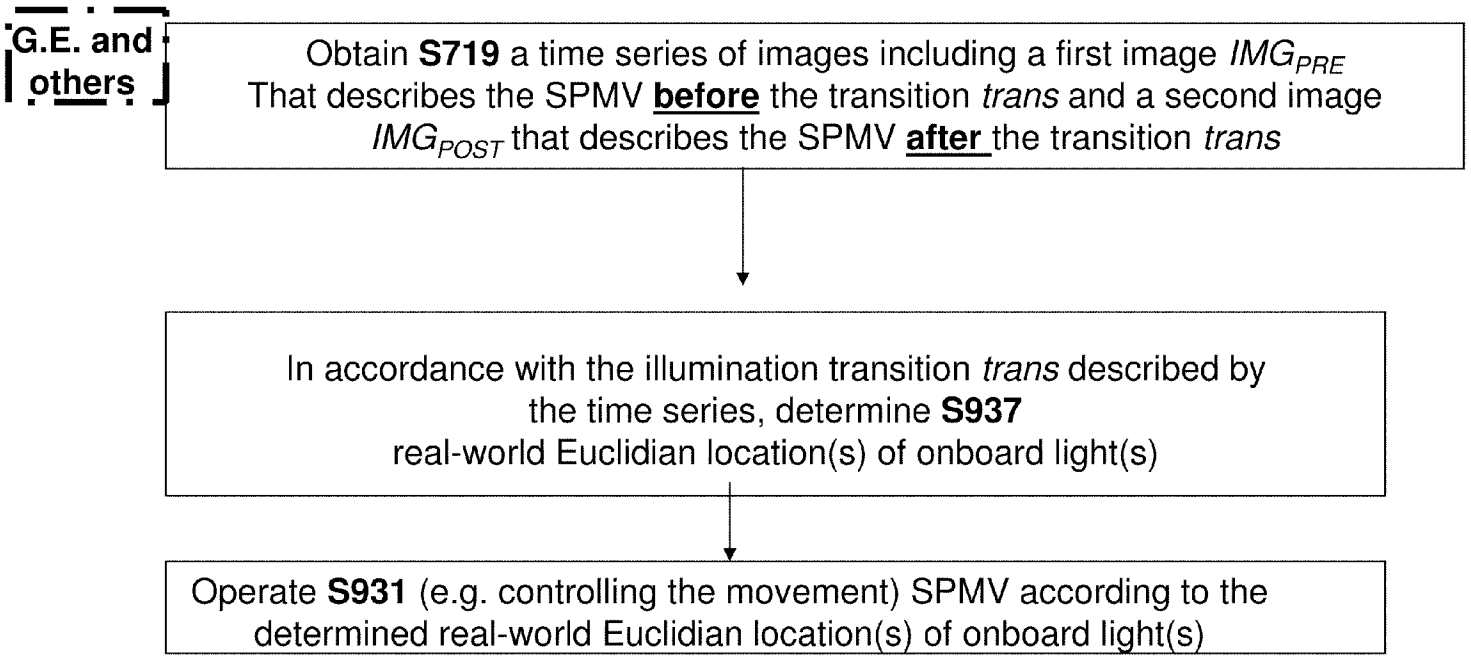

A Discussion of FIGS. 16A-16B

FIGS. 16A-16B are flow charts of routines for operating an SPMV 120 according to a Euclidian location of an SPMV (or a portion thereof) as determined The routine of FIG. 13 is one particular 'use-case' example of the routines of FIGS. 16A-16B.

In step S711, camera calibration data including extrinsic calibration data (see, for example, the map of FIG. 12) for one or more observing camera(s) is provided. Routines for determining the camera calibration data including extrinsic calibration data are discussed below with reference to FIGS. 18-19.

In step S715, one or more onboard lights 124 of SPMV 120 are electronically controlled to modify color and/or brightness to effect an illumination transition trans. In one example, this is carried out by sending wireless commands (see steps S905-S909 of FIG. 13). In another example, the onboard lights 124 operate autonomously with no need for external input from outside of SPMV 120 (for example, according to some pre-determined timing scheme).

In step S719, a time series of images is acquired, including $IMG_{PRE}$ and/$IMG_{POST}$. In some embodiments, this is carried out in steps S901 and S913 of FIG. 13. In another embodiment as discussed above, camera 110 may automatically acquire a time series of images (i.e. without receiving explicit instructions via an incoming data communication), and $IMG_{PRE}$ and/or $IMG_{POST}$ may be selected according to a 'temporal calibration' as discussed above. Steps S917-931 are as discussed above.

Reference is now made to FIG. 16B. Step S719 is the same as in FIG. 16A. In step S937, the real-world Euclidian location of one or more onboard light(s) 124 is determined according to an illumination transition described by trans—for example, according to steps S715 and S917-S923 of FIG. 16A. Step S931 is as described above.

Figure 17:
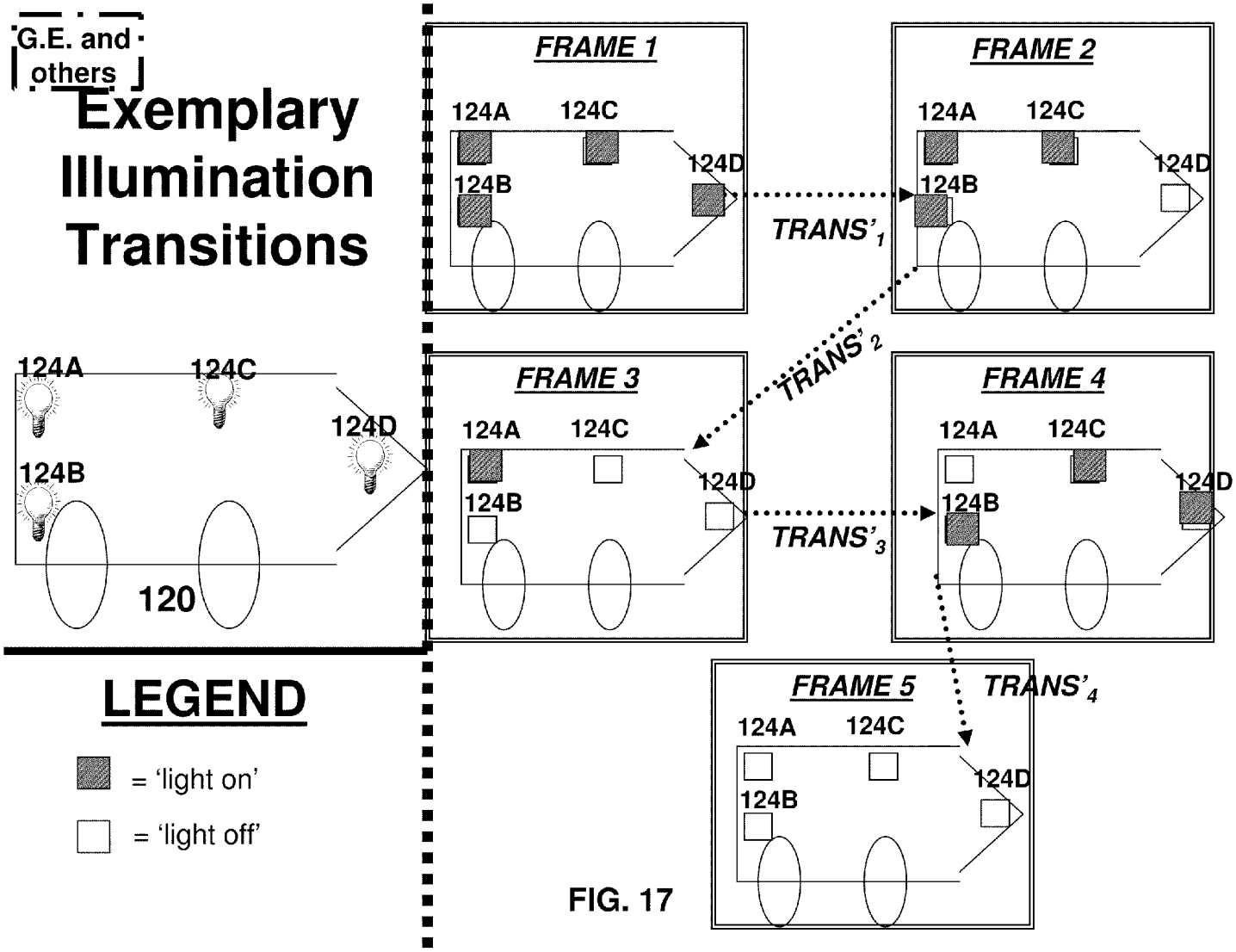

A Brief Discussion of FIG. 17

FIG. 11A described certain illumination transitions. One salient feature of the illumination transitions is that each transition only involved at most a single light transitioning from 'off' to 'on' and at most a single light transitioning from 'on' to 'off.' This is just an example. As shown in FIG. 17, any illumination transition may involve any number of onboard lights.

A Discussion of a Technique for Operating an SPMV in a Held of Field of an Observing Camera in a 'Self-Sufficient' Manner FIGS. 18A-18B are flow charts for techniques for 'self-sufficient' systems where (i) an SPMV 120 is operated according to a Euclidian location of one or more onboard lights 124 as determined from images of the SPMV 120; and (ii) the system does not require any calibration object. FIGS. 18A-18B assumes that the geometry of how the onboard lights 124 are deployed is known a-priori—i.e. that 'real-world' Euclidean distances between onboard lights 124 and/or Euclidean angle between line segments connecting the onboard lights 124 are known.

Instead of requiring an external calibration object and/or the presence of trained technicians, the systems of embodiments of FIGS. 18A-18B are 'self-sufficient' such that calibration data may be calculated according to a time series of images of the SPMV 120 itself. In some embodiments, SPMV 120 include one or more onboard lights 124 which are electronically controlled to undergo illumination transition(s). Comparison of pre-illumination-transition images (i.e. images of the scene including the SPMV that are acquired before respective illumination transitions) with post-illumination-transition images (i.e. images of the scene including the SPMV that are acquired after respective illumination transitions) may be useful for computing calibration data of (i) an observing camera and/or (ii) a servo motor of a servo assembly 112 on which a camera is mounted (i.e. for those embodiments that include a servo assembly 112—as noted above this certainly not a requirement); and/or (iii) an onboard motor of an SPMV 120.

Thus, in step S1011 of FIGS. 18A-18B, respective pixel locations of onboard lights 124 may be determined by comparing pre-illumination-transition images with post-illumination-transition images. In step S1015, it is possible to calculate calibration data from the combination of (i) pixel locations of multiple onboard lights 124 (for example, at least four non-planar onboard lights 124 or at least six onboard lights) and (ii) known real-world Euclidian distances separating the lights and/or known Euclidian.

The skilled artisan is referred to the section "Details of a Specific Exemplary Embodiment" below for additional details about how non-limiting examples for computing the real-world Euclidian location from a pixel location.

The routines of FIG. 18-20 are automatic—i.e. the illumination transitions are carried out automatically by electronically controlling the electronic lights, and (if relevant) servo assembly 112 and/or SPMV 120 operate automatically to mechanically change the distance between camera 110 and/or SPMV 120 and/or the angle of SPMV 120 (or a portion thereof) relative to camera.

In FIG. 18B, step S1015 is generalized into step S1015' where calibration data may be computed for the camera 110 and/or a servo motor of any servo assembly 112 and/or an onboard SPMV motor.

The techniques of FIGS. 18A-18B do not require any mechanical motion in steps S1011-S1015 (or S1011-S1015') and may rely exclusively on an analysis of illumination transitions. Thus, in some embodiments, the relative location of SPMV 120 (and constitutive parts) relative to camera 110 may remain constant during S1011-S1015 (or S1011-S1015').

Nevertheless, experiments conducted by the present inventor have indicated that the quality of calibration may be improved (even dramatically, in some situations) by mechanically moving SPMV 120 and/or camera 110 (for example, using servo assembly 112) during calibration. Techniques for carrying this out are discussed below with reference to FIG. 22.

FIG. 19 is one non-limiting implementation of FIG. 18B. In this example, multiple sets of calibration images are acquired and used in step S711" to compute calibration data. Thus, first a 'first set' of calibration images are acquired during a first pass of steps S1211, S1215 and S1219—these calibration images relate to multiple illumination transitions (for example, at least 3 illumination transitions) that all take place when the SPMV 120 is located in a first location ($R_1$, $\Phi_1$) in (R,Φ) space (e.g. there is no mechanical motion of camera 110 relative to SPMV 120 while the 'first set' of calibration images is acquired). After the 'first set' of calibration images are acquired, in step S1223 the SPMV 120 and/or camera(s) 110 are mechanically moved in step S1223 so the location of SPMV 120 relative to camera 110 in (R,Φ) space is ($R_2$,$\Phi_2$), and a second set of calibration images is acquired when the SPMV 120 is located in a second location ($R_2$,$\Phi_2$) in (R,Φ) space—steps S1211-S1223 may be repeated any number of times—for example, at least 5 or 10 times. In step S1227, calibration data is computed by comparing calibration images with each other according to illumination transitions to determine pixel locations and to determine calibration data according to the known geometry of onboard lights 124.

A Discussion of (R,Φ) Space Describing the Position and/or Orientation of SPMV 120 (or a Portion thereof) Relative to Camera 110

FIG. 20A-20D describe (R,Φ) space of the SPMV and/or a portion thereof relative to camera 110.

Figure 20A:
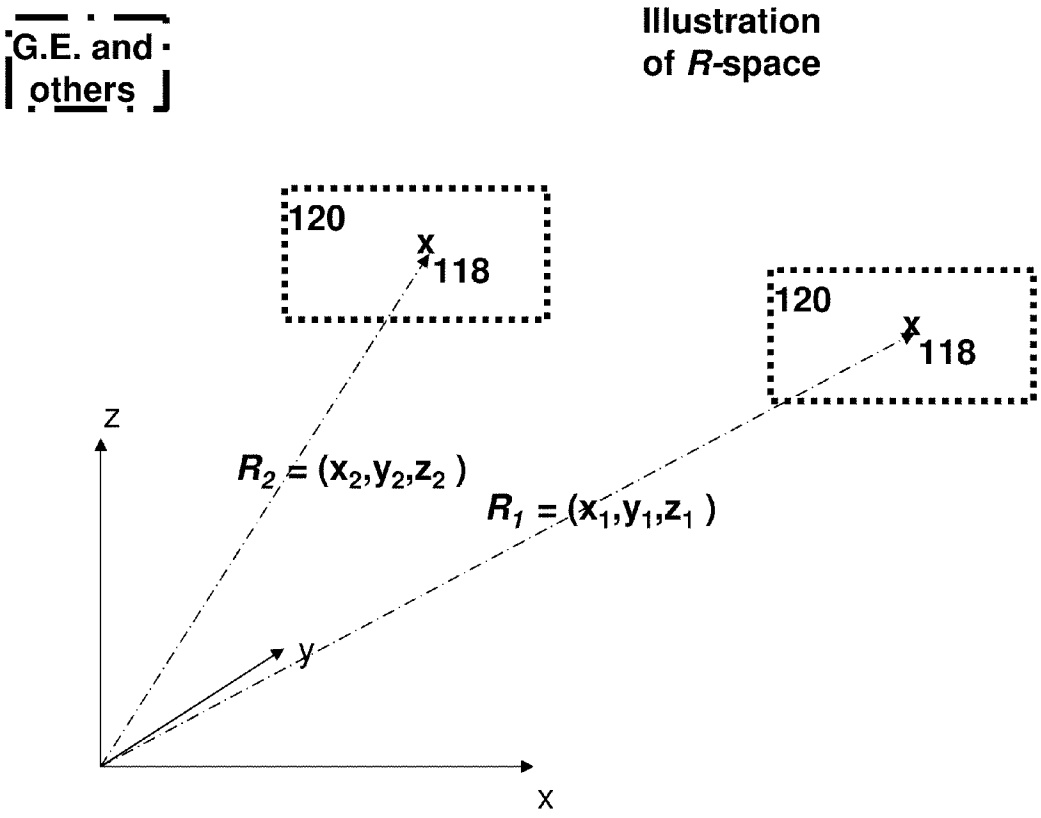
FIGS. 20A-21C illustrate translations and rotations.
Figure 20B:
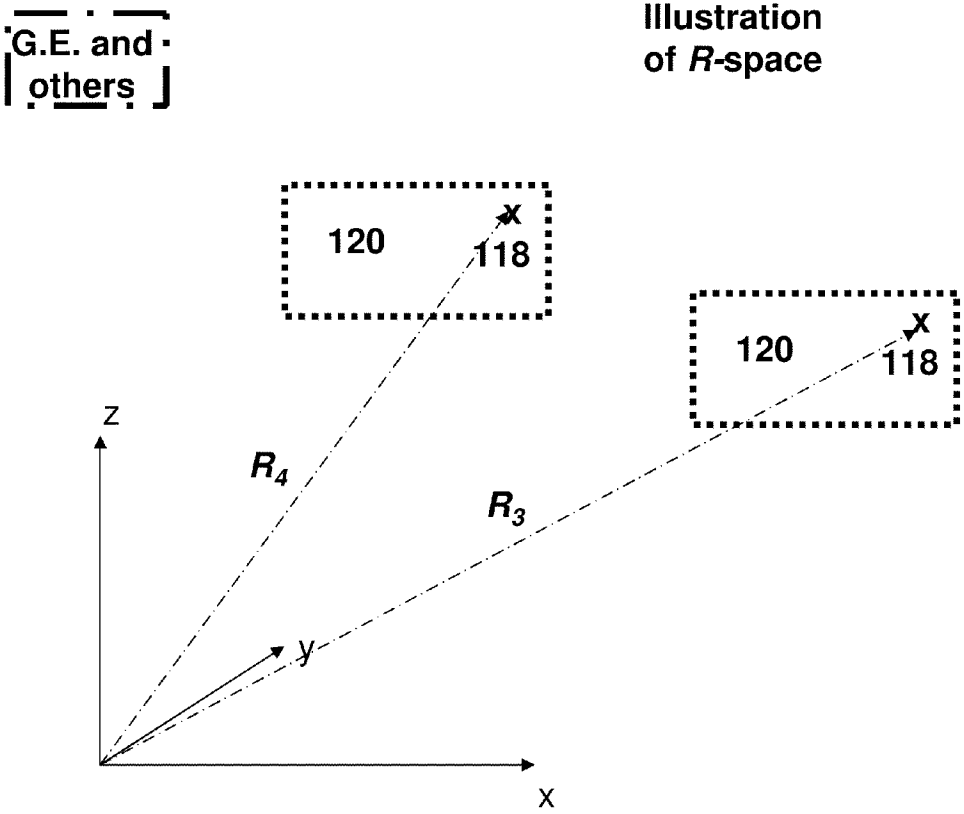
Figure 20C:
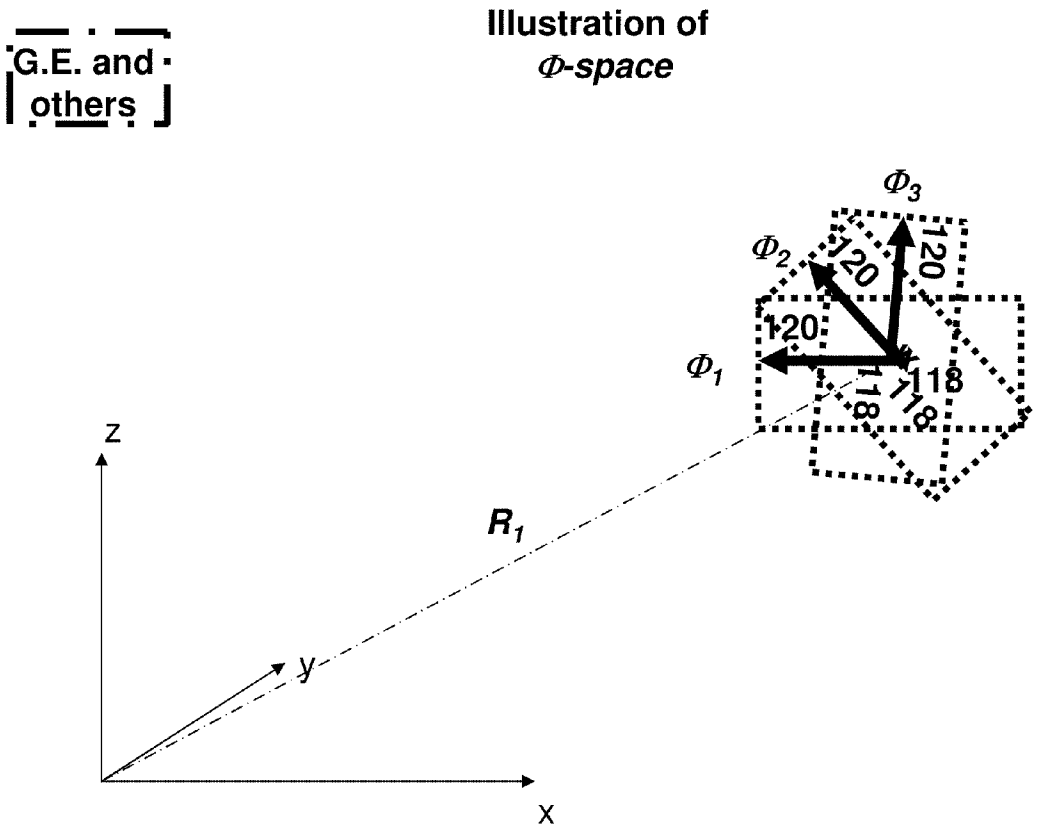
Figure 20D:
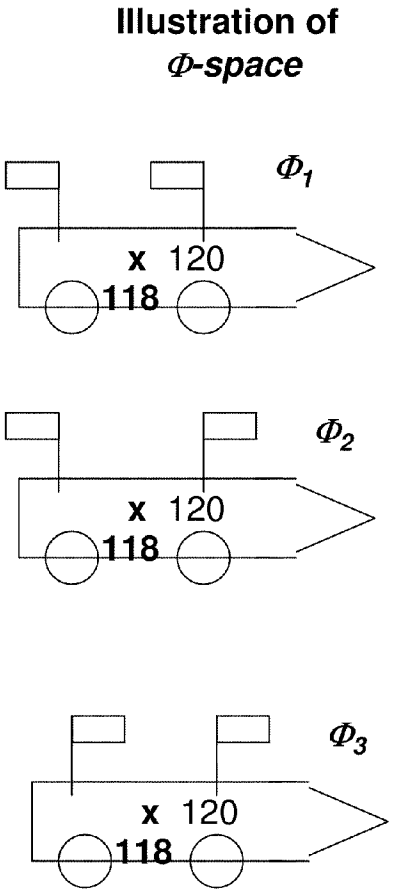

FIGS. 20A-20B illustrates R space. FIG. 20C illustrates configuration or orientation space (Φ-space) In FIGS. 20A-B, the location of SPMV 120 in R space is designated by 'locator point 118' (for example, some sort of centroid of SPMV 120—the locator point in FIG. 20B differs from the locator point in FIG. 20A). In FIG. 20C, SPMV 120 as a whole (which in general is not radially symmetric) is oriented in different orientations—3 orientations $\Phi_1$, $\Phi_2$ and $\Phi_3$ are illustrated in FIG. 20C. In FIG. 20D, a component (e.g. a flag or any other portion or component of SPMV 120) may have different orientations.

(R,Φ) space is the Cartesian product of R space and Φ-space.

Figure 21A:
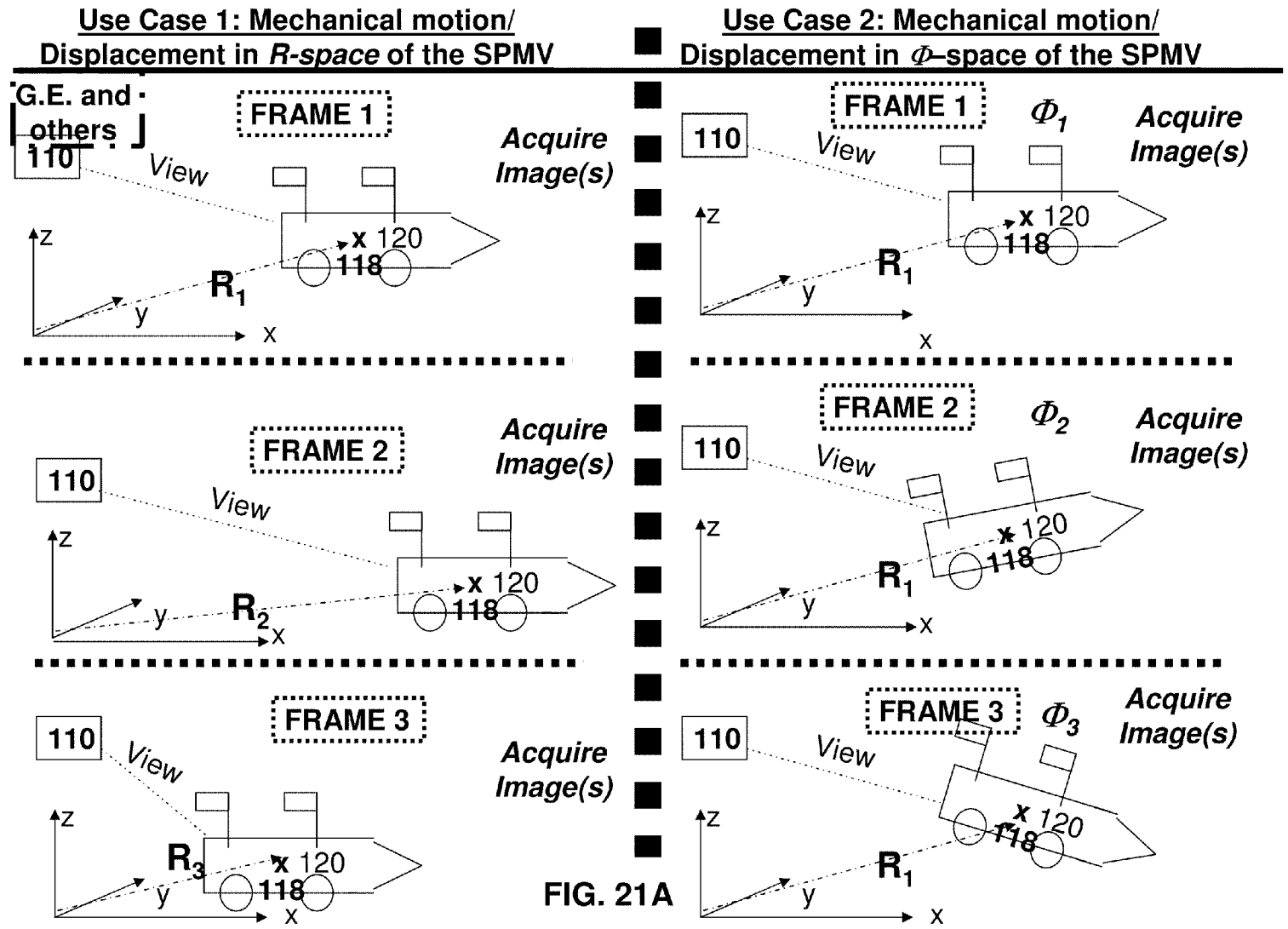
Figure 21B:
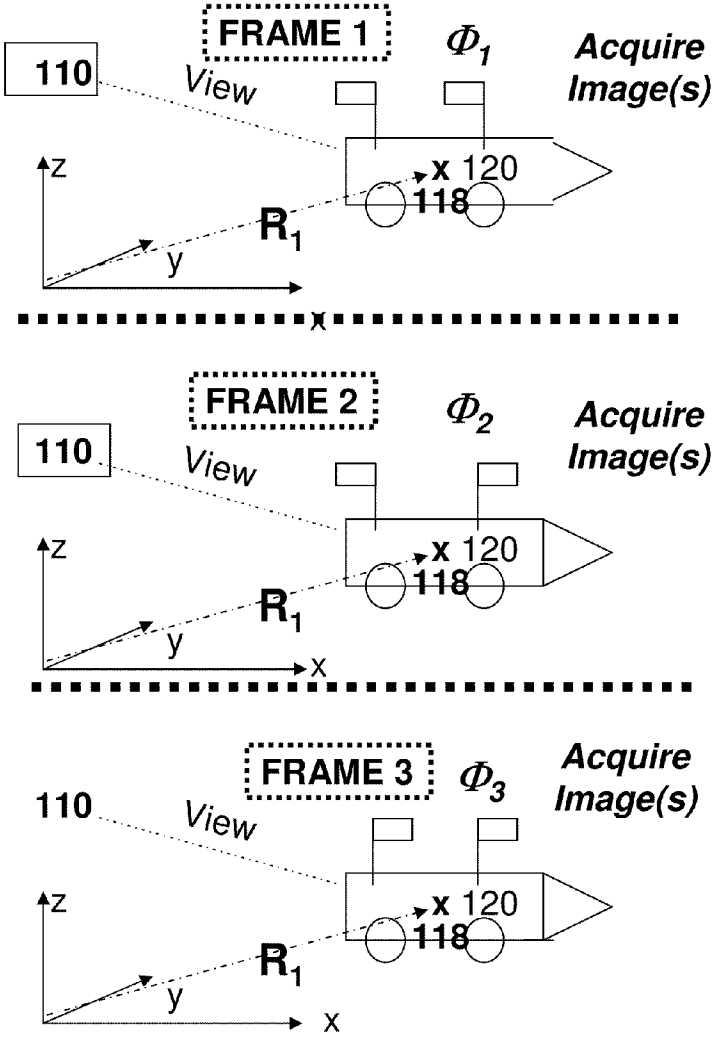
Figure 21C:
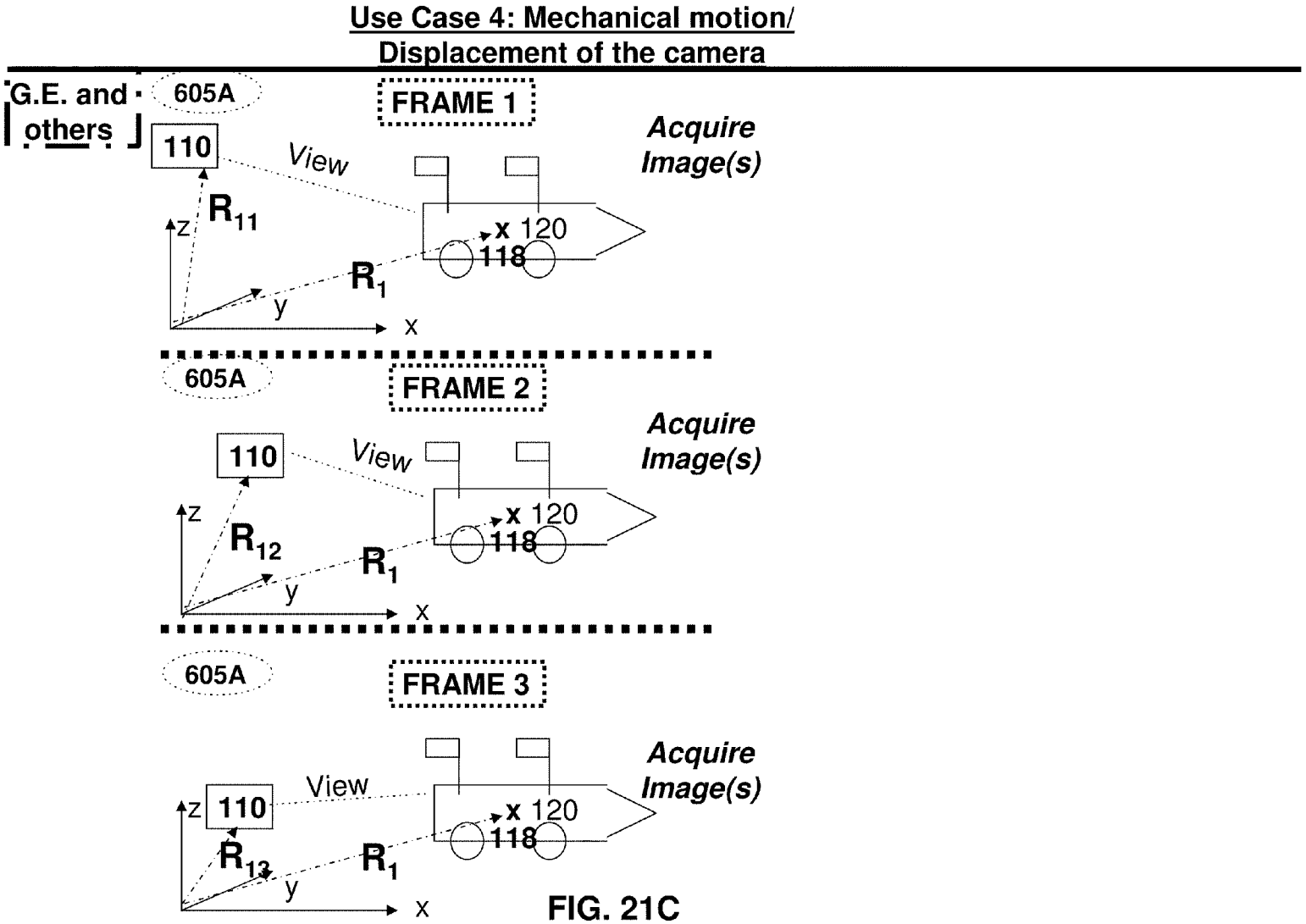

Motion in (R,Φ) space (see step S1223 of FIG. 19) is illustrated in FIG. 21. Thus, FIG. 21A relates to the case of R-space motion of the SPMV. FIGS. 21B-21C relate to the case of Φ-space motion of the SPMV. FIG. 21C relates to the case of camera motion (and does not require mechanical motion of SPMV 120)—in some embodiments, the camera motion may be provided using servo assembly 112 on which a camera 110 is mounted.

Any combinations of the motions modes may be provided (for example, in step S1223).

A Discussion of Servo(s) Assemblies 112

In step S1015', it is discussed that it is possible to generate servo calibration data and to utilize this calibration data when determining a Euclidian location of SPMV.

In the present sections, servo assemblies 112 are discussed for the particular non-limiting case where there are two cameras 110 each camera being mounted on a respective servo assembly. In other embodiments, there may only be a single camera mounted on a single servo assembly. In other embodiments (not shown), in order to save manufacturing costs, it is possible to provide multiple cameras on a single servo assembly.

Thus, as is illustrated in FIGS. 1, 3, in some embodiments camera 110 may be mounted on a pan-and-title system 108 (i.e. a servo) as a camera assembly 92. Mounting the camera 110 onto a servo may obviate the need to use a 'more expensive' wider-view camera and may also be useful for calibrating camera 110 according to images of SPMV 120 (the discussion above).

Figure 22A:
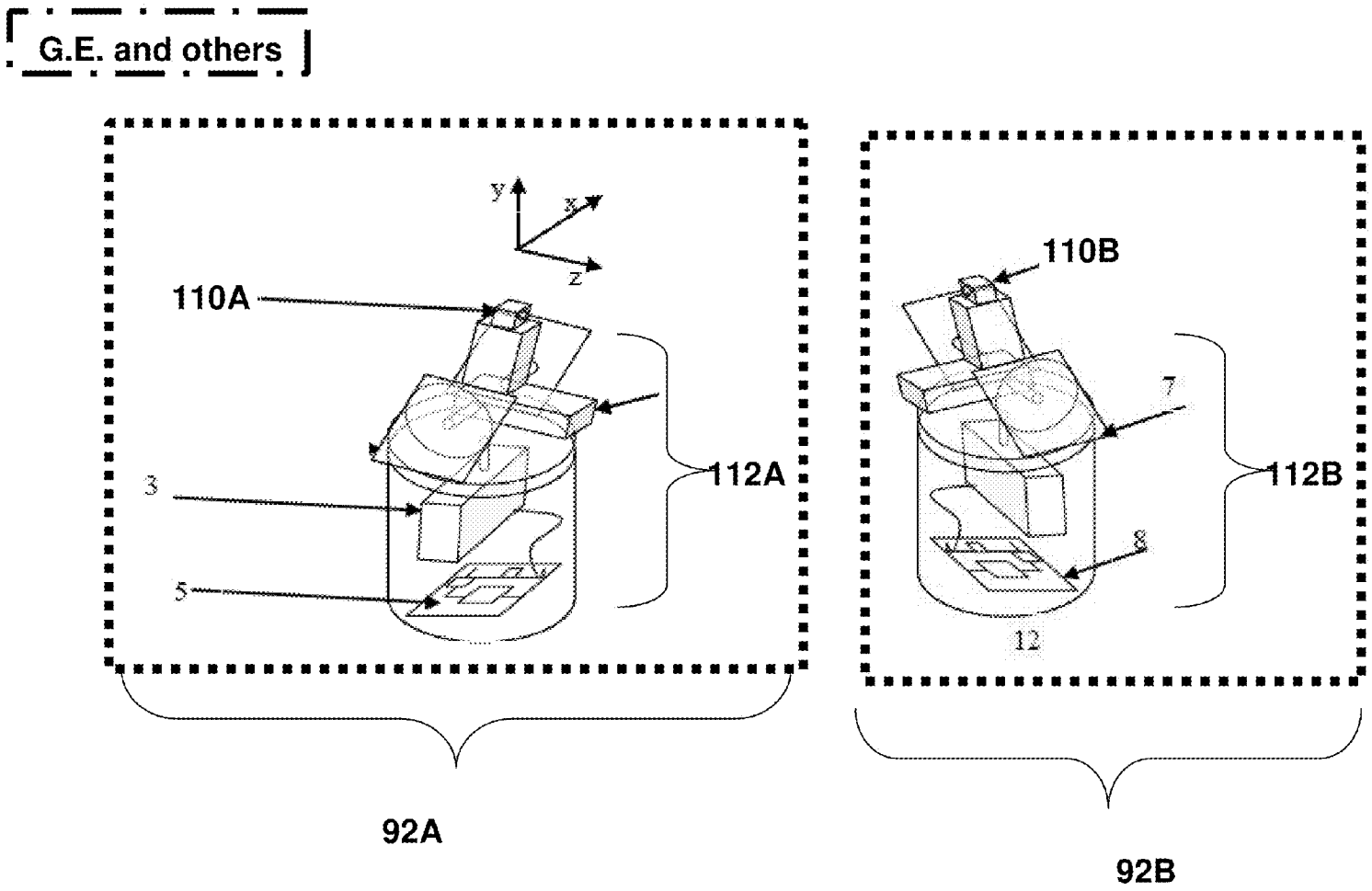
FIG. 22A is an illustration of a servo assembly.

FIG. 22A illustrates two camera assemblies 92A, 92B including two cameras 110A, 110B and respectively mounted on respective servo assemblies 112A, 112B. A first camera 110A is mounted on a first pan-and-tilt system (or 'servo assembly') 112A which includes two servo motors. A first servo motor 3 rotates the tilt system 4 about the y axis as shown in the coordinate axis shown in the diagram. A second servo 4 motor drives the tilt system which rotates the camera 1 about the x axis. The system (i.e. combination of servo assembly 112 and camera 110) can thus view a large area of the room—for example, when it is placed in roughly corresponding to the hemi-sphere forwards of the z axis.

In one implementation, both the camera 110 and the pan-and-tilt system (referred to throughout the present disclosure as a 'servo assembly') 112 are controlled and powered by a first camera control unit (CCU) 5 (e.g. corresponding to camera electronics assembly 80) to which the camera and servo are attached by direct wiring. The CCU 5 (or camera electronics assembly 80) is an example of electronic control circuitry 130 and may be implemented in any combination of hardware, software and firmware. In the exemplary embodiment the CCU 5 may include some basic computational capability in the form of microcontrollers and memory. In some embodiments, CCU 5 is capable of providing the signals required to direct the servo motors 3 and 4 of servo assembly 112 and the camera 110.

In some embodiments, CCU 5 may include volatile and/or non-volatile memory for storing an image acquired by camera 110. For example, the CCU 5 may receive the camera image, process it to some extent and capable of storing the processed or unprocessed image (in and before communicating data of the image (i.e. either wireless communication as shown in FIGS. 1, 3 or wired communication) to other computing devices (for example, computer unit 108 or any SPMV 120). Thus, the first camera assembly 92A may includes the first camera 110A, the first pan and tilt system 112A and the first CCU 5.

A second camera assembly 92B may include camera 110B placed on a second pan-and-tilt system 112B (or 'servo assembly') which operates in the same manner as the as the first pan-and-tilt system 112A. Both the camera 110B and the pan-and-tilt system 112 may be controlled and powered by a second CCU 8. Thus, the second camera assembly 92B may include the second camera 110A, the second pan and tilt system 112B and the second CCU 8.

In one non-limiting embodiment the two CCUs 5 and 8 may be each connected by a data cable (for example a USB cable each) to a computer unit 108. However, in other embodiments the cable may be replaced by a wireless connection with similar capabilities. In yet other embodiments the computer may be replaced be a mobile computing device, a dedicated interface unit, a router connected to a remote computer or network or any similar alternative. Any such controlling processing unit will be referred to without precision as: the controlling computer. In any case the cable or wireless interface is used to transmit images from the camera to the controlling computer and is also used for the controlling computer to transmit instructions to the CCU.

Figure 22B:
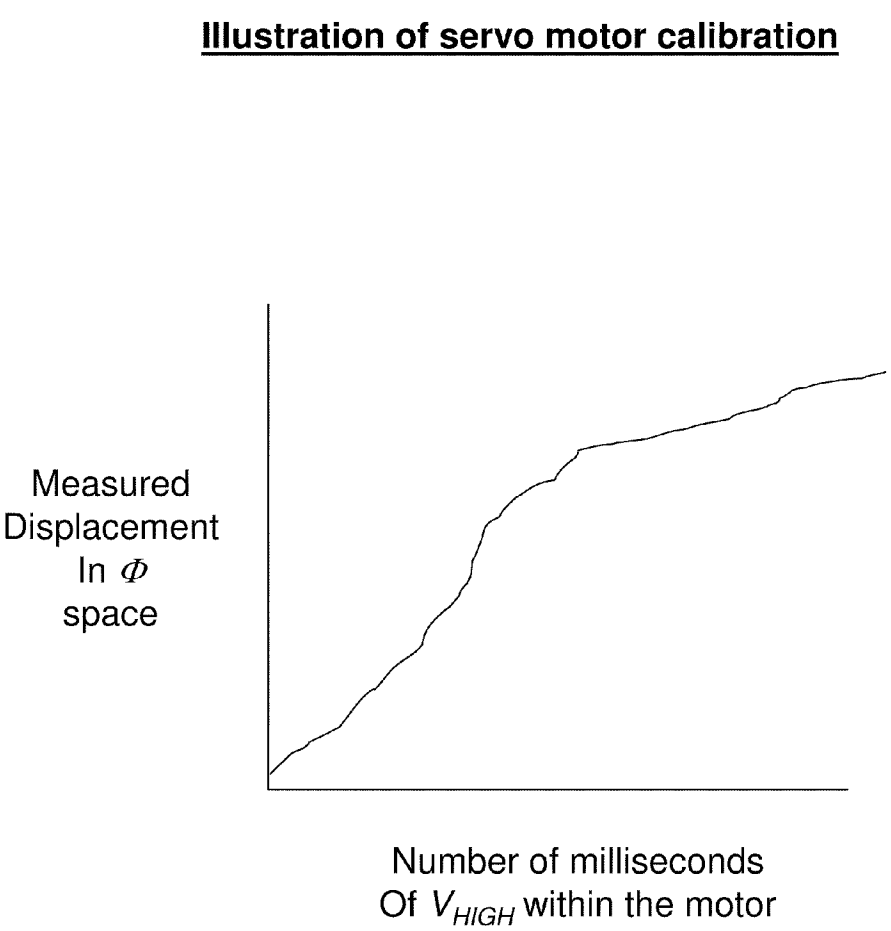
FIG. 22B illustrates a servo motor calibration curve.

A Discussion of Servo Motor Calibration Data with Reference to FIG. 22B

In some embodiments, any component of servo assembly 112 may be relatively inexpensive and/or not completely reliable. As such, it is possible that when an image is acquired, that the location of SPMV 120 in (R,Φ) space relative to camera 110 is not known or known with uncertainty.

For example, if the location is known at a certain point in time, but then camera is moved (for example, tilted) by an unknown (or known with relatively low certainty) angle, then at the later time the relative location or orientation of SPMV 120 relative to camera 110 may be uncertain. Towards this end, it may be useful to have 'servo calibration data.' Servo calibration data describes the relationship between: (i) an input to motor(s) of servo assembly 112 (for example, a voltage or during that a voltage is applied or any other input)—this is the 'x' axis of FIG. 22B and (ii) a rotational displacement of servo assembly 112 in response to the power input to the motor(s)—this is the 'y' axis of FIG. 22B.

If (i) before servo movement the position of camera 110 is known; and (ii) the amount of camera displacement (e.g.

angular displacement) associated with a given amount of power is known (e.g. from the graph of FIG. 22B), then it is possible to determine (e.g. with a 'lower' amount of uncertainty) the Euclidian location of SPMV 120 relative to camera 110 using knowledge of the camera's previous location before re-orientation of servo assembly 112.

It is noted that the Euclidian location of SPMV is always determined relative to the camera 110 (this may also be determined in an absolute level if the location of the camera 110 is known). Thus, knowledge about the 'Euclidian location' of SPMV (for example, in FIG. 18B—for example, in accordance with determined pixel locations of lights that are deployed with known geometry) gained by (i) effecting illumination transitions, (ii) acquiring PRE and POST images; and (iii) comparing the PRE and POST images to learn about pixel location and hence Euclidian location of light(s), may be useful for also helping to determine information the location of camera 110 (and hence information about a previous camera displacement caused by servo motors). For example, it is possible to leave SPMV 120 stationary and to move camera 110 using servo assembly 112.

Thus, the combination of (i) knowing about 'power parameters' for 'input power' to motor(s) of servo assembly 112; and (ii) knowing about how much camera 110 has moved relative to SPMV 112 since camera 110 was at a previous known position (i.e. from knowledge of the Euclidian location of SPMV 112 relative to camera 110 which is determined from pixel locations of lights) can be useful for computing servo motor calibration data in step S1015'. Since it is possible to obtain information about the 'current location' of SPMV 120 in (R,PHI) space from knowledge of the Euclidian location of lights 124 (i.e. based on pixel locations of lights), comparing images in accordance with an illumination transitions may be useful for (i) determining camera 110 has moved or re-oriented since servo motor(s) were subjected to known power parameters (e.g. input voltages); and (ii) thus, determining information related to the servo calibration curve (see FIG. 22B).

At a later time, it is possible that camera 110 has moved again (i.e. since the most recent calibration). In this case, it may be useful to use the servo calibration information (e.g. as in FIG. 22B) to determine how much the camera 110 has moved, in order to determine, in step S1021, the Euclidian location of SPMV 120 relative to camera 110. As is discussed above (e.g. with reference to FIG. 15), knowledge of the Euclidian location of SPMV 120 relative to camera 110 can be useful for operating (e.g. controlling motion of) SPMV 120.

Figure 23:
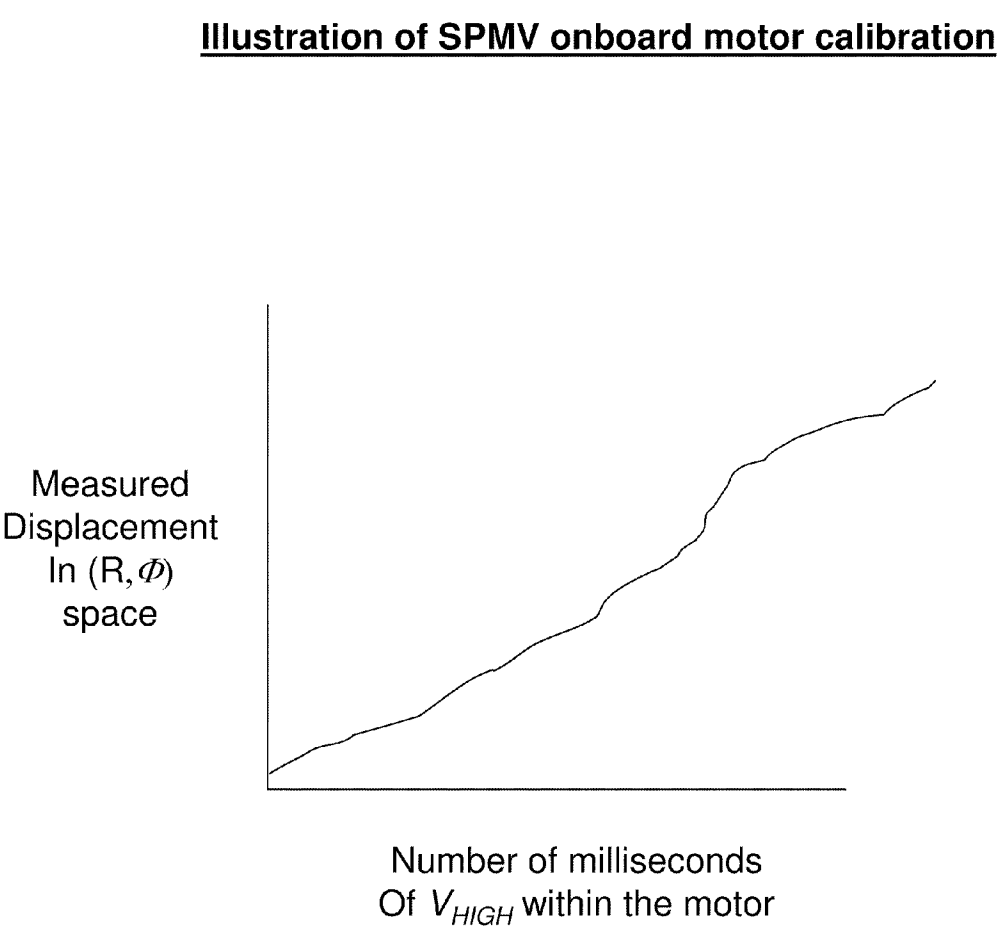
FIG. 23 illustrates an SPMV motor calibration curve.

A Discussion of SPMV Onboard Motor Calculation with Reference to FIG. 23

Similar reasoning may be used for the onboard motor(s) of SPMV 120.

Thus, embodiments of the present invention relate to techniques for (i) determining the relative Euclidian location in (R,Φ) space of SPMV 120 relative to camera 110 and (ii) operating SPMV 120 according to this knowledge of the Euclidian location in (R,Φ) space.

In some embodiments, when power is delivered to SPMV 120 onboard motors, it is not certain how far SPMV 120 moves—this is especially true if SPMV 120 includes inexpensive or not completely reliable components. In another example, the friction parameters between SPMV 120 and the floor may not be known, or may vary depending on the surface of the flooring (e.g. carpet may be different from wood flooring). Since it is desired to be able to determine the relative Euclidian location in (R,Φ) space, it is desired to know, after a known amount of voltage (or any other power parameter) is delivered to SPMV 120 onboard motors, how much the SPMV (or a portion thereof) has moved or re-oriented in response to the delivery of power to SPMV onboard motors.

This relationship is illustrated in FIG. 23.

If (i) before SPMV movement the position of SPMV 120 relative to camera 110 is known; and (ii) the amount of SPMV displacement (e.g. translational or angular displacement) associated with a given amount of power is known (e.g. from the graph of FIG. 22B), then it is possible to determine (e.g. with a 'lower' amount of uncertainty) the Euclidian location of SPMV 120 relative to camera 110 even after the SPMV moves using knowledge of its previous location before SPMV motion.

It is noted that the Euclidian location of SPMV is always determined relative to the camera 110 (this may also be determined in an absolute level if the location of the camera 110 is known). Thus, knowledge about the 'Euclidian location' of SPMV (for example, in FIG. 18B—for example, in accordance with determined pixel locations of lights that are deployed with known geometry) gained by (i) effecting illumination transitions, (ii) acquiring PRE and POST images; and (iii) comparing the PRE and POST images to learn about pixel location and also Euclidian location, may be useful for also helping to determine information of SPMV 120 relative to the camera, and hence information about how far SPMV 120 has traveled since its position was last known and since SPMV onboard motors have operated.

Thus, the combination of (i) knowing about 'power parameters' for 'input power' to onboard motor(s) of SPMV 120 and (ii) knowing about how far SPMV 120 has moved or reoriented since SPMV 120 was in a previous known position in (R,Φ) space relative to camera 110 can be useful for computing onboard SPMV motor calibration data in step S1015'. Since it is possible to obtain information about the 'current location' of SPMV 120 from knowledge of the Euclidian location of lights 124 (i.e. based on pixel locations of lights), comparing images in accordance with an illumination transitions may be useful for (i) determining how far an SPMV 120 has traveled since being subjected to known power parameters (e.g. input voltages); and (ii) thus, determining information related to the SPMV onboard motor calibration curve (see FIG. 23).

At a later time, it is possible that SPMV 120 has moved again (i.e. since the most recent calibration). In this case, it may be useful to use the SPMV onboard motor calibration information (e.g. as in FIG. 23) to determine how much the SPMV 120 has moved, in order to determine, in step S1021, the Euclidian location of SPMV 120 relative to camera 110. As is discussed above (e.g. with reference to FIG. 15), knowledge of the Euclidian location of SPMV 120 relative to camera 110 can be useful for operating (e.g. controlling motion of) SPMV 120.

Figure 24A:
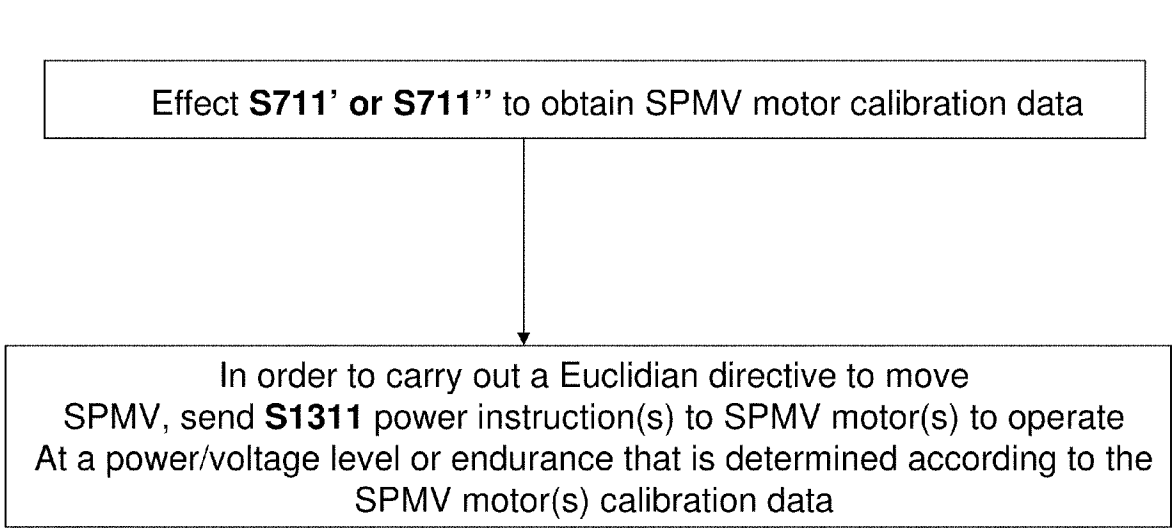
FIGS. 24A-24B are routines of using motor calibration data.
Figure 24B:
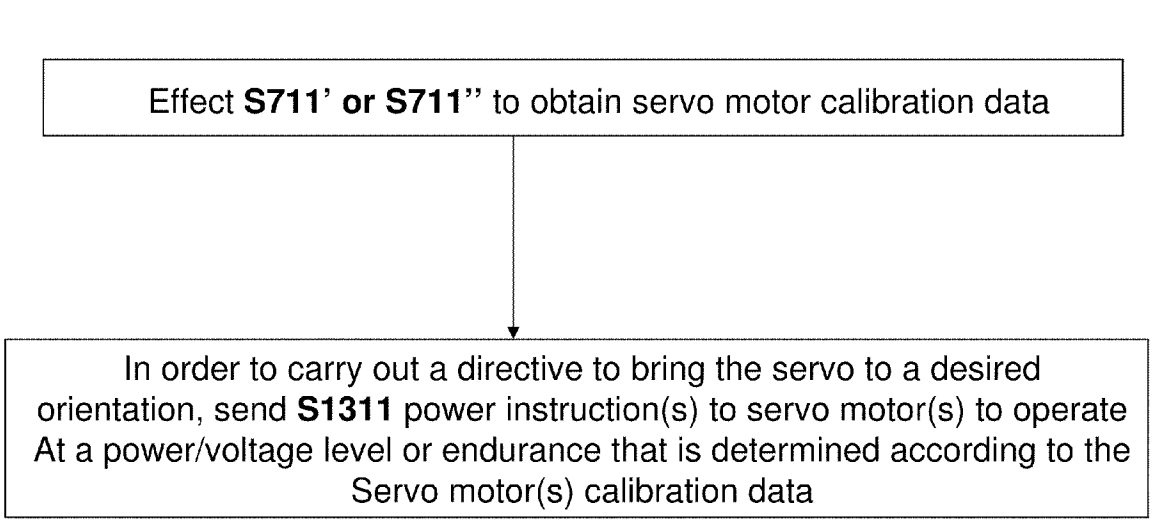

A Discussion of FIGS. 24A-24B

As noted above, knowledge of the servo motor and/or onboard SPMV motor calibration curve (see FIGS. 22B-23) may be useful for determining, at any given time, the relative Euclidian location in (R,Φ) space of SPMV 120 relative to camera 110. As noted above, this may be useful for operating SPMV 120 (see, for example, the discussions with reference to FIG. 15).

FIGS. 24A-24B relate to additional routines for utilizing motor calibration data.

In FIG. 20A, once the motor calibration data is known, if is desired to move SPMV 120 a specified distance, it is possible to utilize the data of the SPMV onboard motor calibration curve (see, for example, FIG. 23) in order to determine a power parameter for delivering power to SPMV onboard motor(s).

Similarly, in FIG. 20A once the servo motor calibration data is known, if is desired to reorient camera 110 by a specified angle, it is possible to utilize the data of the servo motor calibration curve (see, for example, FIG. 22B) in order to determine a power parameter for delivering power to SPMV onboard motor(s).

A Discussion of Operating Robots in an Outdoors Environment and/or an Environment with a Relatively Large Ambient Light Level In some embodiments, when there is a relatively 'high' level of ambient light, one or more onboard lights 124 may be difficult to detect from images acquired by camera 110. In this case, (or in other cases), it may be desirable to replace any onboard lights with onboard mechanical shutters.

For example, it is possible to have a black mechanical shutter (on SPMV housing which conceals a white surface. The local surface of SPMV 120 housing in the vicinity of the black mechanical shutter is also black. Thus, when the shutter is closed, the entire surface (i.e. including the shutter itself and the surrounding region) appears black—conceptually, this may be regarded as similar to a 'light off' illumination status. When the shutter is open, the surround region remains black but the viewed surface of SPMV 120 housing at the location of the shutter is white.

Figure 25A:
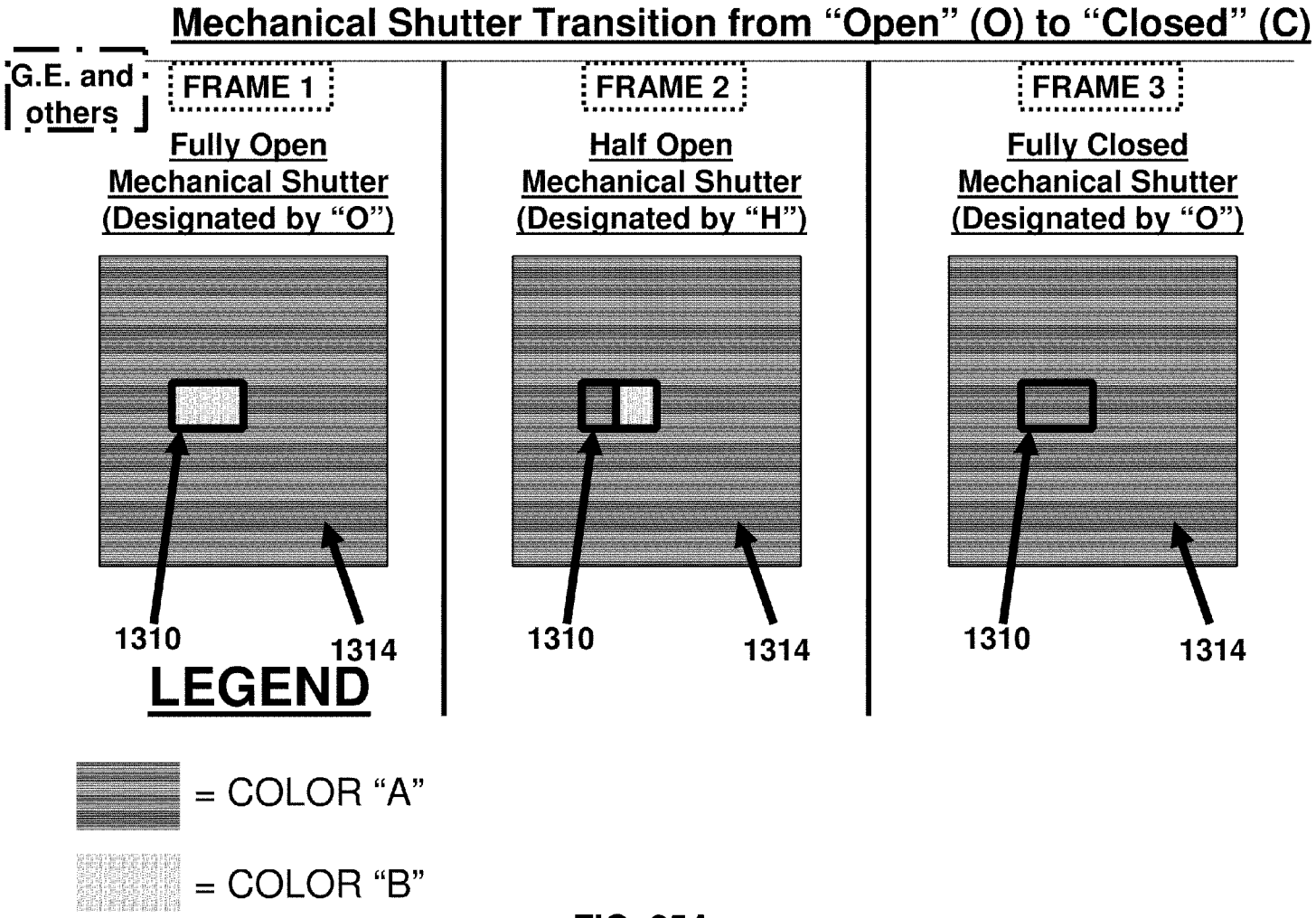
FIGS. 25A-26 relate to mechanical shutter transitions.

FIG. 25A illustrates the time development of a shutter 1310 as it transitions (i.e. a shutter transition) from open to closed. In FIGS. 25-26, the 'shutterable region' is referred to with number 1310 and the surrounding region is referred to with number 1314—when the shutter is open the status of the shutterable region is "O" status, when the shutter is closed, the status of the shutterable region is "C" status, and when the shutter is half closed the status of the shutterable region is "H" status.

In FIG. 25A, both the color of the shutter itself as well as the color of the surrounding surface 1314 of SPMV 120 housing is 'color B' (in some non-limiting examples, a 'dark' color such as black). The color of the 'sometimes concealed' surface (i.e. within shutterable region 1310) which is sometimes concealed by the shutter and sometimes revealed (i.e. when the shutter is open an in "0" status) is 'color A.' (in some non-limiting examples, a 'light' color such as white).

Figure 25B:
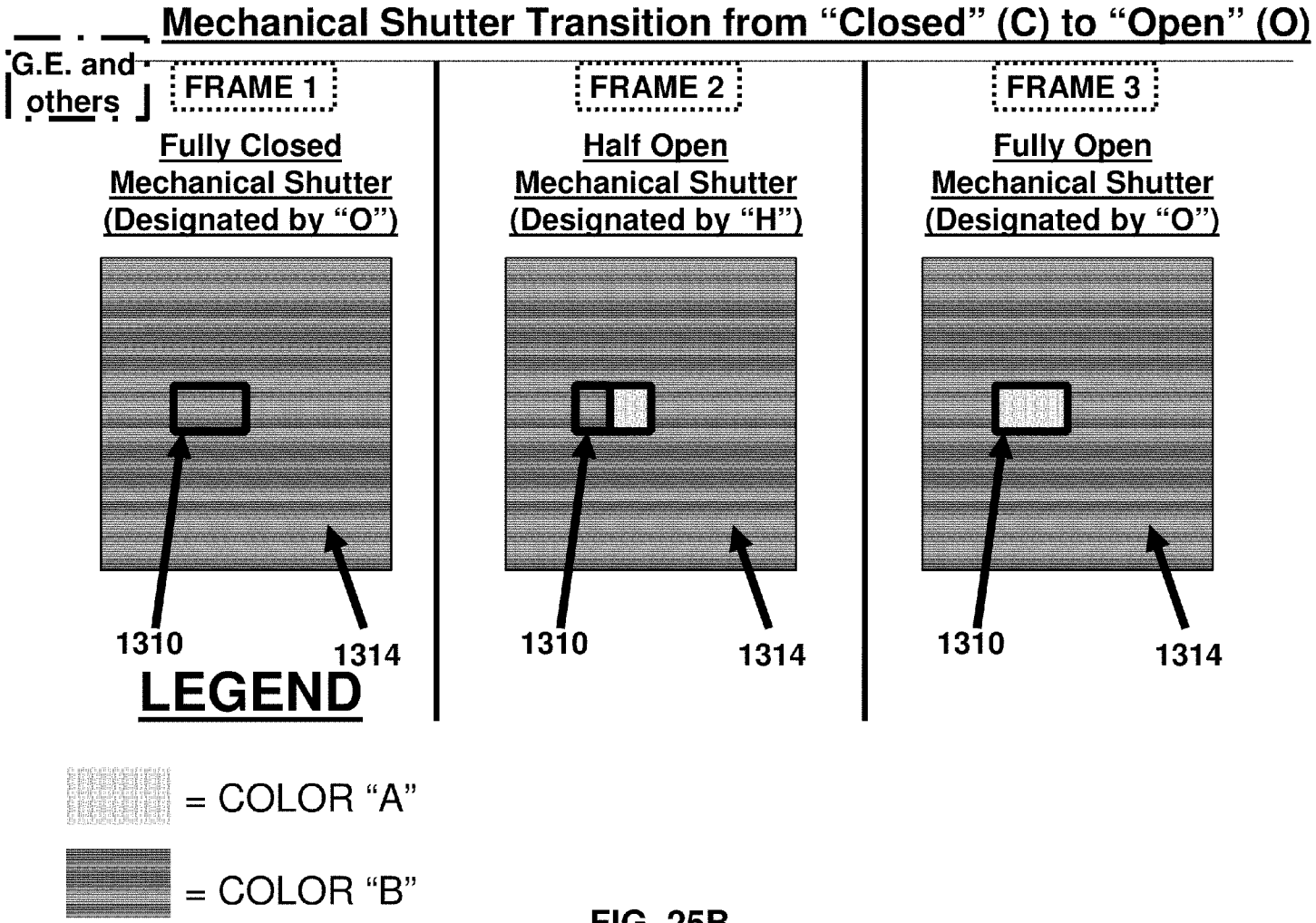
Figure 26:
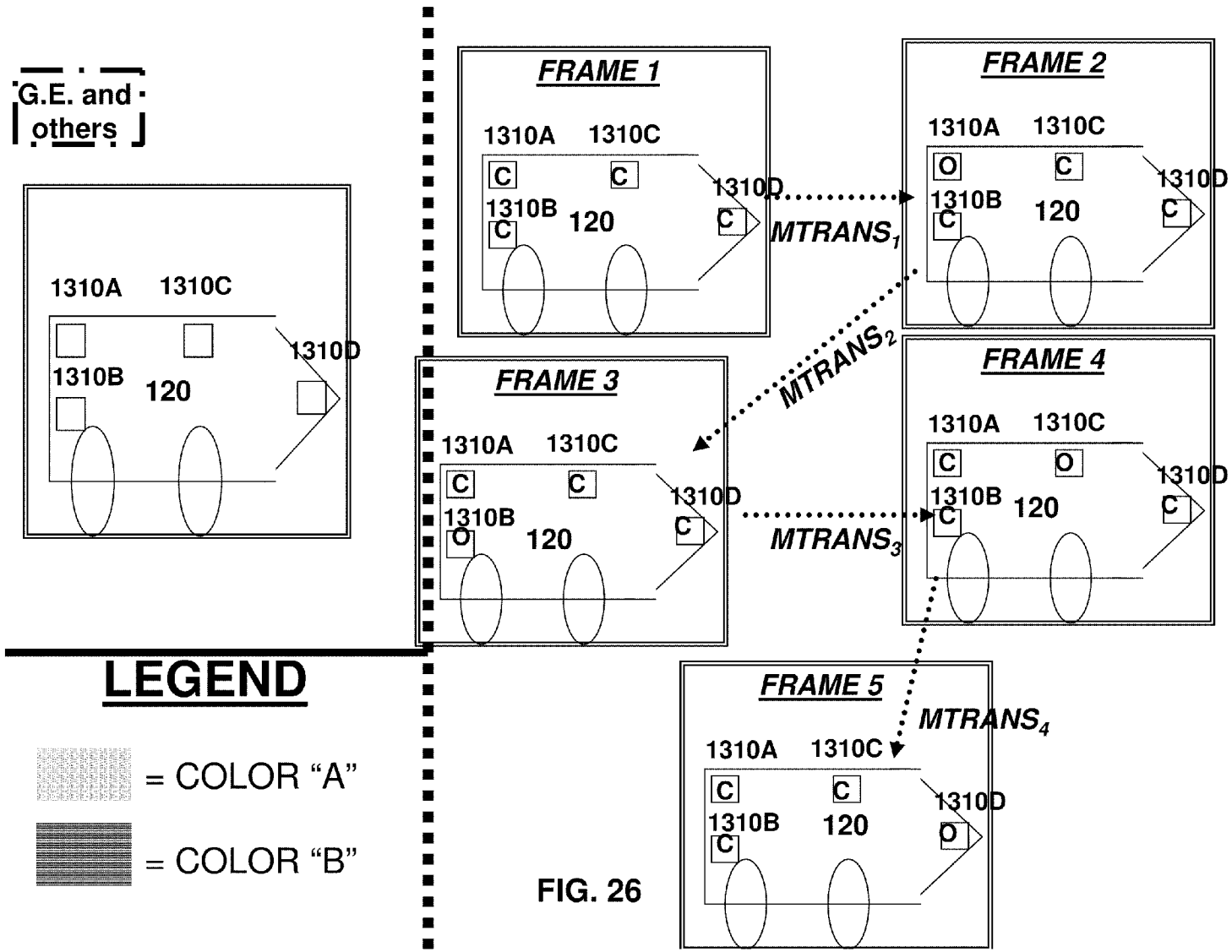

FIG. 25B is the time development of a shutter as it transitions from "Closed" to "open."

As is shown in FIG. 26, it possible to deploy multiple shutter assemblies 1301 at different locations (for example, with known geometry and known distances and angles between them—for example, in a non-coplanar configuration) on SPMV 120 housing.

FIG. 26 illustrates multiple shutter regions which may be in "0" configuration or "H" configuration or "C" configuration. The mechanical shutter transitions (i.e. shutting or opening of shutters) are designated by MTRANS. Thus, MTRANS1 refers to the opening of the shutter of 1310A—i.e. the region which in FRAME 1 appeared dark now may appear light. This may be considered equivalent to the "turning on" of a light. Close study of FIG. 26 in comparison to FIG. 11A indicates that they are analogous—i.e. MTRANS1 of FIG. 26 is analogous to TRANS1 of FIG. 11A, MTRANS2 of FIG. 26 is analogous to TRANS2 of FIG. 11A, and so on.

Thus, in some embodiments, it is possible to substitute for any onboard light 124 the combination of (i) specially colored shutter which may conceal a region of a different color as discussed with reference to FIGS. 25-26. It is possible thus, to effect routines of FIGS. 13, 16A-16B, 18A-18B, 19, 24A-24B using colored shutter regions 1310 instead of and/or in addition to onboard lights, and effecting 'shutter transitions' (for example, see FIGS. 25A-25B for examples of shutter transitions) instead of 'illumination transitions.'

In some embodiments, this may be preferred in an outdoor environment.

Figure 27A:
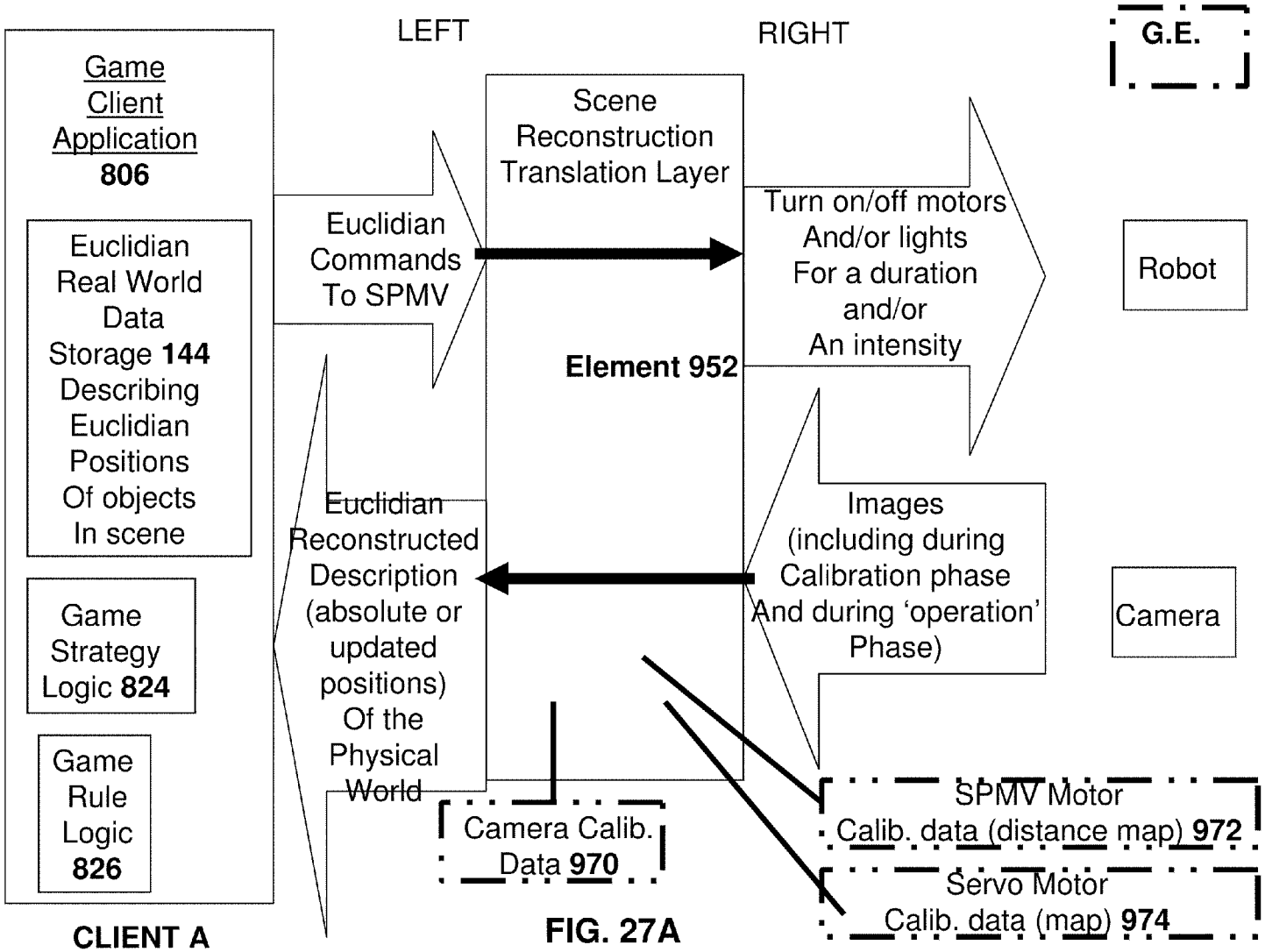
FIGS. 27A-27B are a block diagram of a scene reconstruction translation layer (for example, in software).
Figure 27B:
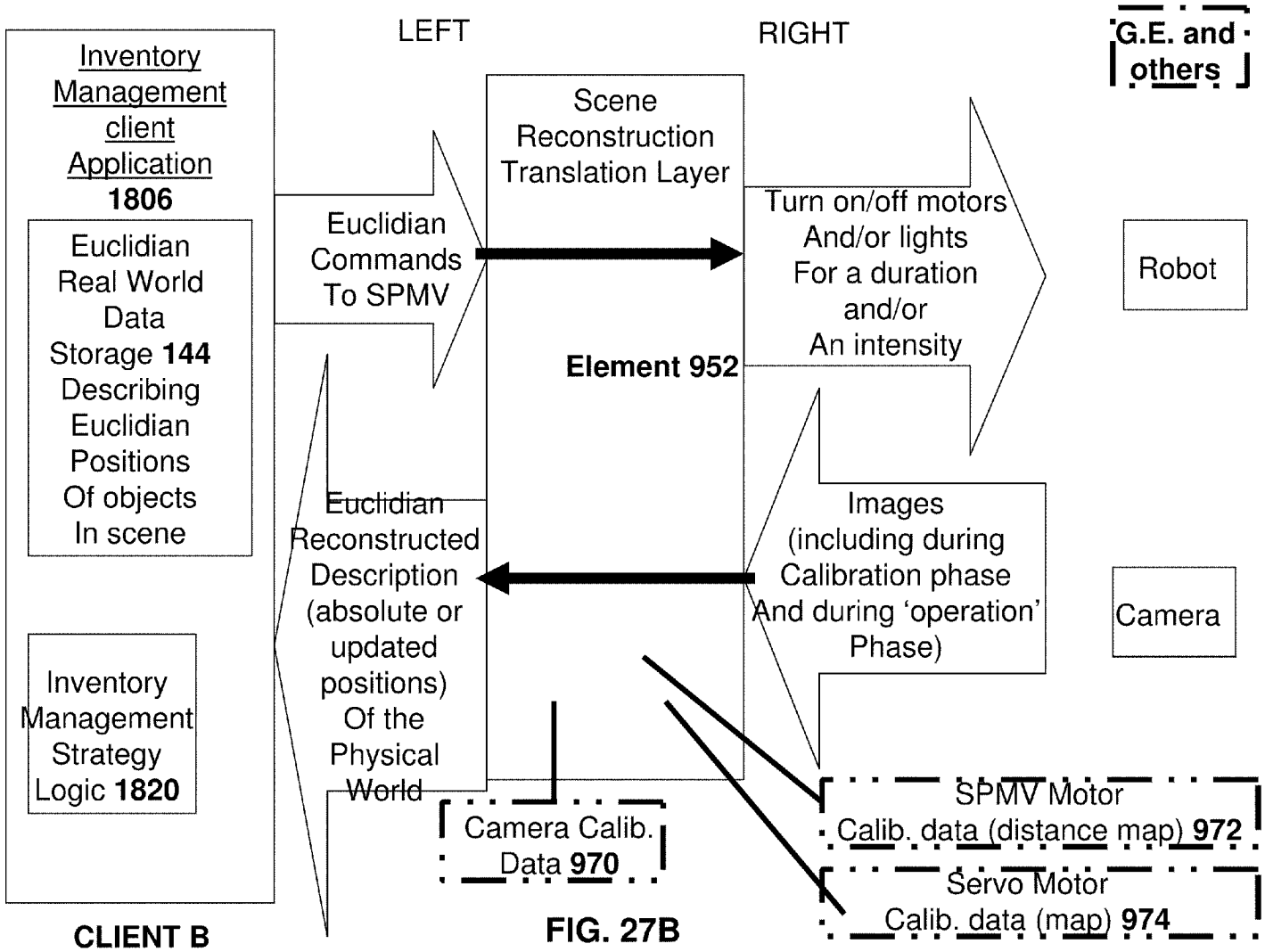

Discussion of FIGS. 27A-27B

Some embodiments of the present invention relate to a scene reconstruction translation layer 952 (for example, a software translation layer which resides in volatile or non-volatile memory and is executing by electronic circuitry such as a computer processor). The software translation layer 952 (i) receives Euclidian commands for operating an SPMV 120 from a client application (for example, a game client application 806 in FIG. 27A or an inventory management application 1806 in FIG. 27B) (for example, commands to move to a certain distance or to a certain location, to turn by a certain angle, etc); (ii) generates motor commands for robot/SPMV 120; (iii) repeatedly effects Euclidian scene reconstructions (for example, according to analysis of pixel locations of onboard lights or analysis of images according to mechanical shutter transitions or according to other techniques (i.e. without requiring lights or shutters) which facilitate determining a Euclidian location of any object of the scene; (iv) forwards this Euclidian description of the scene viewed by camera 110 to the client hardware or client application (e.g. 806 of FIG. 27A or 1806 of FIG. 27B).

Towards this end, scene reconstruction translation layer may employ camera and/or servo and/or motor calibration data to determine the Euclidian location of object(s) in the scene and/or to send commands to SPMV(s) 120 and/or servo assembly 112.

According to the architecture illustrated in FIGS. 27A-27B, the client device or application can issue 'abstract' Euclidian directives to move objects within a 'real-world' scene without having to handle issues related to scene reconstruction.

In FIG. 27A, a game client application 806 includes game strategy logic and game rule logic which operate according to the content of real world data storage 144 which is updated according to data received from scene reconstruction translation layer 952.

In FIG. 27B, the same scene reconstruction translation layer 952 may be reused to provide virtual world-real world interface functionality to an inventory management system which may management movement of inventory by robots (i.e. robots or SPMVs may move around inventory) according to a strategy logic (e.g. which may optimize robot usage according to various 'inventory objectives' such as minimize restocking time, minimal warehouse rent, minimizing SPMV power consumption, etc.

In some embodiment, scene reconstruction translation layer may be associated a software or hardware component which provides 'self-sufficiently' and automatically calibrates the camera and/or servo assembly and/or SPMV motor. This provides yet another way to "abstract away the real world" from client hardware or application (e.g. 806 or 1806).

Figure 28A:
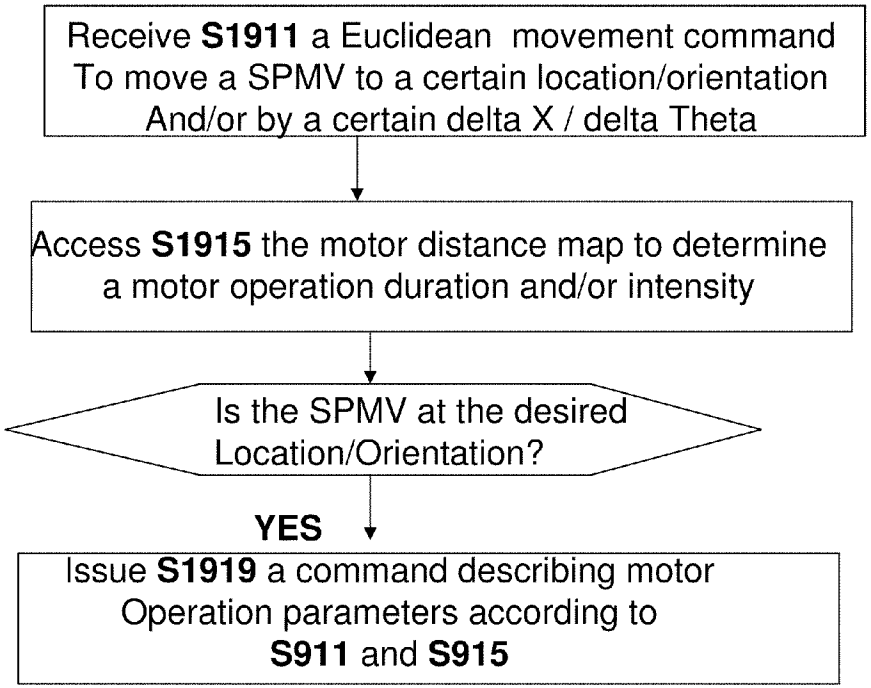
FIG. 28A-28B are flow charts of techniques carried out by a scene reconstruction translation layer.
Figure 28B:
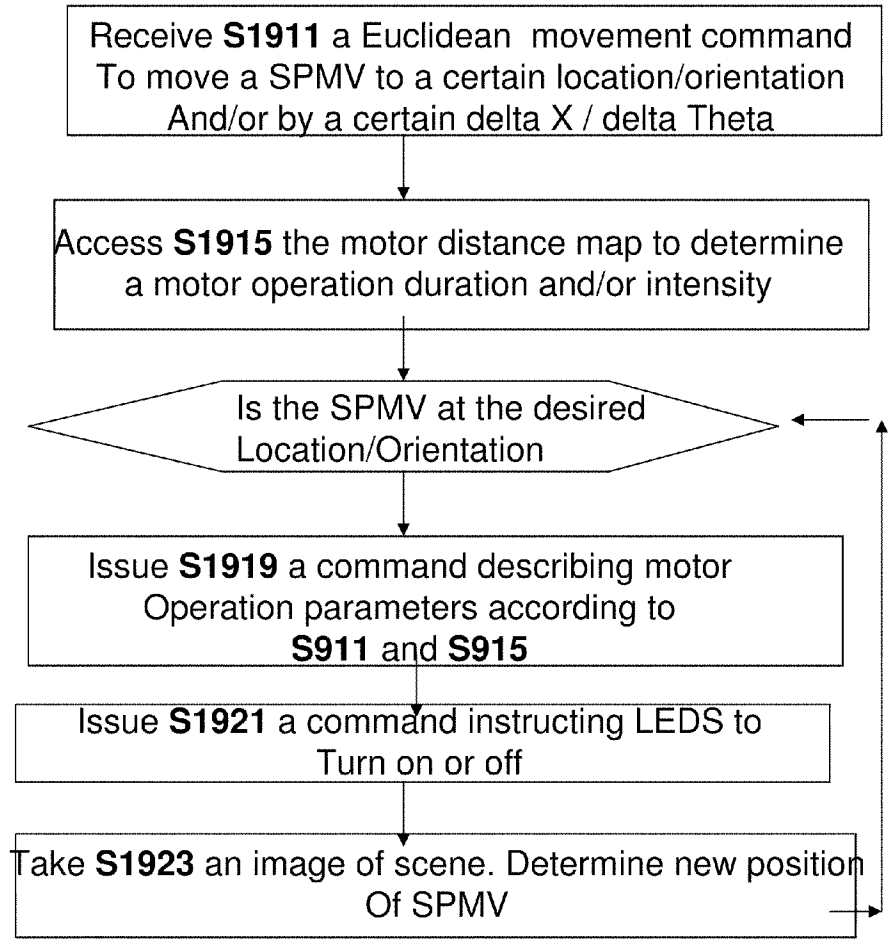

FIGS. 28A-28B illustrate some routines that may be carried out by translation layer 952. Thus, FIG. 28A includes steps S911, S915, and S919. FIG. 27B also includes steps S921 and S923.

A Discussion of FIG. 28

Figure 29:
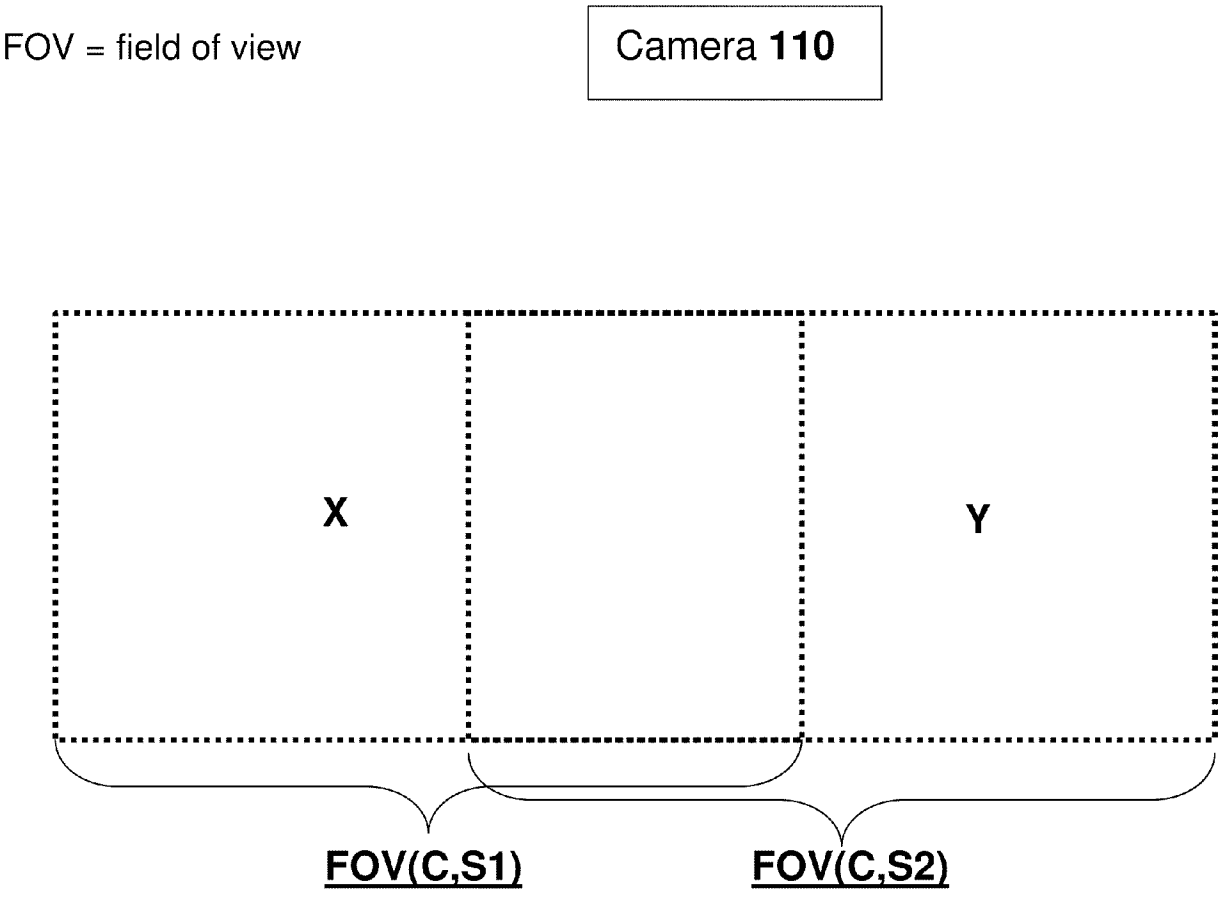
FIG. 29 illustrates two fields of view for a camera depending on the camera's orientation as provided by the servo assembly.

FIGS. 29-30 relate to routines for determining a movement angle describing angular movement of a camera due to servo assembly rotation. This may be useful for computing camera extrinsic calibration data (ie. from earlier more reliable camera calibration data describing the camera before it underwent a mechanical rotation.

Figure 30A:
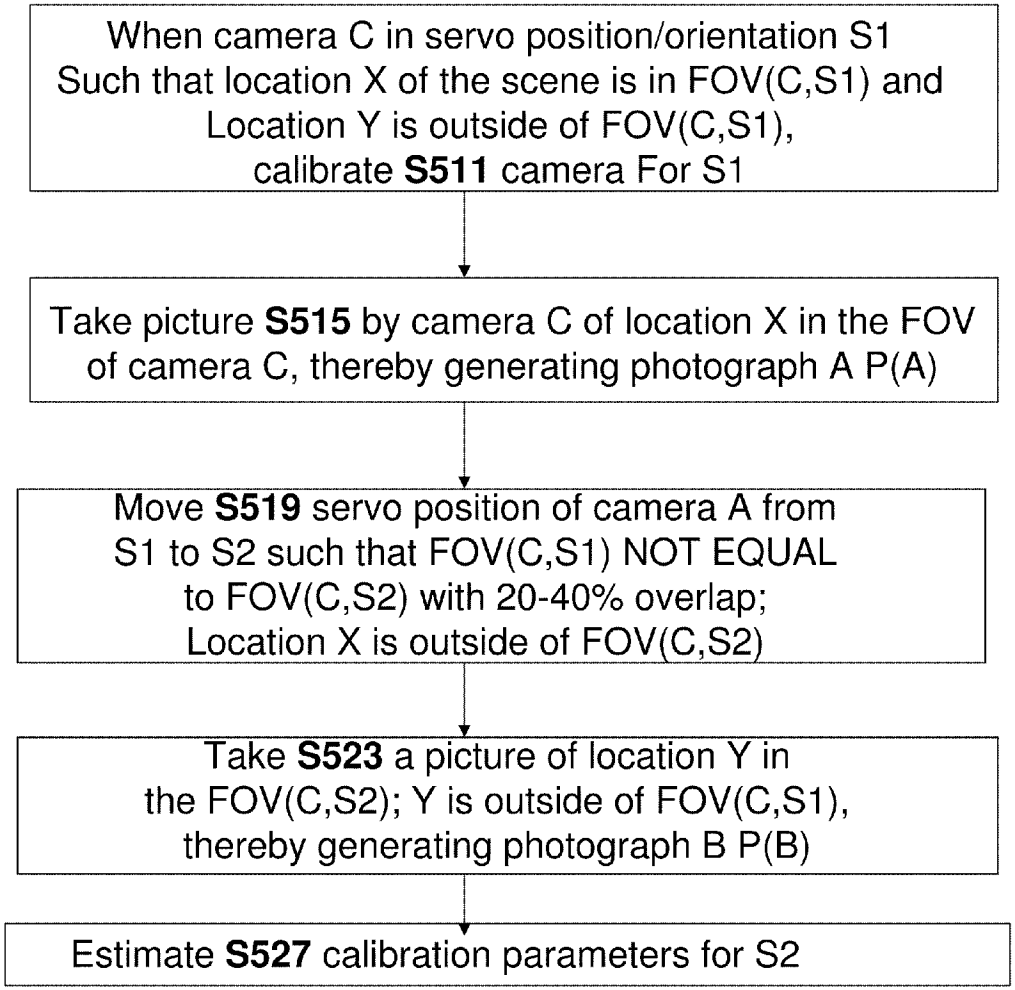
FIGS. 30A-30B relate to a routine for operating a servo assembly.
Figure 30B:
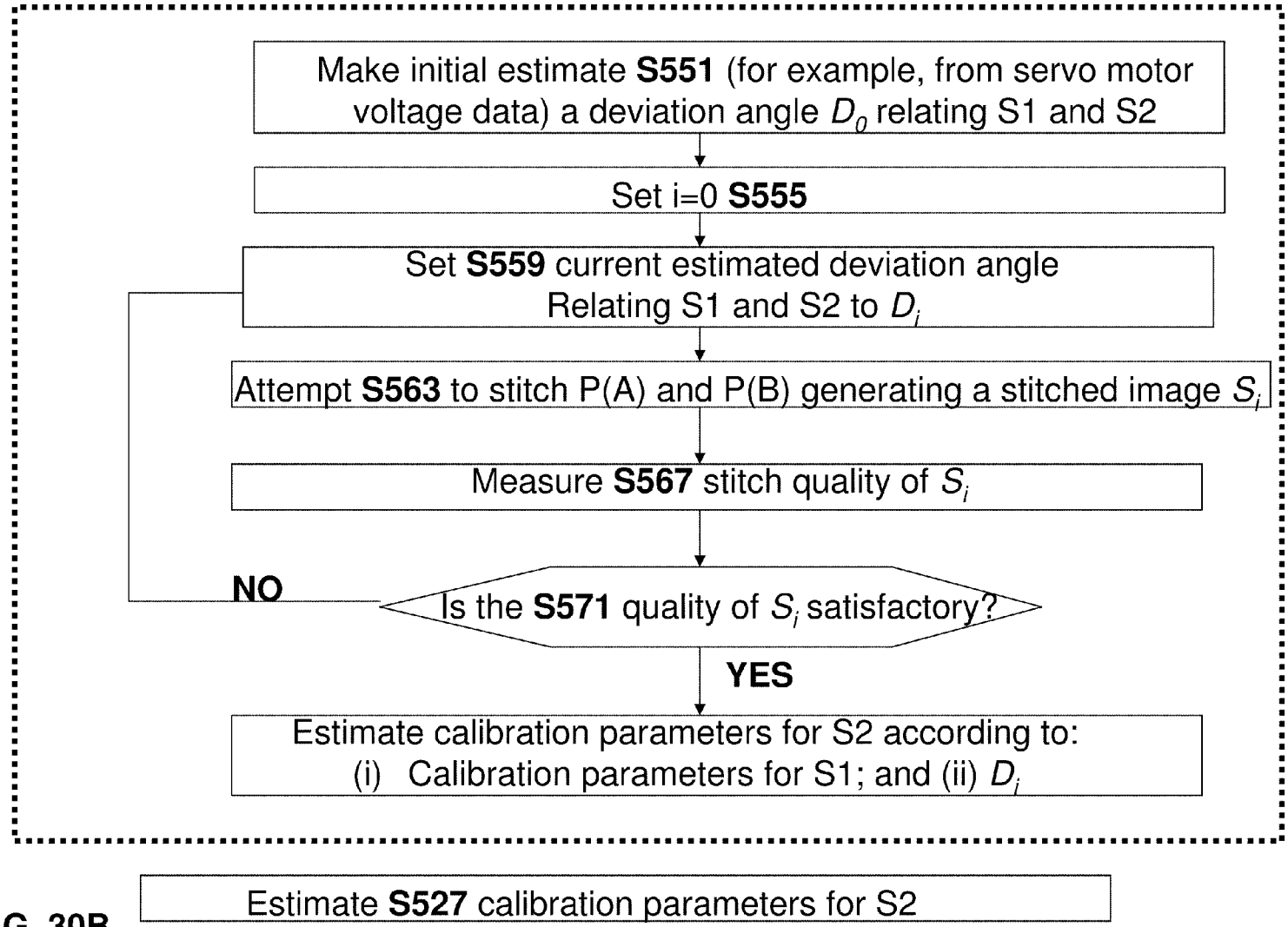

Thus, FIGS. 30A-30B include steps S511, S515, S519, S523, S527, S551, S555, S559, S563 and S561.

Details of a Specific Exemplary Embodiment

In some embodiments, two cameras 110A and 110B (or more) are provided as parts of two camera systems 92A, 92B. These two camera systems 92A and 92B (or more) may be placed on a roughly flat surface (see, for example, FIGS. 1 and 3) such that their viewing hemispheres include the SPMV 120 and the scene of interest. In one embodiment, they need not be placed with precision nor with any particular regard to the distance and relative position between them. Nevertheless, in some embodiments, the accuracy of the triangulation system to be described (i.e. for embodiments where a triangulation system is provided) may be reduced if camera systems 92A, 92B are placed less than a few centimeters apart. In other embodiments a designer may choose to fix the exact position between the camera systems. However, it is noted that, in many embodiments such careful placement is not required—in these embodiments, no trained technician is required to place camera systems 92A, 92B, making the system suitable for home use or use by hobbyists. It is important to note that no direct measurement of the placement of the two camera systems (92A and 92B) is required.

In some embodiments (for example, see FIGS. 1 and 3), SPMV 120 is placed in the scene of interest. The scene of interest might be the floor on which objects are placed which the SPMV is to interact with. These other objects of interest might be other, similar SPMVs, inanimate objects which the SPMV is required to grasp or move, components to be constructed, things to be cleaned or painted or any such like alternatives. The floor might be some other, roughly flat, working surface or such like.

In one use case (see FIGS. 2B, 3B) SPMV 120 is a wheeled vehicle with a number of LEDS placed around its body whose motors and LEDs are controlled by some processing capability built into the SPMV. This processing ability includes in one embodiment at least one microcontroller. The processing ability includes the ability to receive and transmit at least simple wireless signals. In one example, a Zigbee©-like protocol stack may be employed. In one embodiment, the CCU 5 contains a wireless module of the same protocol capable of communicating with the SPMV. In other embodiments the SPMV communicates directly with the controlling computer. In such cases the wireless protocol would be chosen accordingly.

In some embodiments the SPMV 120 is equipped with a typically articulated robotic arm 106 controlled by the processing capability of the SPMV 120 (for example, as provided by SPMV electronics assembly 84). In other embodiments there is no such robotic arm. In yet other embodiments there may be some other moving equipment on the SPMV 120, lasers, range finders, ultrasound devices, odometers other sensors, or alternative equipment. Nevertheless, there is no requirement to include such additional sensors, and some embodiments tech operation of SPMV 120 primarily according to analysis of images of the scene including SPMV 120.

In some embodiments, SPMV 120 is designed with a generic mechanical and electronic plug whose interface has been standardized and published such that third parties can design accessories for the SPMV 120.

Additional Discussion About System Calibration

Although not a requirement in some embodiments, electronic circuitry 130 may include a computer unit 108 as illustrated in FIG. 1. In some embodiments, software executing on the controlling computer 108 can (i) operate the camera servo motors (e.g. to re-orient a camera 110), and/or (ii) receive images taken by the cameras, and/or (iii) move the SPMV and/or (iv) turn LEDs on and off on the SPMV. It can time and coordinate these activities with timing precision.

As said, the setup of the system in terms of the placement of its components can be haphazard and does not require skilled or trained personnel. Once all components have been placed and plugged in or turned on, the system must now learn from its environment the exact position of its relative components and their intrinsic parameters. This is referred to as calibration of the system. Once calibration of the system has been completed, the 3D visual interface can be displayed and the SPMV guided and controlled with the precision required by the specific application.

In order to calibrate a camera, a calibration object may be employed. Some embodiments teach that the calibration object is the mobile SPMV 10 itself (for example, including onboard lights 124 or onboard mechanical shutters). This may obviate the need to introduce or manipulate a special calibration object.

Figure 2A:
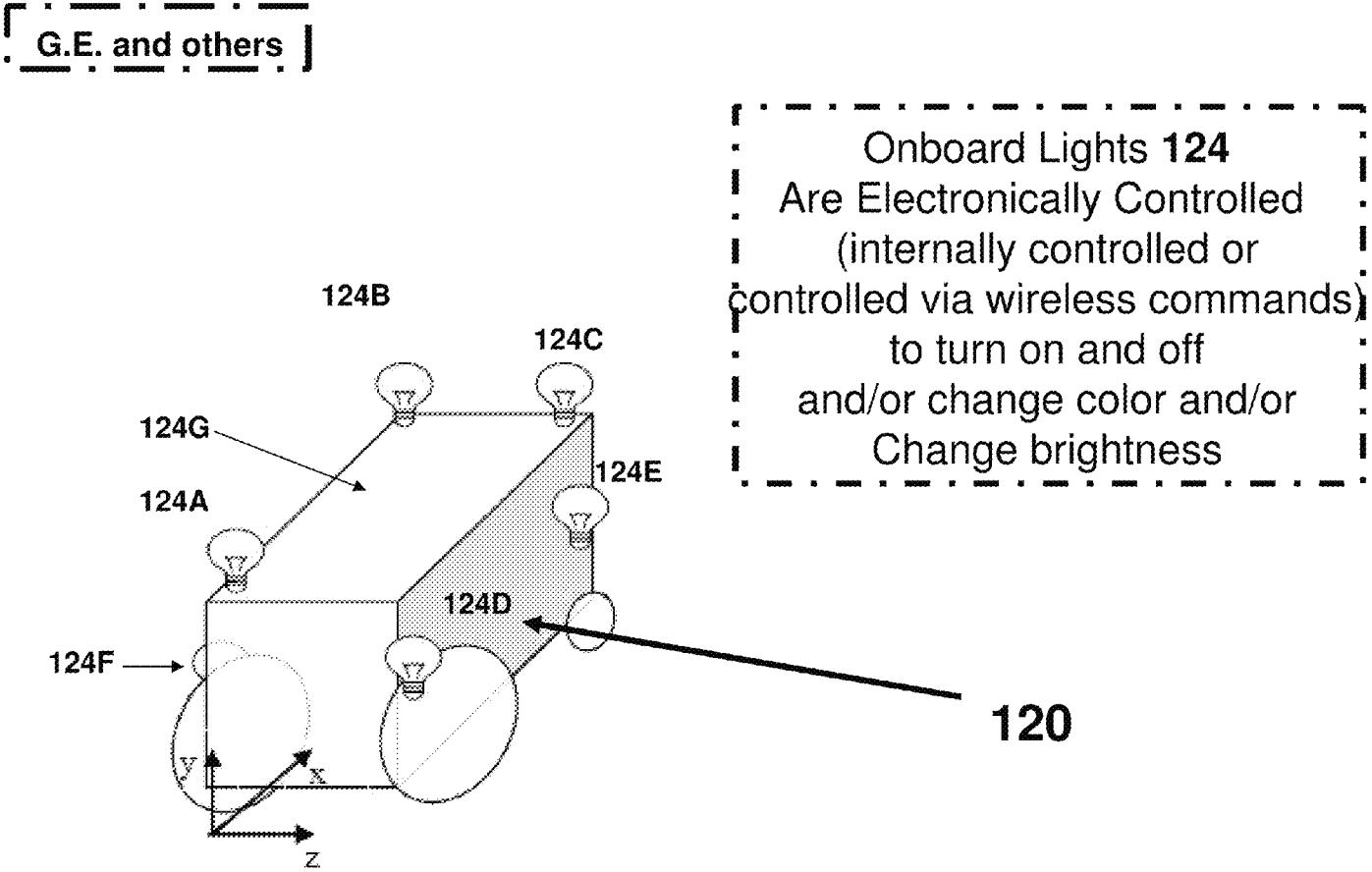
FIG. 2A illustrates a self-propelled motorized vehicle (SPMV) including a plurality of onboard-lights attached to a housing of the SPMV.
Figure 2B:
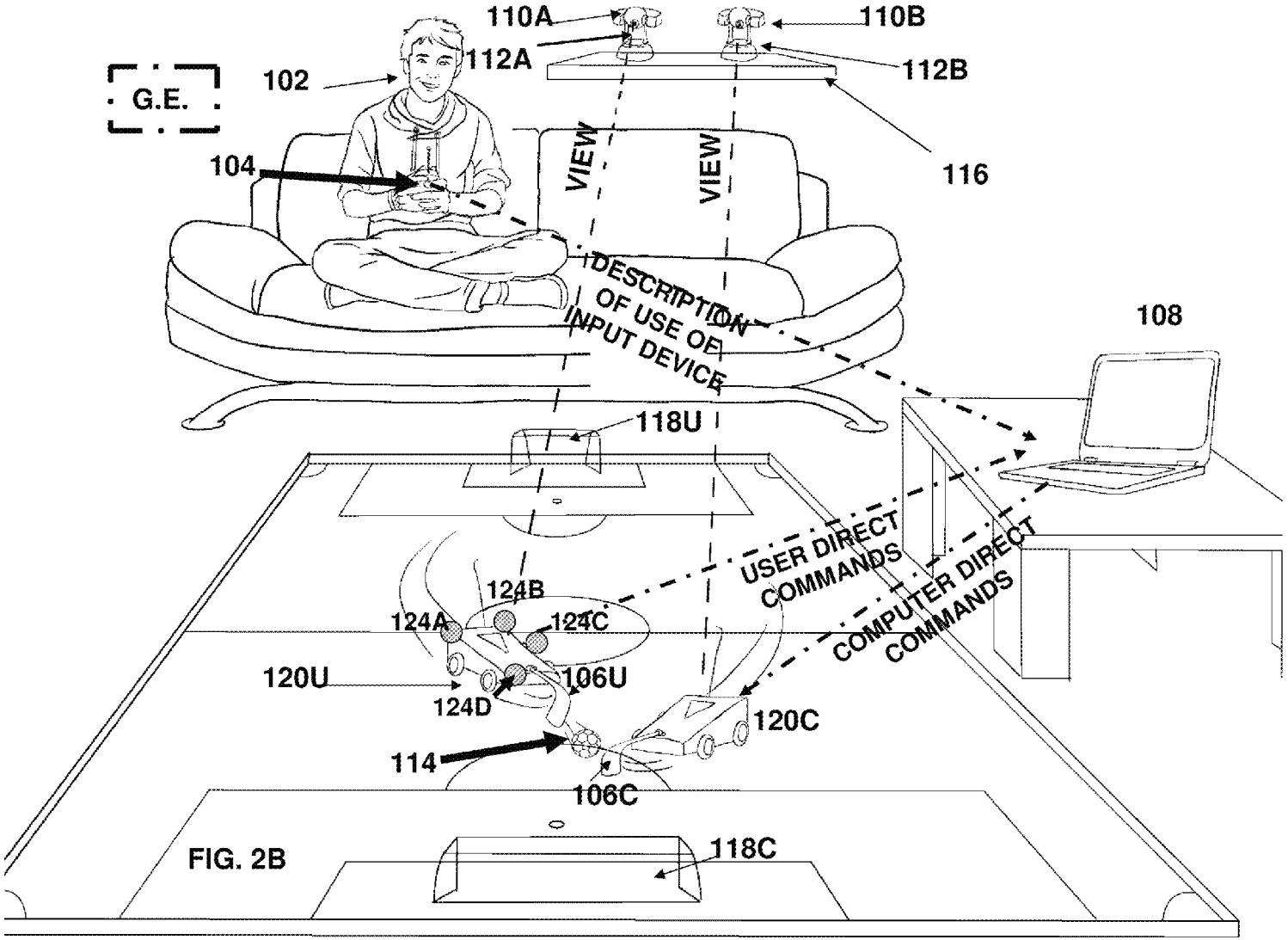
Figure 3A:
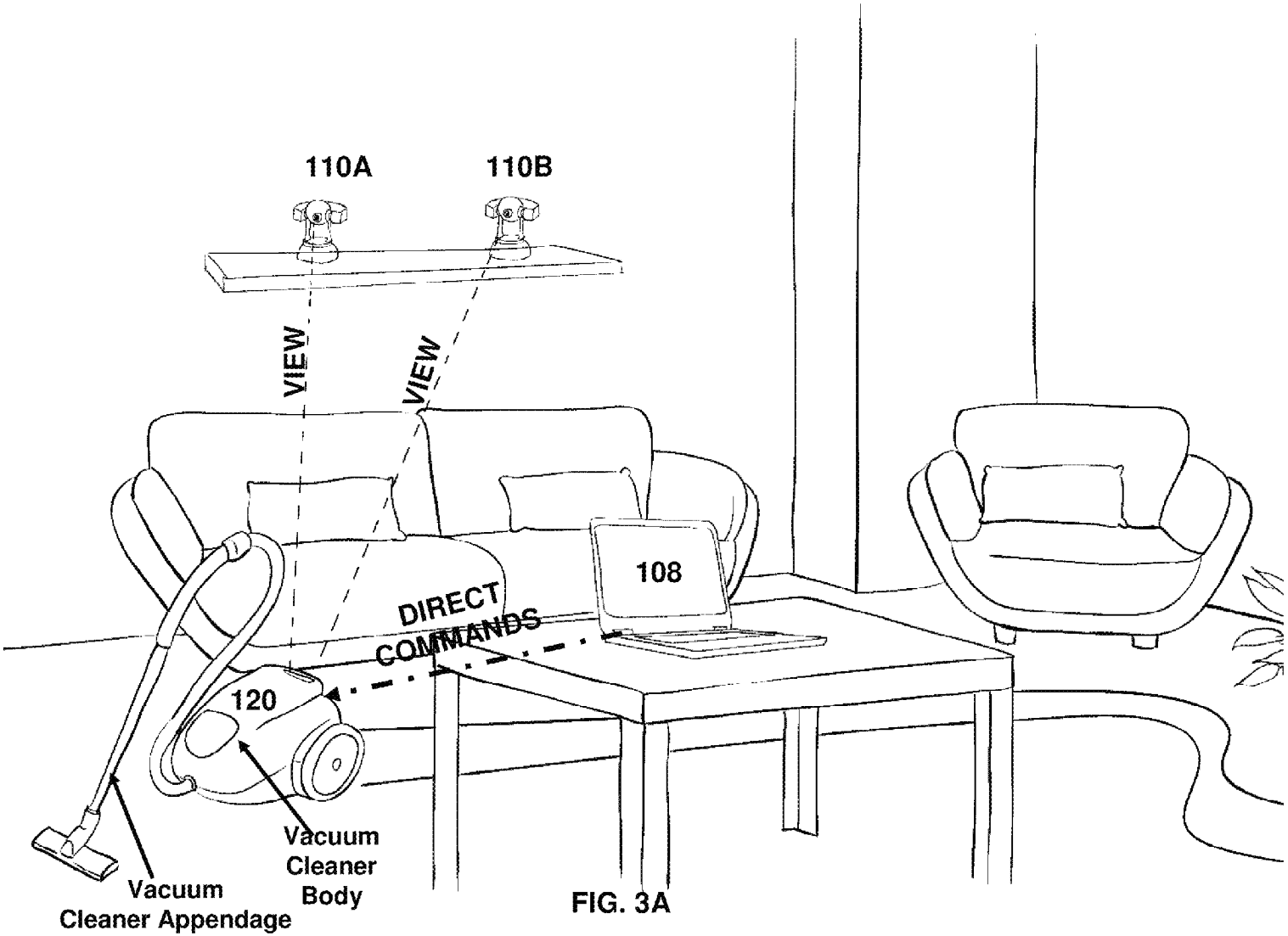
FIGS. 3A-3B illustrate a robotic vacuum cleaner.
Figure 3B:
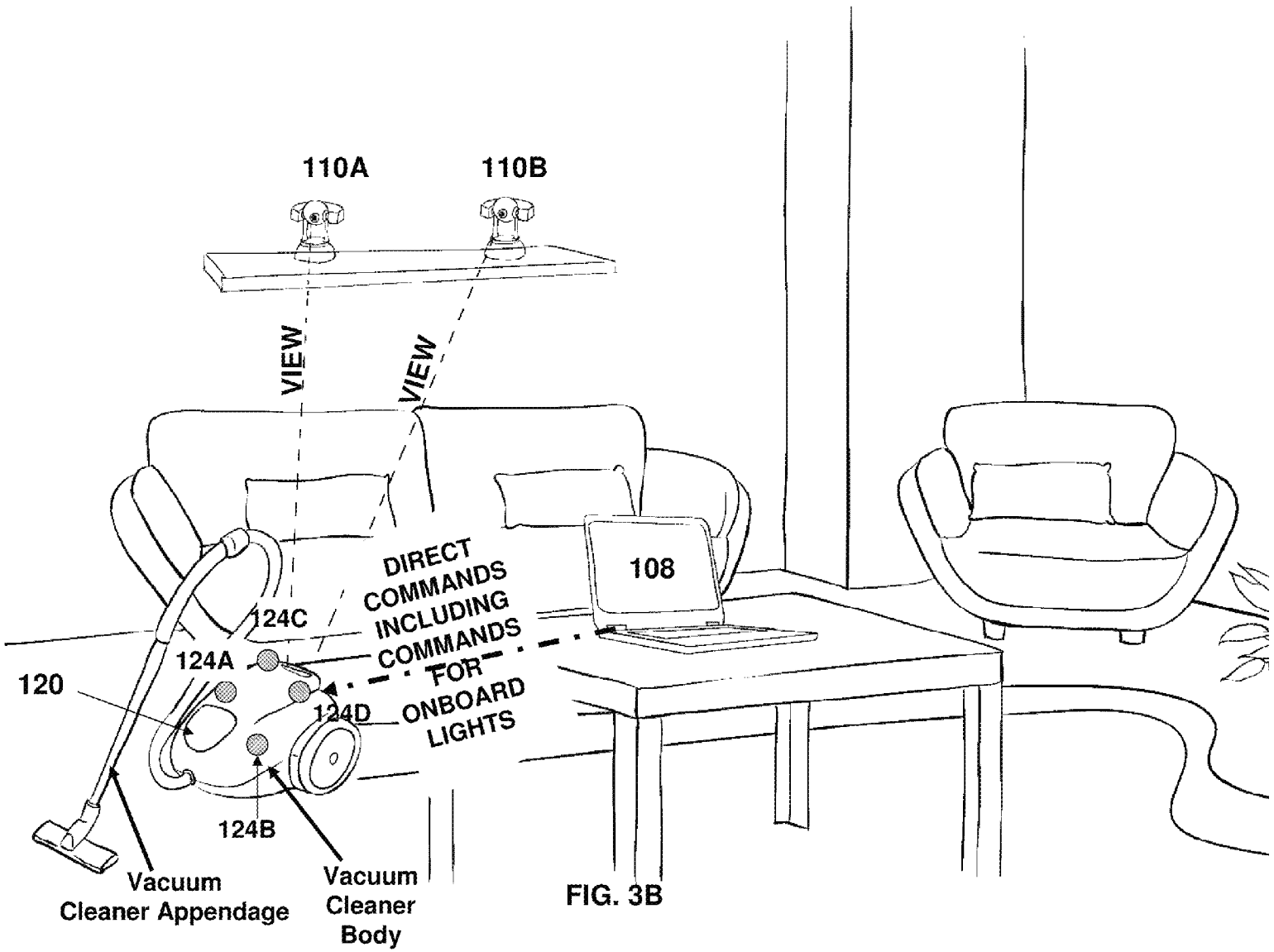

In the non-limiting example of FIG. 2A, SPMV 120 has 8 LEDs 124 placed around it. In this example, these LEDs may be placed roughly as shown. For example, LEDs may be placed in at least three planes. In other embodiments there are fewer LEDs. In yet other embodiments there can be many more. In some embodiments, the position of each LED is known with some precision (typically within millimeters) (see, for example, step S1015 of FIG. 18A). Lights 124 need not be placed in exact positions (such as within a specific plane etc.)

An Discussion LED Positioning System (One Example of a 'Light-Transition' Based Positioning System—See FIGS. 13-16)

One example of an implementation of step S917 (see FIGS. 13, 16A-16B) is discussed in the current section. It is appreciated that the implementation details of this current example are not intended to limit, but rather to explain one single use case.

LEDs provide a very fast and computationally easy method to find a spot in the image with a known world coordinate. Assuming no movement of objects in the scene or the camera, two succeeding images one with the LED off and one with the LED on can be compared (see the discussion which accompanies FIG. 11B).

In one example, the pixels that change (i.e. which are changed $IMG_{POST}$ in relative to $IMG_{PRE}$) are potentially the result of the LED turning on or off. In one example, next an image is created that is composed only of the difference in intensity of the two images (assuming a gray scale image). In one example, next a convolution is performed to blur the image and add the intensity of neighbors to any given pixel. The pixel with the highest intensity may be considered the centroid of the LED flash (thus other techniques for locating a 'centroid' may be used). Using this method, in some embodiments, a few frames are required to locate all eight LEDs. In some embodiments, nine images are certainly enough but there is a way of allowing multiple LEDs to flash simultaneously while still recognizing each location. This may be done by each LED flashing as if spelling a binary number. Using this method, 5 frames may be sufficient. (1: none. 2: 1, 3, 5, 7 on. 3: 2, 3, 6, 7 on. 4: 4, 5, 6, 7 on. 5: 8 on) this method provides far more significant results for large numbers of LEDs. Typically, the CCU (FIG. 1 object 5) takes the images and transfers them to the controlling computer. (The computation is actually simple enough for the micro-controller in the CCU (FIG. 1 object 5) to calculate the results without sending the image to the controlling computer thus saving transfer time.) Finally, as will be described soon, there are situation where two LEDs are sufficient to provide the location and orientation of a SPMV.

In order to achieve good results when detecting flashes, it may be advantageous to set the CCD camera settings to maximize the contrast between on an off. First of all, it may be advantageous for automatic gain control to be turned off. Secondly, it may be advantageous for brightness to be set at lower than the level normally desirable for human viewing. This may be done by lowering brightness to the level where the peak intensity in non-lit images are below 0.8. With this setting bright LEDs cannot be confused for other changes and neither is their reflection.

In some embodiments, it may be advantageous to mount LEDs 124 to SPMV 120 by installing them somewhat inset into the surface or flush with it in order that the reflection of the light on the surface in the immediate vicinity does not affect the calculation of the center-point of the light.

A Brief Discussion of the Robustness Properties of this Method of Using LEDs

This non-limiting 'use-case' system, specifically in the example just cited, relies on the comparison of two images one each of which has a different configuration of LEDs turned on or off. All the pixels in the image are approximately the same in brightness levels with the exception of the location where a LED was turned on or off where there is expected to be a large difference in brightness for a small number of pixels. This located the LED in the image. For any one image we have a number of LEDs which we can use for calibration and later for operating the SPMV.

However, this system may provide an inherent feature that it is particularly robust. It works in a large range of lighting conditions and is very fast computationally. However, it might still be the case that a lighting transition is falsely detected. For example, some other element in the scene might experience a brightness transition by some unlucky chance. Alternatively, the LED itself may be occluded (by being on the other side of the SPMV for example) but it may shine on some other part of the scene which will be recorded as if it was the location of the LED.

The solution depends on the fact that we know the relative positions of the LEDs (the distances and the angles between them). This means that if you have, say, three true LED locations and a false one, we can easily find the false one and remove it. If the camera is calibrated, this is easy. The good ones will have valid distances between them (wherever the SPMV is in the room) and the bad one will have bad distances to the other three. However, even if the camera is not calibrated we can find the "bad guy." It can be shown that a configuration of a few LEDs that include false readings will, in general have NO intrinsic or extrinsic calibration possibility that would produce such a configuration of LED positions. This is because the configuration is constrained by the knowledge we have of the distances and angles between the real-world LEDs. Once we know that the set as a whole is bad, we can choose subsets of LED positions and see whether there is some calibration configuration for the subset. If we find good subsets, we can easily remove those that can fit into no calibration configuration.

As will be discussed below, it may be possible, in some embodiments, to employ 'iterative techniques' for computing one or more calibration parameter(s).

Initial Intrinsic Parameter Calibration

In the current example, the first task is to determine the intrinsic parameters of each camera. An initial estimate of the camera intrinsic parameters may be obtained as part of the manufacture of the system itself and not as part of the user-setup of a particular instance of the system. A simple articulation of the specification of the components is sufficient for input to the further calibration.

The intrinsic parameters are expressed by the matrix A:

$$\begin{matrix} \alpha & \gamma & u0 \\ 0 & \beta & v0 \\ 0 & 0 & 1 \end{matrix}$$

Where:

$\alpha$ is the distance, in horizontal pixels, from the lens plane to the sensor plane (focal length if focused)

$\beta$ is the same distance in vertical pixels $\gamma$ is a measure of the skew of the image u0 is the horizontal pixel coordinate of the image center v0 is the vertical pixel coordinate of the image center Increasing Intrinsic Parameter Precision In some embodiments of the invention, the initial pre-setup estimate of intrinsic parameters is used to calculate a more accurate set of values for the specific instance of the system.

The method used involves keeping the SPMV steady while taking a number of pictures from a single camera whose intrinsic parameters are to be determined until an image location has been measured for each LED on the SPMV. We refer to this as one data set. Next, the SPMV is instructed to turn (and perhaps move) and another data set is measured. This is repeated a number of times ranging from 4 to perhaps 100. It should be stressed that no human-operator involvement is required for this operation. The fact of powering the system in a state where its own records show that calibration has not happened yet is enough to initiate the calibration. The user need only be asked not to interfere and some form of detection of user interference should he/she not cooperate is also required for complete robustness.

The method calculates an optimal value for A such that the expected image locations of the LEDs are as close as possible to the actual positions measured. The distance from the camera to the SPMV is not known. Usually, it is not possible to determine both A and the distance to the SPMV at the same time because we cannot know whether camera magnification or distance from the object is the cause of a particular size. The reason this is not a problem can be expressed as finding the Image of the Absolute Conic or it can more simply be explained as the effect of perspective shortening. The shorter the distance to the object the stronger the perspective effect is. This need not be represented explicitly, the iteration method used implicitly uses it to achieve the correct result.

It is possible to employ the Levenberg-Marquardt Iteration technique which is well known to practitioners in the field; referred to henceforth simply as ML iteration. A good implementation can be found in [Press 2009]. It will be used extensively. In each case we will provide:

1. A mathematical model of a relationship between at least two sets of data
2. The sets of data points
3. An initial guess at the parameters of the model
4. An error evaluation function If the guess is close enough, the iteration will converge on a good value for the parameters of the model.

Assume a coordinate system as in FIG. 2A. The point on the floor (or other surface on which the SPMV has been placed) beneath the back right of the SPMV is arbitrarily considered the point of origin of the world coordinate system. All the locations of the LEDs on the SPMV are specified within this given world coordinate system. We thus have eight (in some embodiments) known points in this coordinate space. Using the flash detection described above we know the location in the image of each of the LEDs. We thus have eight point correspondences.

Writing the homogenous world coordinate vector as X and the homogenous image vector as x, we know that:

$$x=AR[I|-C]X \quad \text{(eqn. 5.2.3.1)}$$

where I is a 3×3 Identity matrix, R is the rotation matrix of the camera relative to the chosen axis system and C is the location of the camera in that system. R can in this case be expressed as a single rotation about a unit vector. For this we need two parameters for the x and y component of the unit vector with the z coordinate implied by the unit magnitude of the vector as well as a third parameter, θ, for the rotation. C is three more parameters and A is expressed in terms of the 5 parameters given above. We already have an initial estimate for the values in matrix A and we need to generate an initial estimate for the remaining six parameters.

The first step is to generate a number of sets of data. Each set of data includes the taking a camera image and locating each of the eight LEDs in that image using the flash detection. Next the camera and/or the SPMV is moved to a different position and orientation relative to the camera and another data set is collected. For this set of data it is preferable that the SPMV is fairly close to the camera in order that the effect of perspective shortening on the further LEDs is more accentuated resulting in more accurate measurement and hence results.

We now have N sets of data each of which contain a number of world-image correspondences. For each data set, the value of matrix A is identical but R and C are different. The ML iteration is therefore required to improve the value of R and C individually for each data set and collectively improve A for all the data sets combined.

We now need to provide an initial estimate for R and C for each data set. This is done by first creating an estimate of the R and then calculating C from this value. We generate a value of R by iterating roughly through the space of possible values for R. A general 3D rotation matrix can be seen as a combination of three independent orthogonal rotations around each of the three axes. We simply divide the complete 2π rotation into 32 (or some such number) divisions. This gives 32 possibilities for the x and y axes each and another 32 for the z axis. This gives 32,768 possibilities. However, since the y axis is essentially the upwards direction, the camera system is on a roughly smooth surface and the camera is installed essentially horizontally, we can assume the z rotation is slight. 3 z rotations are sufficient for the estimate and therefore the number of possibilities to check is thus only ~3000. A modern PC can perform the following calculation 3000 times in much less than a second typically.

For every possible value of R there is one value of C that is the closest to making a good match between world and image coordinates. We calculate this value for C and attach a score to this value of R as a sum of the square of the distance between the calculated image points and the measured image points. The value of R with the lowest score wins and becomes the input value to the ML iteration.

The following is the details of the calculation of C for a given value of R.

We write the world coordinate for any given world point, assuming a unit matrix for the intrinsic parameter matrix A, as W. It is simply calculated as:

$$W=A\cdot X \quad \text{(eqn. 5.2.3.2)}$$

Writing R·[I||−C] as [R||t], we have:

$$x=[R||t]\sim W \quad \text{(eqn. 5.2.3.3)}$$

We write R as $[R_0, R_1, R_2]$ (i.e. $R_0$ is the first row of R), x as [s·u, s·v, s] and t as $[t_x, t_y, t_z]$. We use the period (·) to indicate multiplication for scalars and dot-product for vectors.

A data set includes about six valid correspondences because two LEDs are normally hidden from view. We write the value for the $i^{th}$ data point as X[i], for example.

Thus we get:

$$s\cdot u=R_0\cdot W+t_x \quad \text{(eqn. 5.2.3.4)}$$

$$s\cdot v=R_1\cdot W+t_y \quad \text{(eqn. 5.2.3.5)}$$

$$s=R_2\cdot W+t_z \quad \text{(eqn. 5.2.3.6)}$$

From these we get, using two data values; i,j:

$$t_x=((u[j]\cdot(R_0\cdot W[i]\cdot v[i]-R_1\cdot W[i]\cdot u[i])-(u[i]\cdot(R_0\cdot W[j]\cdot v[j]-R_1\cdot W[j])))/(u[i]\cdot v[j]-u[j]\cdot v[i])$$

$$t_y=((v[j]\cdot(R_0\cdot W[i]\cdot v[i]-R_1\cdot W[i])-u[i])-(v[i]\cdot(R_0\cdot W[j]\cdot v[j]-R_1\cdot W[j]\cdot u[j])))/(u[i]\cdot v[j]-u[j]\cdot v[i])$$

$$t_z=((R_0\cdot W[i]+t_x)/u[i])-(R_2\cdot W[i]) \quad \text{(eqns. 5.2.3.7)}$$

Different results are obtained for every pair of values chosen from the data set, so a few pairs are chosen (1&7, 2&6, 3&5) and the values are averaged. Once a value is obtained for t, the score is calculated by applying [R|t] to every value in the data set obtaining a set of image points that would be where the LEDs would be imaged if the chosen value of R was the correct one. Distances are measured from the calculated values to the real value and the sum of the squares of these distances is the score given to R.

We iterate through the ~3000 values of R and find the R with the lowest score. This value along with the calculated value for the camera center C becomes the estimate that is input into the ML iteration for that data set.

Next we perform ML iteration on this one data set in order to improve the values for R and C. A, the intrinsic parameters of the camera is still held constant. The model for ML used is as follows:

$$P=A[R|t] \quad \text{(eqn. 5.2.3.8)}$$

such that P is the camera matrix. We apply P to each of the world coordinates of the LEDs and thus determine the calculated image points. The error function is the sum of the squares of the pixel distances between these and the actual image locations of the LEDs. Thus we get in improved value for R and t (and hence C) for the data set. This is the value that is used for the next stage.

Next, we combine a number (for example, between 4 and 100) of data sets. Each data set already has an optimal value of R and C of its own. However, they all share a value for A. We now input all the data sets into an ML iteration where the model is exactly the same as the last one. The model is eqn. 5.2.3.8 and the error function is the sum of the squares of the distances between points calculated using PX and the measured locations as before. The only differences are that, we now have multiple data sets each with their own R and C and that all the parameters A, R and C are allowed to change. The only restriction is that while R and C are applied only to the values of their own data sets, all the data sets must have the same A.

As a result we now have an optimal value of A. The same procedure can be applied to each of the cameras since their intrinsic parameters may be different.

In some embodiments, the data sets should be measured with widely differing orientation of the SPMV. The plane (more or less) formed by the top of the SPMV does not change, which is a problem. However, the plane (more or less) formed by the front, back and sides change significantly thus ensuring a robust value for A.

The model we just described will be referred to as the fixed camera center camera matrix model. The process of calculating a seed value for this model will be referred to as the fixed camera center seed determination process and the process for calculating A from this model will be referred to as the Iterative ML fixed camera center process for calibration of camera intrinsic parameters.

We now have a value for A. This need not be determined too often. It should be performed on the initial setup and then infrequently. If the lens on the camera can be adjusted manually, this will change the value of A. Such a change should be discouraged and if it is done, the system should be "informed" in order to do the calculation again.

Extrinsic Parameters Calibration and Pan-and-Tilt System Calibration (See, for Example, FIG. 22B)

Next we seek to determine the calibration, position and orientation of the camera-system in some world coordinate system. Our goal is to develop a model for the extrinsic (R and C) parameters of the cameras as well as the parameters of the servos that pan and tilt the camera. We need to know all the fixed parameters of the model and their relationship to command parameters from the controlling computer.

Again we start with the coordinate system as in FIG. 2A relative to the SPMV. Referring to FIG. 23, we need to determine:

1. The center of rotation of servo 4 in world coordinates (O). This is essentially a measure of where the user placed the camera system.
2. The distance from O to the camera center C, (L). The camera is assumed to be on the axis orthogonal to the axis of rotation. (Thus if servo 4 is not tilted at all the camera is in the center of rotation of servo 3.
3. The angle rotated by servo 3 for every unit of rotation as transmitted by the controlling computer ($k_h$). The controlling computer sends some arbitrarily scaled number to the microcontroller controlling the servo. The latter translates this into some pulse width which is the controlling mechanism for the position of a servo. The unit of rotation used by the controlling computer is referred to as $i_n$.
4. The angle of the camera relative to the chosen world coordinate system when $i_h$ is zero for horizontal servo 3 ($\theta_0$). This is a measure of the orientation of the camera as placed on the surface by the user.
5. The angle rotated by servo 4 for every unit of rotation as transmitted by the controlling computer ($k_v$). This is a similar to $k_h$. It will have a similar value but each servo may be manufactured differently.
6. The angle of the camera relative to the chosen world coordinate system when $i_v$ is zero for vertical servo 4 ($\phi_0$). This is a measure of the orientation of the camera as a function of the position of the midpoint of the servo within the pan-and-tilt system.
7. The angle of the camera as rotated about the z direction. This is the same as the rotation about the z axis when the horizontal and vertical rotations are such that the principle axis is the z direction ($\omega_0$). This is not controlled by the controlling computer and there is no z axis rotation in the pan-and-tilt system. However, the camera may not have been installed absolutely flat and the surface that the camera is on may not be horizontal. This is therefore an important, if minor, correction in the system.

We now develop the model. Assume a coordinate axis system such that the axis of rotation of the horizontal servo (3) is roughly the direction of the y axis. We define θ as the angle that the camera has turned horizontally or specifically that the camera's principle axis makes with the z axis of the world coordinate system in the x-z plane. ϕ is the angle that the camera has turned vertically or specifically the angle that the y axis in the camera's coordinate system makes with the y axis direction of the world coordinate system. From the definitions above we can write:

$$\theta=k_h i_h+\theta_0 \quad \text{(eqn. 5.2.4.1)}$$

$$\phi=k_v i_v+\phi_0 \quad \text{(eqn. 5.2.4.2)}$$

We write O as $[O_x, O_y, O_z]$ and C, the camera center as $[C_x, C_y, C_z]$ $$C_y=L\cos(\phi)+O_y \quad \text{(eqn. 5.2.4.3)}$$

$$C_x=L\sin(\phi)\sin(\theta)+O_x \quad \text{(eqn. 5.2.4.4)}$$

$$C_Z=L\sin(\phi)\cos(\theta)+O_z \quad \text{(eqn. 5.2.4.5)}$$

The extrinsic camera matrix requires a rotation matrix. The model as described so far already specifies the camera center, C. We also have three rotation angles, but they are not orthogonal so a slightly different approach must be used to calculating R.

The vertical servo which rotates the camera about the x axis can be treated as a standard matrix of the form of a Givens Matrix which we'll call Qx:

$$\begin{matrix} 1 & 0 & 0 \\ 0 & \cos(\phi) & -\sin(\phi) \\ 0 & \sin(\phi) & \cos(\phi) \end{matrix} \quad \text{(eqn. 5.2.4.6)}$$

Thinking simply, the matrix for horizontal rotation can also be a Givens matrix of the form:

$$\begin{matrix} \cos(\theta) & 0 & -\sin(\theta) \\ 0 & 1 & 0 \\ \sin(\theta) & 0 & \cos(\theta) \end{matrix} \quad \text{(eqn. 5.2.4.7)}$$

If we calculate the horizontal rotation first, the axis of vertical rotation physically moves with the camera. However, in the new coordinate system (calculated after the horizontal rotation alone) the axis of vertical rotation is actually still the x axis of the new system. Therefore by calculating the vertical rotation second, a Givens matrix can be used too.

We now consider performing the same calculation with vertical axis first. We do this in order to introduce a method for calculating an error due to the fact that the camera may not be situated exactly horizontally but may be skewed a little as represented by a small rotation about its own z axis.

We first calculate the vertical rotation using the vertical Givens matrix above (eqn. 5.2.4.7). However, now the horizontal rotation about the y axis cannot take the simple form of eqn. 5.2.4.6 because in the new coordinate system the world y axis about which the horizontal servo rotates has been rotated too and is now in a new position in the y-z plane. So instead we use the form for a rotation about a unit vector. We use the following routine (defined in C) to generate a rotation matrix expressing a rotation of theta about a unit vector [x, y, z]:

```
void MakeAxisRot(Mat_O_DP& R, DP x, DP y, DP z, DP theta)
{
    DP c = cos(theta); DP s = sin(theta); DP C = 1 − c;
    DP xs = x * s; DP ys = y*s; DP zs = z*s;
    DP xC = x*C;   DP yC = y*C;   DP zC = z*C;
    DP xyC = x*yC; DP yzC = y*zC; DP zxC = z*xC;
    R[0][0] = x*xC+c;     R[0][1] =   xyC−zs;     R[0][2] =
zxC+ys;
    R[1][0] = xyC+zs;     R[1][1] = y*yC+c;     R[1][2] = yzC−
xs;
    R[2][0] = zxC−ys;     R[2][1] = yzC+xs;     R[2][2] =
z*zC+c;
}
```

. . . where DP is a double precision typedef. Mat_DP is a typedef that defines a two-dimensional matrix.

We start off with the y axis vector [0, 1, 0] and apply Qx (eqn. 5.2.4.7) to that thus generating y', the axis for the now not-so-horizontal rotation. We then use the above method with the unit axis y' to generate the second rotation matrix. This method gives identical results to the first method, the difference between the two being simply that the order of matrices has been reversed and therefore in the second method the effect of the first on the second's axis of rotation must be accounted for.

The z axis rotation can be accounted for similarly. Assume that the camera is rotated a fixed angle about its own z axis, $\omega$. If we calculate the z rotation first, the axes of vertical and horizontal rotations will now have to be modified by the z rotation. We can thus use either order of calculating the next two rotations. If we do the vertical first, the x axis is first modified by the z rotation to create a new unit axis x' and then the unit-vector routine given above can be used to generate the "vertical" rotation. Next, the combined rotation matrices can be applied to the y axis to generate y" and the unit-vector routine used yet again to supply the third matrix.

Since the model can now calculate R and C, together with A, we now have a complete model of the camera imaging system including a camera matrix (the basic conversion of world coordinates to image coordinates as given by eqn. 5.2.3.1) in terms of $\alpha$, $\gamma$, u0, $\beta$, v0, $\theta k_v$, $i_v$, $\theta_0$, $\phi$, $k_v$, $i_v$, $\phi_0$, O, C, L and $\omega$.

These parameters change at different times. Assuming that the lens cannot be adjusted, that the length of the arm of the vertical servo is not significantly temperature dependent, that the seating of the camera on the system is not adjusted and that the servos do not start to wear out, $\alpha$, $\gamma$, u0, $\beta$, v0, $k_h$, $k_v$, L and $\omega$ will stay the same all the time. It might be good to calibrate them every now and then but we can refer to these as fixed for a particular instance of the system. Thus an initial calibration is required to ascertain these values and then they can be left unchanged. (The only reason to change these later on is if our system is continuously providing readings which might improve the accuracy of these values.) We refer to this set as the system-constant model values.

Whenever the camera system as a whole, including the base, is moved or turned $\theta_0$,$\phi_0$ and O will change. Thus whenever we determine that the camera base has moved, these values should be recalculated. These can be figured out so quickly that it makes sense to do this often, particularly at start-up or perhaps at the start of each new assignment. We refer to these as the position-constant model values.

$i_h$ and $i_v$, are under direct control of the software running on the controlling computer and consequently C, $\theta$, and $\phi$ change whenever they do. This is the basic action of moving the servos and therefore redirecting the cameras. We refer to these as the controlled model values. The purpose of creating this model has been to determine the values of all the other parameters in the model and therefore to generate the controlled models values and subsequently the Camera Matrix (P=AR[|−C]). If we know all the parameters of the model then every time the controlling computer sends a new servo position instruction we can calculate the complete Camera Matrix including both extrinsic and intrinsic parameters.

The model we just described will be referred to as the pan-and-tilt camera matrix model.

We use this model in three phases:

1. Initial calibration of system-constant model values
2. Subsequent calibration of position-constant model values
3. Determination of controlled models values every time the computer changes $i_h$ and $i_v$, the parameters that control the servos.

For the first phase of initial calibration of system-constant model values we can either accept the system-constant model values as given by the manufacturing process or we can use these given values as inputs to seed an ML iteration and thus improve the values. We also have a number of options as to how to go about improving the values. For all options, the initial procedure is the same:

1. Point the camera at the SPMV 120. (This is easily done by starting the LEDs flashing and moving the camera until the flashing comes into view then centering on the flashing and perhaps determining the boundaries of servo pan and tilt wherein the SPMV LEDs are fully in view.
2. Set the LEDs flashing in order to capture one data set including one set of correspondences between world coordinates of the LEDs and the location of their corresponding images in terms of pixel coordinates in the image. (The origin of the world coordinate system is arbitrarily set for the whole process as the point on the floor below the back right corner of the SPMV).
3. Record the values of $i_h$ and $i_v$ for which the data set was collected.
4. Move the camera to another location such that the SPMV is still fully in view and repeat steps 2. and 3.
5. Collect all the data sets and corresponding servo command parameters and provide them as data for an ML iterative process. The ML process implements the pan-and-tilt camera matrix model as its basic processing model and the error function it uses is the sum of the squares of the distances between the images locations as calculated by the model and the actually measured values.
6. Seed the initial values $\alpha$, $\gamma$, u0, $\beta$, v0, $\theta k_h$, $i_h$, $\theta_0$, $\phi$, $k_v$, $i_v$, $\phi_0$, O, C, L and $\omega$ using one of the processes described below. However, even if we know values for the system-constant model values, we need a way to provide initial seed values for the position-constant model values. This can be achieved by inputting the first data set collected in step 2 and using these as input for a fixed camera center seed determination process. This gives us a value for $\theta$, $\phi$ and C. For the seed value we set O as being L below C. We then calculate $\theta_0$ and $\phi_0$ using manufacturing values for $k_h$ and $k_v$ and using the equations for $\theta$ and $\phi$ given above. We now have all the constant values we need as seeds from the model from the first data sets. For the first as well as all the data sets we now use the values of $i_h$ and $i_v$ from step 3 and the seed values of all the other model values to generate seed values of θ and ϕ.

In order to seed the model we can use one of the following options:

- We can use the Iterative ML fixed camera center process for calibration of camera intrinsic parameters to calculate α, γ, u0, β, v0. We then hold these values constant (the ML implementation we use allows us to choose which parameters of the model are to be held constant and which to iteratively improve) and the rest are left free to change.
- We can accept some of the manufacturing values such as $k_h$ and $k_v$. In other words, we will let these parameters stay fixed during the iteration. These actually can be used to determine a value of α and β without requiring an image that has a lot of perspective shortening. This is because if the angle rotated is known, and the world coordinates are known as well as the change in image locations as result of that rotation, this determines the focal length of the camera. To do this α and β must not be held fixed during iteration. We need not provide an analytic equation for this relationship, it is sufficient that there is a defining relationship with effects clearly outside measurement error for the ML iteration to assign correct values to the model. This represents a new mechanism for calibration of intrinsic parameters of the camera.
- We can set no parameters to be fixed but use all previous values and manufacturing values as seed values that can change in each iteration. In theory this mechanism can work because the perspective shortening defines the values of internal parameters. However, in practice, this method will only produce acceptable results where the SPMV is fairly close to the camera.

Calibrating SPMV Motor Movement (See for Example, FIG. 23)

The SPMV is moved by motors, some of which may contain internal feedback mechanisms which allow them to be set to turn to a specific angle. Such motors may have speed and power controls. The motors will, in general, turn the SPMV or one of its components, or move the SPMV or one of its components. The motors will take some form of input ranging from turn off and on, analog or digital signal input levels, period or frequency in the input signal, duration of input or some such variation that determines the speed, power, angle or some other output parameter.

In general, particularly for cheaper components, the mapping from input parameter to output parameter is not exact. Firstly, each instance of the motor might have a different mapping. Secondly, over time the mapping may change. Motors may wear down or battery charge levels may change resulting in different motors performance. Thirdly, the mapping may depend on such simple differences as the material of the floor or work surface. The SPMV may move much more slowly on carpet as on marble.

For these reasons it is important to create calibration for the mapping of motor inputs on the SPMV to motor outputs. This is done by providing a range of inputs to the motors and for each input monitoring the motor response. A simple example may be sending an "on" signal for a variety of durations and in each case determining the resultant change in the position of the SPMV. The positions of the SPMV before and after the command can easily be determined using all the techniques of location determination using LEDs described here. The result of these measurements is a mapping between a set of inputs and a set of outputs. These can be put into a table and used by "looking up" the desired result and finding the closest appropriate input. Alternately, a mathematical model can be built using standard numeric techniques such that a simple linear or non-linear function relating input to output is described and the constants of that function are determined by the observations.

Determining Pan-and-Tilt State

While using servo positions to both calibrate a system and to provide triangulation information, a problem arises. A servo is controlled by the pulse width of the signal sent to it by its controller. The value of i ($i_h$ and $i_v$) in the previous discussion ultimately translates to a specific period for which the signal is high out of a repetition period of approximately 2 ms. However, servos are built with a deadband which is a range of values within which the pulse width may change without causing any change in position in the servo. The reason for this is to prevent "jittering" as the servo responds to minor noise in the controlling signal.

This may present a problem for our mechanism because it means that the servo position is not an exactly repetitive result of the input i. In practice, if multiple images are taken with the same input value i, each image may differ from the others by a small number of pixels. In one specific configuration this was up to 4 pixels at most. However, higher resolution cameras will mean that this number may be larger. The market for servos includes both "analog" servos with a large deadband and "digital" servos for which the deadband can be controlled. Therefore, for more expensive implementation of this invention this error can be reduced. However, in such cases the microcontroller must guarantee a very exact pulse width requiring fast, dedicated microcontrollers.

We now present a method for handling this servo inaccuracy. This can be applied for the calibration phases as well as for later SPMV guidance phases as will be explained below.

We refer to the input value for the servo position as i. However, we can deal with the deadband issue as if the servo actually received a somewhat different value of i, $i_a$. This is the exact value the servo actually uses to set its position. If a small change is made in the value of i and the change is within the deadband region and the servo does not move at all we can say that $i_a$ has not changed at all. As we continue to increase i, eventually the servo will move a significant amount that is not proportional to the last change in i. We can now say that the value of $i_a$ has "jumped" to a new value proportional to the actual move in the servo. In calibration phases as well as the later SPMV guidance phases we must use the value $i_a$ instead of i in our calculations.

When a change is made in $i_a$, a rotation is effected and the image changes by a specific number of pixels approximately proportional to the change in $i_a$. The number of pixels moved can be counted in principle thus giving a way of figuring out $i_a$. In practice, except for very small changes in $i_a$ close to the principle axis of the camera this relationship is not linear. It is normally a rotation in the image coordinates x and y and it "stretches" as it moves further from the principle axis. We must account for this non-linearity.

The first method applies to the calibration phase. During the calibration phase this can be accounted for simply by allowing the given value of $i_h$ and $i_v$ attached to each data set to change with the ML iterations. This is unusual because these values were data values till now and not model values. Therefore, they must be copied to the model values before the iteration phase. However, a restriction must be applied. The average values of all values of i thus modified must remain the same. Otherwise, the ML engine could simply change arbitrarily in order to minimize the error function. By making this change in the ML model, we can account for the deadband effect during calibration.

A second method for correcting for deadband is during regular camera operation. Later, when the system-constant model values and the position-constant model values have been determined, whenever the camera is moved, instead of applying the new value of i, we can test the change. We use our model to recalculate what we expect the new image to look like. If we had the exact value of $i_a$ we would be correct except for the part of the image that has just moved into view. For the purposes of this calculation we ignore the part of the image that has just come onto view and focus on the remainder: the part of the image that is identical in both images but has been rotated due to the camera movement.

Starting with i as the first guess for $i_a$, we calculate the 3×3 Homography matrix, H, that would convert the first image into what the camera would see if it was rotated by a servo with input $i_a$ and call this the calculated image. We know from our calibration how to calculate R, the rotation matrix that the change in $i_a$ applies to the servo. H is given by $H=ARA^{-1}$ (relevant for step S527 of FIG. 30A and for FIG. 30B)

Where A is the intrinsic camera matrix we have been using all along. Actually this is true only where the rotation is about the camera center. In reality the center of rotation is not about the camera center but for small movements of the center relative to the distance from the points of interest this is often good enough. If it is not good enough, a more accurate equation for H can be used which relies on the fact that most of the points in the image are on a known plane. In our case, that is the plane of the floor or work surface which we have defines as the plane y=0. The general equation for H, where the center of rotation is not the center of the camera is given by a definition of the plane in a coordinate axis of one of the cameras (R must also be converted to that coordinate frame) as $\pi=(n^T, d)^T$ as $H=A(R-tn^T/d)A^{-1}$ (relevant for step S527 of FIG. 30A and for FIG. 30B)

Once we have expected or calculated image and the actual image after rotation we perform a Gaussian convolution causing a slight blurring on both followed by a Sum of Absolute Difference (SAD) between the pixels of the calculated image and the actual image. If the result of the SAD is close to zero we can conclude that indeed ia=i. However, if it is not, we iterate through minor changes in $i_a$ in both directions. For each iteration we calculate H, generate the expected image, blur it and perform the SAD. We then select the iteration with the lowest sum to be the actual value for $i_a$.

This mechanism produces a very good value of $i_a$ but it assumes nothing in the actual scene has changed; only the camera has moved. If the camera is tracking a moving SPMV, this may not be the case. There are a number of potential responses to this issue.

1. One response is that areas of the scene that have really changed will show a bad match for all the test values of i. In that case those pixels do not bias the overall result away from the correct value of i.
2. Another response is that during SPMV guidance, when the SPMV is in the middle of moving, accuracy is not so critical—a few pixels may be acceptable. Once motion has stopped accuracy is more important.
3. Perhaps the best solution is to take more than one (two should be sufficient) images for each camera move. The two images will have identical $i_a$ and therefore the only difference between the two will be due to motion. The pixels involved in the motion should then be excluded from the SAD.

Single-Camera Determination of SPMV Position

Once calibration of system-constant model values and position-constant model values has been completed, the instance is ready to guide a SPMV. Movement commands are sent to the SPMV and, in transit, an LED data set is recorded. This can now easily be used to calculate the position of the SPMV. Since the camera matrix, P, is known we can write for each LED:

$$x=PX \quad \text{(eqn. 5.4.1.1)}$$

where x is the homogenous vector of the image of the LED and X the homogenous vector of the world coordinate of LED. We define the pseudo-inverse of the camera matrix, $P^+$ as $$P^+=P^T(PP^T)^{-1} \quad \text{(eqn. 5.4.1.2)}$$

The theory and calculation of pseudo-inverse is well-known in the field.

Define a vector V that joins the center of the camera, C to the point $P^+x$. Thus:

$$V=C-P^+x \quad \text{(eqn. 5.4.1.3)}$$

We define a line of points in world space as:

$$Pt=P^+x+\lambda V \quad \text{(eqn. 5.4.1.4)}$$

where λ is an arbitrary constant. We know that any point Pt will be imaged at the point x.

We can expand eqn. 5.4.1.4 into its scalar components:

$$Pt_x=P^+x_x+\lambda V_x$$

$$Pt_y=P^+x_y+\lambda V_y$$

$$Pt_z=P^+x_z+\lambda V_z$$

However, since we assume that the SPMV is still on the same surface as that we defined as y=0, we know the $Pt_y$ coordinate of the LED since wherever the SPMV moves (assuming it is either wheeled or can move its legs into a "rest" position) the $Pt_y$ coordinate of the LED will remain the same. If we know the $Pt_y$ coordinate of Pt and we know the other elements of eqn. 5.4.1.4, we can easily calculate A. Once we know λ, we can use eqn. 5.4.1.4 to calculate the $Pt_x$ and $Pt_x$ coordinates of the LED. In theory, two LEDs are sufficient to give the position and orientation of a simple wheeled SPMV since the full world coordinates for any one LED can be calculated fully and independently using this method. Collecting a full data set allows Least Squares method to be used to increase the accuracy. However, if speed is important to generate real-time guidance information, only two LED locations need be measured. Speed is necessary if the method is being used to correct the SPMV that has veered slightly off course and accurate arrival is important. Guidance may also be necessary if for reason of cost the mobility mechanism of the SPMV is very inaccurate.

This method calculates L using the known $Pt_y$ value and then generates $Pt_x$ and $Pt_z$ values. However, this works well for a wheeled vehicle or some other SPMV whose motion type is such that we can know the height of the LED above the floor. For other SPMV kinds, such as those that use legs and therefore the $Pt_y$ coordinate is not known, the location can still be calculated quickly. All that is necessary is to determine more LED pixel locations. We thus have more than one instance of eqn. 5.4.1.4. with different values of λ: $\lambda_1, \lambda_2 \ldots$ . Since we know the relative distances and orientation between the points, we can provide these as constraints on eqn. 5.4.1.4 and thus trivial algebra will provide the real-world location of the LEDs. This method is almost as fast as the method using known height above the floor (work surface) and is still easily fast enough for real-time determination of real-world location using a single camera.

The entire guidance calculation can be performed in well below $1/10^{th}$ of a second with standard cheap cameras and a low-end controller at the camera. This makes this method extremely significant for real-time interaction. The down side of this method is that it applies only to the SPMV or an object outfitted with LEDs at accurately known location. As will be explained later, this method that provides very high speed at low cost can be combined with other methods in order to interact effectively with the environment. This combination is a key teaching of this invention.

When the SPMV approaches the edge of the camera image, the camera must move in the general direction where the SPMV is about to exit the image. At this point i, the input signal to the camera servos will change and the camera model may be used to calculate a new camera matrix. Depending on the constraints of the task, image matching may be used to increase the accuracy of $i_a$ as described earlier.

We have thus far described the single-camera calibration of the camera and servo mechanism as well as the mechanism for fast location and guidance of a SPMV. We now start the discussion of two-camera system that can provide both an internal and an external representation of the 3D geometry of the whole system. This latter mechanism must be integrated with the former single camera mechanism in order to achieve best results.

A Brief Discussion of LEDs on Objects Other than SPMVs

LEDs as described here provide a powerful mechanism for real-time detection of position. It should be noted that this method can also be used to speed detection of other objects besides an SPMV. For example, the goal posts of a game could have LEDs in them to facilitate exact location. In another example, a LED could be embedded in a ball used for Soccer. The significance of this second example is that the object may be moving fast and requires very fast response time.

Stereo System Scene Discovery

In some embodiments, a plurality of camera are used (see FIGS. 1, 3A-3B, 4B-4C). Although not a requirement, use of multiple cameras may be useful for techniques related to stereo scene discovery.

The literature contains a vast amount of methodology regarding scene reconstruction using a stereo rig of cameras. There is no point repeating it here. This document will focus on the implementation details that are specific to this invention. These are as follows:

1. Typical stereo rigs (by no means all) have the two cameras non-moving, or they are fixed on the same moving platform. Additionally they are normally horizontally aligned. Finally, on a fixed moving platform it is impractical to position them more than 5-10 cm away from each other. This severely limits the accuracy of triangulation when working at distances of over a meter. In the case described here the two cameras are at an arbitrary distance from each other and the pan-and-tilt systems are entirely independent. (While arbitrary, it is still recommended that the angle they subtend on the object of interest is not much more than 90°.
2. The stereo rig described here is designed to work in cooperation with the fast, single camera system described earlier. This means that the calibration and camera position may be used to aid the stereo method to be described. It also means that the results of the two systems must be integrated into a single cooperating system.

Pointing Two Cameras at the Same Area

The first challenge presented by an independent pair of cameras is that they need to point to roughly the same area. For depth information to be extracted from the pair of images, the same scene components must appear in the same image.

One solution for this is to combine the images from multiple positions of the same camera into one very large image and apply stereo matching algorithms to a pair of combined images. The method for combining images for a panning or rotating camera is widely discussed in the literature. There are, however, further challenges that arise by using this method.

Here we describe a different solution to this problem. This solution takes advantage of the fact that the camera position and orientation is known to a reasonable level of accuracy. Assume that most points of interest in the scene are on or close to the floor (or the working surface) which defines the y=0 plane. Both cameras can point their principle axis onto the same point on this plane. Clearly some points will appear in one image and not in the other, but around the center of the image, many points will appear in both. Once other planes are detected as described above, the same method may be applied using the walls of the room as reference planes.

Epipolar Matching

The next challenge is that the two cameras will not be, in general, aligned horizontally. Many stereo matching algorithms described in the literature assume that the camera centers of the two cameras can be described as a horizontal translation in terms of the images, with no rotation. In this mechanism, the matching epilines, the lines on which image correspondences will occur, are simply the horizontal lines of the image of the same image y coordinate. In our case, we need to extract the matching epilines from our knowledge of the camera positions and orientation. This will now be described.

All the epilines meet at the epipole. The epipole for first camera is the image of the second camera center in the first image. Since we know the camera matrix of the first camera and the world coordinates of the second camera center we can calculate the epipole for the first image.

We now generate epilines radiating from the epipole in 360°. The number of such lines depends on the resolution we want to work at and the processing power available. Next we find which lines will cross the actual image. For example, a typical image may have pixel coordinates from 0 to 320 horizontally and 0 to 240 vertically. A typical epipole may be at coordinate −1500, 150 which is way off on the left and side beyond the actual image. We calculate which of the epilines cross into the actual image and discard those that do not cross two of the image borders. We are now left with a set of potential epilines from the first image.

We write the camera matrices as $P_1$ and $P_2$ for the first and second cameras respectively, and similarly $C_1$ and $C_2$ for the two camera centers, $e_1$ and $e_2$ for the two epipoles, $I_1$ and $I_2$ for specific matching epilines. We write F, the fundamental matrix (actually the essential matrix since the cameras are calibrated) as:

$$F=e_2^{skew}\cdot P_2\cdot P_1^{+} \quad \text{(eqn. 5.5.2.1)}$$

where $e^{skew}$ is the skew matrix formed from the 3-vector e.

As described in standard stereo matching literature, if an epiline is defined by a vector $I_1$ written as [a, b, c] where ax+by+c=0 is the equation of the line for the epiline, the matching epiline is calculated as:

$$I_2=F\cdot e_1^{skew}\cdot I_1 \quad \text{(eqn. 5.5.2.2)}$$

For all the epilines in the first image that cross the boundaries of the first image, not all matching epilines in the second image cross the boundaries of the second image. In that case both the epilines that do not intersect the second image and the corresponding epilines that generated them must be discarded.

We now have a set of matching epilines from the two images. We can create two new images using them. We will call these epimatch images. The image is formed by creating a fixed interval of the radius from the epipole of each image depending on the resolution and accuracy we want to use for the stereo matching. All the points on the epiline generated using this interval that fall inside the image are used to generate the epimatch image. If we are using a gray-scale image we can, for example, generate the epimatch image pixel by performing a simple bilinear filtering on the four nearest neighbor pixels of the original image. (The generated point on the epiline does not, in general, have integer x-y coordinates.)

The two epimatch images are now of the form used in standard stereo matching literature where each horizontal line of the first image is a corresponding epiline of the equivalent horizontal line of the second image. Standard techniques for matching the features of the two epilines can be used and need not be discussed here. We will however, discuss some fast techniques that take advantage of the integration of the stereo-based information with the single-camera knowledge that we have already gained.

It is important to note that the two epimatch images that have been generated should still retain the original coordinates of the images from which they were generated. This can be achieved simply using a parallel data structure. Once we know which pixel on one epiline matches the pixel of the other epiline, we will use the original coordinates in order to produce the triangulation that gives us the world coordinates of the scene point that generated the two corresponding image points.

It is possible to improve the fundamental matrix F using ML iteration at this stage. If we do not assume that a match must occur only on the actual matching epilines but allow a leeway for finding matches, say on up to 4 nearby epilines we can find and record corresponding points using this relaxed assumption. Any technique may be used to find this new set of corresponding points. Great success was achieved using a simple box matching algorithm. We now have a data set of thousands of point correspondences that should all obey the model:

$$x_2\cdot F\cdot x_1=0$$

If we now create a simple error expression using:

$$\text{Error}=|x_2\cdot F\cdot x_1|/|F|$$

we have all we need for an ML iteration. We can allow the values that comprise F to change in the iteration in order to minimize the error function.

However, this is not a good solution because we move away from the information we have already calculated regarding the position and orientation of the cameras. Our goal is not to change this information but just to get a value for F that maximizes our ability to find matches along the epilines. We therefore can perform the ML iteration and also include data sets from the LED matches or other world-image correspondences that we know. Alternatively we can add to the error function a term that penalizes moving F away from the parameters of the camera matrices underlying it. Another solution is simply to form F' such that F'=HF where H is some homologous transformation 3×3 matrix. We then allow only H to vary in the ML iteration.

Stereo matching algorithms are notoriously slow. This is one reason that we require combining the fast single-camera process for determining the location of a moving SPMV as will be described later.

Identifying Extrusions from a Surface

We now describe a fast method for extracting important scene information from a stereo rig calibrated according to the methods taught here.

Assume all the points in the image are actually part of the floor (or work surface) and thus at world coordinate y=0. Form the epimatch images as described. Next find the x and z world coordinates that would generate the image point if the world y coordinate was 0 using the method described earlier for fast calculation of LED position in section 5.4. Next create correspondences along the epilines ignoring gray-scale or color discrepancies between "corresponding" points but simply using the x and z coordinates calculated for each point along the epiline.

Now perform a slight Gaussian blurring and calculate the SAD of the "corresponding" pixel and perhaps that of a 3×3 box around the pixel. If the value of the SAD is low then we can conclude that the assumption for this pixel was correct and indeed it is part of the floor. However, if the value of the SAD is high, then the assumption is incorrect. We take the "image" of the SAD values and convolve with a larger Gaussian to create a bigger blur in order to accumulate the SAD values of neighbors. We can say that wherever we have a big area of high SAD values, there is some rising from the floor probably corresponding to an object placed on the floor or an obstacle.

This method is fast and produces good results. Furthermore it is a good method to use as a starting point for finding correspondences on the epilines. Normally the problem starts off as an $O(n^2)$ problem where n is the number of points in the epiline because initially any point may match any other point. However, once most of the points have been determined to be floor points, there is only a need to focus on the remaining points and thus n is drastically reduced.

The method can also be applied to planes in the scene that are not part of the floor. Once other planes are detected (vertical ones are normally expected), the same method can be applied to find these. Thus the walls of the room can also be quickly determined.

Identifying Movable Objects

We now describe another method for identifying objects within the scene. The SPMV can be guided to move up to a specific extrusion or some other area that has potential for being a separate object. The SPMV is then guided to apply some force to the object. If the object is relatively rigid and it moves, its movement will have a uniform rigid nature. Motion estimation applied to the images before and after the movement can be analyzed for this kind of rigidity. All pixels participating in the movement may be marked as being part of the object.

Internal Scene Representation

The stereo camera system can be used to generate a complete 3D representation of the scene of interest. Once the multiple stages of calibration have completed, if the system is allowed some time, the cameras can start turning on their own accord and produce stereo images of the entire range of movement of their servos. The methods just described as well as standard stereo scene reconstitution methods are applied to these images. The results are all combined into one internal representation of the entire room. This may take a long time.

However, the result is very impressive. As will now be described, not only does the system now have a "knowledge" of the entire room and all its non-moving components, but now we can display to the user the room he is in using full 3D display technology. Over time this internal representation can be updated if the "motion" that has been detected is determined to be non-transitory.

Having such an internal database of the 3D features of the room and the images captured at different angles also speeds up processing of moving components in the room. When new images are taken, they may be compared to the initial database thus yielding immediately which area of the picture has changed. Stereo recreation of the new object or motion can focus on this area alone and thus reduce the $O(n^2)$ problem described earlier.

3D Scene Visualization

Once we have an entire representation of the scene of interest, this actually takes the form of what is known in the literature as a "point cloud". We have millions of points in the room whose 3D coordinates we know. These are all on the surface that is present to the cameras (ignoring transparent objects). We now want to turn this point cloud into a surface which may be partially planar and partially a very complex surface. The immediate use is for a visual representation. However, there are other uses including object recognition.

The method used to turn the point cloud into a surface is called tessellation. Methods for tessellation are described extensively in the literature and need not be expanded upon here. The only point specific to the methods described here is the starting point of tessellation. Tesselation works well when it starts with a 2D grid of points (each of which has 3 world coordinates: x-y-z). The 2D grid coordinates may be arbitrary as long as they make tessellation easy. The 2D grid chosen is the grid of pixels in the first epimatch image described above. The epimatch image specifies whether a pixel has a corresponding pixel in the other epimatch image and therefore that this pixel is a valid point on the grid.

We therefore have a 2D grid with some elements of the grid invalid and the remaining elements representing a pair of corresponding image points and therefore a valid world coordinate from the pixel cloud. The first task of the tessellation is to create triangles that are formed from points of the grid as close to each other (on the grid) as possible while avoiding the invalid elements.

The basic algorithm for tessellation works with pairs of grid lines generating basically optimal triangles as it goes along the lines. We try to generate pairs of triangles each time, one bottom-left and the other top-right. The disturbing factor is that an invalid grid element cannot generate the vertex of a triangle. In the simplest case we start with four adjacent valid elements two along the top and two on the bottom which generate two simple triangles.

In other cases, the there may be invalid elements on the bottom or top and the algorithm has to deal with these accordingly. We provide the C source code for the implementation of a tessellation algorithm. The code is commented sufficiently to understand the algorithm. The only detail that one needs to know about the structures provided is that STesselEl holds the data for each element in the tessel grid and that it includes a member bWCValid that has value true if the grid element has valid world coordinates associated with it and is thus valid for use as a vertex in a triangle of the tessellation process.

```
/*
Function:
    ProcessLinePair
Purpose:
    Generate all the triangles that are valid between two
grid lines
Parsameters:
    listTris: List of triangles to generate as the result
of tesselation.
        Each triangle consists of three vertices.
        Each vertex consists of a pair of coordinates
that are the horizontal and
        vertical coordinates of the pixel grid.
    teTStart: element of top tessel grid line to start
with
    teBStart: element of bottom tessel grid line to start
with
        The element following these can be accessed by
adding integers to pointers
        actually the integer added is iB for the bottom
line and iT for the top line
    w: width of line in tessel grid
    iGL: horizontal index of first grid element to process
on the top line
    iGT: vertical index of top line
*/
void ProcessLinePair(CListTris& listTris, STesselEl *
teTStart, STesselEl * teBStart,
                                int w, int iGlL, int iGlT)
{
    int iT=0;
    int iB=0;
    STesselEl * teT = teTStart;
    STesselEl * teB = teBStart;
    // find first vali element along top line
    while (!teT->bWCValid) {
        iT++;
        if (iT == w) {
            return;
        }
        teT++;
    }
    // Loop along line as long as there are still some
triangles to produce
    while (1) {
        // When we return here in the loop we are
"starting clean"
        // as opposed to closing up open triangles
        // Declare the two objects to hold the triangle
        // Tri1 is the bottom left (BL) triangle and Tri2
the top-right (TR)
        UTri Tri1, Tri2;
        // The top left valid element is the first vertex
for both triangles
        Tri1.x[0] = iGlL + iT;
        Tri1.y[0] = iGlT;
        Tri1.n=1;
        Tri2.x[0] = iGlL + iT;
        Tri2.y[0] = iGlT;
        Tri2.n=1;
        // Search for the first valid element on the
bottom line. We search
        // for the rightmost valid element that is not
right of the first vertex.
        iB = iT;
        teB = teBStart + iB;
        bool bNoBelowLeft = false;
        while (!teB->bWCValid) {
            iB--;
            if (iB < 0) {
                bNoBelowLeft = true;
                break;
            }
            teB--;
        }
        // if there is one, make it the second vertex of
the BL triangle
        if (!bNoBelowLeft) {
            Tri1.x[Tri1.n] = iGlL + iB;
            Tri1.y[Tri1.n] = iGlT - 1;
            Tri1.n++;
```

-continued

```
        }
        // The following loop will iterate we find a
valid
        // element on the top row.
        // Each iteration moves both top and bottom
element one to the right
        // It keeps going if we are skipping both top and
bottom or just
        // building trinangles from elements of the
bottom line
        iB = iT;
        teB = teBStart + iB;
        bool bKeepGoing = true;
        while (bKeepGoing) {
            // returning here in this inner loop means
that we are not "starting clean"
            // but rather finishing off triangles that
already have one or
            // two vertices defined.
            //we start by simply finding the next two
elements top and bottom
            iB++; iT++; teT++; teB++;
            // if we got to the end of the line we need
generate no more triangles
            if (iT==w) {
                // we're done
                return;
            }
            // the simple case is where the right side
has valid top and bottom
            // we close up either one or two triangles
and store them
            if (teT->bWCValid && teB->bWCValid) {
                // if the BL triangle already had two
points we generate it
                // otherwise this candidate is
discarded because after this
                // we "start clean"
                if (Tri1.n==2) {
                    Tri1.x[2] = iGlL + iB;
                    Tri1.y[2] = iGlT − 1;
                    Tri1.n = 3;
                    // this is how we store a new
triangle by adding it to the list
                    listTris.push_back(Tri(Tri1));
}
                // there is always a TL triangle in
this case
                // the order here is important for
backface culling
                Tri2.x[1] = iGlL + iB;
                Tri2.y[1] = iGlT − 1;
                Tri2.x[2] = iGlL + iT;
                Tri2.y[2] = iGlT;
                Tri2.n = 3;
                // stoe TL
                listTris.push_back(Tri(Tri2));
                // get out of this loop and "start
clean".
                bKeepGoing = false;
            }
            // the second case is one where we have no
valid bottom element
            // in this case we will only generate one
triangle before
            // starting clean
            else if (teT->bWCValid && !teB->bWCValid) {
                // If we already have 2 points this is
an easy option,
                // we just need to close up BL
                // actually this is neithe BL or TL
because there is only 1
                if (Tri1.n == 2) {
                    Tri1.x[2] = iGlL + iT;
                    Tri1.y[2] = iGlT;
                    Tri1.n = 3;
                    listTris.push_back(Tri(Tri1));
                }
                else { // we need to find a partner at
all costs
                    // however we know that the next
top will also not find
                    // a vetex below left so we are
allowed to do this
                    bNoBelowLeft = false;
                    while (!teB->bWCValid) {
                        iB++;
                        if (iB == w) {
                            bNoBelowLeft = true;
                            break;
                        }
                        teB++;
                    }
                    // use of the name bNoBelowLeft is
somewhat misleading
                    // because we are actually saying
that we found a vertex
                    // below but to the right of the
top vertex
                    // anyway, if there is a valid
element close up one triangle
                    if (!bNoBelowLeft) {
                        Tri2.x[1] = iGlL + iB;
                        Tri2.y[1] = iGlT − 1;
                        Tri2.x[2] = iGlL + iT;
                        Tri2.y[2] = iGlT;
                        Tri2.n = 3;
listTris.push_back(Tri(Tri2));
                    }
                }
                // start clean.
                bKeepGoing = false;
            }
            // If we only have a valid bottom element we
add a vertex and loop again
            else if (!teT->bWCValid && teB->bWCValid) {
                Tri1.x[Tri1.n] = iGlL + iB;
                Tri1.y[Tri1.n] = iGlT − 1;
                Tri1.n++;
                // on the way if we have three vertices
                // we can store a BL triangle and then
make its right
                // edge the left edge of the next
triangle
                if (Tri1.n == 3) {
                    listTris.push_back(Tri(Tri1));
                    Tri1.x[1] = Tri1.x[2];
                    Tri1.y[1] = Tri1.y[2];
                    Tri1.n−−;
                }
            }
            // else implied - go round for another go
            // we simply move the search for both top
and bottom pair
            // one to the right until at least one of
the two is valid
        }
    }
}
```

The method as described provides one way to produce a triangle mesh from the point cloud calculated in the previous sections. The triangle mesh can now be used with any standard 3D rendering engine such as DirectX or OpenGL in order to present to a user a 3D representation of the screen. Such engines provide the ability for the user to move a virtual view-camera around the scene and inspect it from different angles. This provides a very intuitive and useful way to interact with the scene for both programmers and users. It is possible to zoom in on an item of interest or inspect from a different angle.

A triangle mesh by itself does not provide all the information that the 3D model can present. The way to create an impressive information-laden image is to apply the images from the camera as a texture for the mesh. This is easily done given the methods described so far. The point cloud that was used in the tessellation process includes a 3D world coordinate associated with the point but also the original pixel coordinates of each of the camera images used in the triangulation. These images can be applied as textures with the texture coordinate associated with each vertex in the mesh being the original pixel coordinates. There are two textures whereas a simple texturing process requires but one. Some implementations may choose to use only one of the textures. Other implementations may choose to apply both textures with an alpha value of 0.5 applied to each. Advanced 3D graphics engine support such multiple texture application.

Of course, with only two cameras, any scene components hidden from either of the two images will not be displayed in the internal representation or in the graphic display. This can be resolved by adding more cameras at different angles on the scene. Thus, some implementations will choose to utilize any number of cameras using similar methods to those taught by this invention.

There are various methods for combining triangulation from more than two cameras. The literature includes mathematical treatments of n-camera systems where n>2. Other implementations may choose to stay with the 2-camera system as described. Each pair of camera triangulates coordinates as described. There will therefore be some points that are calculated multiple times with slightly different coordinates in each case (usually). In that case a simple weighting system can be used to integrate the different results.

Incidentally, multiple camera systems can also be used to cover more complex scene geometries. For example a corridor with corners may be represented using a number of cameras such that each part of the corridor is covered by at least two cameras (where coverage includes the ability to turn the pan-and-tilt system towards the point of interest). In that case the system as described can be used both to get better all-round information as well as to allow camera hand-off as the area of interest is progressed along the corridor.

Smoothing Visualization Surfaces

The image produced by the 3D graphic engine using this method is satisfactory but much image detail is lost. The reason for this is that since the triangles are small and the surface has a large degree of fluctuation (due to calculation and observation error factors) relative to the size of the triangle, the normals of the triangles vary quite strongly. This causes the texture of the individual triangles to be viewed at angles that distort the detail of the overall texture.

There are a number of solutions which will be now presented to this issue that provide rather excellent results:

1. For surfaces that are more or less planar or locally planar, a simple algorithm such as least-square distance can be used to calculate the equation of that plane. The world coordinates are then calculated with the restriction that the point lies on the plane. For this the algorithm described in section 5.4 for the intersection of the vector from the camera center to image point and the plane performs well.
2. Another solution is to perform a 3-dimensional convolution with a Gaussian on all points on the tessel-grid. This creates a blurring in the 3D domain which produces a good image for many surfaces.
3. A third solution is to perform the following steps:
   a. For each element in the 2D tessel-grid, find the normal of all triangles adjacent to the element and perform an average of these to calculate a normal for the element itself.
   b. Perform a 2D Gaussian convolution on the tessel-grid but apply it to the normal of the grid element. This has the effect of blurring the direction of the normal or, in other worlds, making the differences between neighbors less strong.
   c. Calculate the distance neighbors on the grid are in front of or behind the normal of any specific element.
   d. Average over these values and move the element such that its location along this normal is equal to the average.

Using any of these methods produces an excellent image with most of the scene showing at the resolution of the original image.

Method 1 above, however, will be used in any case to analyze the significant planes in the scene. Any areas of the mesh that are significantly different from the nearby plane are considered as an object in their own right for the purposes of the internal representation.

Interacting with the Visualization

When a user clicks on any point in the 3D graphic representation of the scene, advanced engines are capable of providing the nearest vertex to the 3D representation of the location of the mouse click. This feature may be used to allow the user to interact with the scene details. The click is used to make a selection which may be interpreted as follows:

- It may be interpreted as an object selected. In this case the object could either be identified as such due to a significant divergence from the plane as just described in sections 5.5.3 and 5.5.4.
- It may be interpreted as a single point location in terms of a specific 3D world coordinate.

This selection can either be used:

- To create a label. In this case the user either creates a new label or is asked to select from a list of labels that the specific application has defined. In this way a user simply and intuitively can input the mapping of the application to the instance that this specific scene represents. For example, an application may use the concept of "goal post" and the user is thus indicating what location or object should be treated as "goal post" in this specific scene.
- To refer to a previously created label. Here the instance of the application running on the controlling computer already knows the mapping of label to coordinate or object. In this case the user is inputting a choice regarding the object. For example, there could be a number of objects and the user wants the robot to pick up the selected object now.

We have thus described a system that uses controllable cameras to calibrate itself and build an internal representation of a scene, that can guide a robot in real-time within the scene and that can provide a 3D graphical interface that can interact with the user both by providing visual information about the scene to the user and by accepting input from the user regarding components of the scene.

Application Development

We now describe a programming environment which is designed to allow programmers to create applications for the system described in this document. An application created using the programming environment is software that is written once but runs on many instances of the system. At any one time, a specific application is running on an instance of the system. When we refer to the programming or development of an application we mean the application as a class. When we refer to the use or operation of an application we mean a specific instance of the application.

The purpose of an application is to specify the behavior of a robot as a function of:

1. The current state within a Finite State Machine (FSM)
2. The configuration of a specific scene
3. The choices of the user regarding the currently desired activity.
4. The location and orientation of the robot and its accessories.

The behavior of a robot refers to the specific action its motors and servos perform. This may be specified in direct terms of motor or servo behavior. For example, the application may specify a current location target, it receives input regarding, the current location and orientation of the robot and together with an immediate history of previous locations it will provide directions to the motors in terms of power, voltage and timing.

The system as described frees the programmer from any vision analysis, triangulation or such like. The program can be written simply in terms of the world coordinates as described in the document till now. This can take two forms. It can be specified in absolute coordinates or in coordinates relative to a specific object within the scene. Thus an application can receive coordinate for a robot and take action accordingly. This puts programming of the application within the area of expertise of a large pool of programmers as opposed to the very specific specialization of say, stereo scene geometry. The application is written in terms of objects referred to by labels. Thus in the example given before, a programmer may write an application in terms of "goal posts". The application may choose not to specify what or where the "goal post" object actually is. There are two choices of implementation. In one, the system can provide the application with the geometry and coordinates of all objects of the scene together with the image of them and the application will apply object recognition techniques and context to specify that a given object is a goal post. Alternatively, the application may ask the user to make a selection using the selection-interaction system described in section 5.7 in order to specify to the application which object should be the "goal post". Either way, the goal post ends up as a specific object with a location in the application instance and the program can execute instructions relative to the object/location.

In the hierarchy, system-application-instance, application does not mean all the software. The system itself includes a layer of software and the application is a layer of software on top of the system software. In the preferred implementation, the system layer of software runs on the controlling computer and comprises the entirety of the firmware on the camera system and the robot.

We now describe one possible method of interaction between the application and system software.

The system software runs the user interface application. It therefore controls the screen resources. The system as seen by a user on the controlling computer is a 3D graphic environment. The standard method of writing applications where the application controls menu items, buttons etc. is not applicable in this case. The application software may run as a separate executable, a dynamic link library (DLL) or as a script compiled or interpreted by the system software. If it is a separate executable it must establish communication mechanisms with the system software. If it is a DLL, it provides call-back functions for the system to call. In any of these three cases, it will not control any screen resources directly. Nevertheless the application designer requires the user to interact with the system in a way specific to the application.

The method proposed for doing this is that the application provides artificial objects for inclusion in the 3D graphic environment. For example, the application may provide the triangle mesh and texture for a red 3D cube that when pressed ultimately calls an application function. The application function may change the color of the cube to green to provide feedback to the user of the interaction and simultaneously launch a routine to, say, move the robot to the first base. The system software renders the cube in the scene as if it was part of the room. These artificial objects will be referred to as interaction objects. The application can chose to place the interaction objects in the scene in one of two ways:

The interaction object may be placed in the scene in terms of coordinates relative to the user's virtual view camera. Thus the object might always appear on the lower right side of the screen. The camera referred to here is not the real physical camera but just the view camera as generated by the 3D graphics display engine. As the user pans around the scene, the objects of the scene will obviously be seen to move across the screen. However, the interaction object will stay in the same place on the screen (unless the application chooses to move it).

The interaction object may be placed in the scene in terms of absolute world coordinates or relative to labeled objects. For example, an interaction object may be placed on the floor (y=0 plane) of the scene, next to the object with the "goal post" label. In that case, the user sees a 3D representation of the room he/she is sitting on the screen. However, somewhere on the floor as seen on the user's screen, there is also an object that is not present in the real room on the floor.

The application is provided notification whenever the user's mouse moves over the interaction object and whenever the user clicks on the object. The application can at any time provide new information to the system software regarding the 3D shape, texture, color, position or orientation of the object and the system software will immediately update the user's screen accordingly. Normally, such changes occur as a result of information the application receives regarding the user's mouse activity. However, such changes could also occur as result of developments in the state of the application or simply as a function of time.

The application is informed regarding any change in the scene that the system is aware of. This would definitely include changes in the robot position. It may also include other real-time movement of objects in the scene. The system uses motion estimation on the background of a static image to recognize when a small area of the image has changed. In that case triangulation information for a small area may be achieved at speeds that are good enough for real time. The application is informed of such changes. The most significant change of this type is when an object that has a label attached is moved. In such cases the application would require the system to recognize that the object in the new position is the same as the one in the old position.

It is further noted that any of the embodiments described above may further include receiving, sending or storing instructions and/or data that implement the operations described above in conjunction with the figures upon a computer readable medium. Generally speaking, a computer readable medium may include storage media or memory media such as magnetic or flash or optical media, e.g. disk or CD-ROM, volatile or non-volatile media such as RAM, ROM, etc. as well as transmission media or signals such as electrical, electromagnetic or digital signals conveyed via a communication medium such as network and/or wireless links.

Having thus described the foregoing exemplary embodiments it will be apparent to those skilled in the art that various equivalents, alterations, modifications, and improvements thereof are possible without departing from the scope and spirit of the claims as hereafter recited. In particular, different embodiments may include combinations of features other than those described herein. Accordingly, the claims are not limited to the foregoing discussion.

What is claimed is:

1. A method of operating a self-propelled motorized vehicle (SPMV) in accordance with camera calibration data of an electronic camera, the camera calibration data defining a map between pixel-image locations and real-world locations, the SPMV including one or more onboard lights the method comprising:

a) electronically controlling the onboard light(s) of the SPMV to induce an illumination transition that modifies brightness and/or color of one or more of the onboard lights;

b) comparing first and second electronic images acquired by the camera, the first image being a pre-transition electronic image describing the SPMV before the illumination transition and the second electronic image being a post transition electronic image describing the SPMV after the illumination transition; and c) in accordance with results of the comparing and in accordance with the camera calibration data defining the map between the pixel-image locations and the real-world locations, electronically controlling rotational and/or translational movement of the SPMV or a portion thereof.

2. The method of claim 1 wherein: (i) the comparing of the first and second electronic images is performed so as to determine, for each onboard light of the one or more onboard lights, a respective pixel-image location; (ii) the method further comprises determining, from the respective pixel-image location(s) of each onboard light(s) and from the camera calibration data defining the map between pixel-image locations and the real-world Euclidian locations, a respective real-world Euclidian location of each onboard light(s); and (iii) the electronic controlling of the rotational and/or translational movement or the portion thereof is performed in accordance with the respective real-world Euclidian location of each onboard light(s) as determined by image comparing and the camera calibration data.

3. A system comprising: a) a self-propelled motorized vehicle (SPMV) including one or more onboard lights operative to effect an illumination transition that modifies brightness and/or color of one or more of the onboard lights b) an observing camera operative to acquire a time series of images of a scene including the SPMV; and c) electronic circuitry operative to: i) determine a real-world location of the SPMV according to the illumination transition as described by the image time series and according to camera calibration data for the observing camera, the camera calibration data defining a map between pixel-image locations and real-world locations; and ii) control rotational and/or translational movement of the SPMV or a portion thereof according to the determined real-world location of the SPMV.

4. The system of claim 3 wherein the Euclidian location of the SPMV is determined primarily by analyzing one or more image(s) of the image time series.

5. The system of claim 3 wherein the controlling of the rotational and/or translational movement of the SPMV is carried out according to the combination of:

i) the Euclidian location of the onboard light(s); and ii) other information derivable from one or more electronic images acquired by the camera.

6. The system of claim 3 wherein the other information describes one or more foreign objects in the scene.

7. The system of claim 3 wherein the foreign object information is selected from the group consisting of color information for the foreign object, surface texture information for the foreign object, and motion information describing translational or rotational motion of the foreign object.

8. The system of claim 3 wherein the controlling of the rotational and/or translational movement of the SPMV is carried out according to the combination of: i) the Euclidian location of the onboard light(s); and ii) information that is a Euclidian description of a real or virtual boundary in the scene.

9. The system of claim 3 wherein the controlling of the rotational and/or translational movement of the SPMV is carried out according to the combination of: i) the Euclidian location of the onboard light(s); and ii) a stereoscopic description of the scene obtained by analyzing images from multiple observing cameras that view the scene.

10. A system comprising:

a. a self-propelled motorized vehicle (SPMV) including one or more onboard lights operative to effect an illumination transition that modifies brightness and/or color of one or more of the onboard lights;

b. an observing camera operative to acquire a time series of images of a scene including the SPMV such that a first image of the time series is a pre-transition electronic image describing the SPMV before the illumination transition and a second electronic image of the time series is a post transition electronic image describing the SPMV after the illumination transition; and c. electronic circuitry operative to (i) compare the first and second electronic images to determine for each onboard light of one or more of the onboard lights, a respective pixel location within the first and/or second electronic image;

(ii) determine, from the pixel location(s) and from camera calibration data for the camera, a respective Euclidian location for each onboard light of the one or more onboard lights, the camera calibration data defining a map between pixel-image locations and real-world locations; and (iii) in accordance with the determined Euclidian location(s) of the on-board light(s), electronically control rotational and/or translational movement of the SPMV or a portion thereof.

* * * * *